US005184184A

United States Patent [19]

Hayashi et al.

[11] Patent Number: 5,184,184

[45] Date of Patent: Feb. 2, 1993

[54] IMAGE FORMING APPARATUS

[75] Inventors: Keisuke Hayashi, Fujisawa; Kouji Ishigaki, Yokohama; Kazuyuki Nakahara; Masato Yanagida, both of Tokyo; Fumio Kishi, Yokohama, all of Japan

[73] Assignee: Ricoh Company, Ltd., Tokyo, Japan

[21] Appl. No.: 835,579

[22] Filed: Feb. 14, 1992

[30] Foreign Application Priority Data

Feb. 17, 1991 [JP] Japan ..... 3-045885

[51] Int. Cl.[5] ..... G03G 21/00

[52] U.S. Cl. ..... 355/296; 355/260; 355/297; 355/298; 222/160; 222/325; 222/DIG. 1

[58] Field of Search ..... 355/296, 297, 298, 306, 355/260, 269, 270, 203, 204, 200, 202, 210, 211; 222/160, 325, DIG. 1; 141/364-366, 346, 383

[56] References Cited

U.S. PATENT DOCUMENTS 4,062,385 12/1977 Katusha et al. ..... 222/DIG. 1
4,502,514 3/1985 Ballard et al. ..... 222/DIG. 1
4,614,286 9/1986 Yamaguchi et al. ..... 222/DIG. 1
4,972,887 11/1990 Hacknauer et al. ..... 222/DIG. 1
4,997,016 3/1991 Hacknauer et al. ..... 222/DIG. 1
5,091,750 2/1992 Yoshida et al. ..... 141/366 X

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

A copier, facsimile transceiver, printer or similar electrophotographic image forming apparatus uses a toner cartridge whose volume decreases when released a toner. A cartridge collecting section for collecting toner cartridges is lower in height than the cartridge when the cartridge is filled with a toner. The cartridge has top plate, a bottom plate and sides which are implemented by an elastic member or a film-like member. The cartridge collecting section, a waste toner tank and a photoconductive element storing section are constructed into a unit which is removable from the apparatus body.

20 Claims, 77 Drawing Sheets

10
40
43
44
45
ADC
EVEN
ODD
41
42
50
51
GA1
52
GA2
53
GA3
54
GA4
55
GA5
56
CLOCK GENERATOR
57
ADM
58
RAM
20
30
31
32
33
M
E

BOX INSERTION

1
BOX REPLACEMENT IN-PROGRESS FLAG SET ?
N
RET
Y
2
BOX SET SENSOR ON ?
N
RET
Y
3
TURN OFF BOX LOCK SOL. (LOCK)
4
DISPLAY "REPLACE BOX"
5
RESET BOX REPLACEMENT IN-PROGRESS FLAG
6
RESET BOX REPLACEMENT END FLAG
7
SET WRAP REQUEST FLAG
1

1
8
CLEAR CARTRIDGE COUNTER
9
CLEAR COPIES PER SHEET COUNTER
RET

IMAGE FORMING APPARATUS

BACKGROUND OF THE INVENTION

The present invention relates to a copier, facsimile transceiver or similar image forming apparatus.

An image forming apparatus such as a copier usually uses an electrophotographic process or cursor process for forming a visible image on a recording medium which is implemented as a sheet. The visible image is formed by fine particles of toner stored in a developing device and sequentially consumed due to repetitive image formation. The problem with this type of image forming apparatus is, therefore, that a toner has to be supplied every time the amount of toner existing in the developing device becomes short. The supply of toner is the most troublesome operation regarding the maintenance of the apparatus.

While various kinds of toner supply methods have heretofore been proposed, typical of conventional methods are one which directly supplies a toner to a toner supply section included in a developing device, and one which supplies a toner from a toner cartridge which is removably mounted on the toner supply section. The cartridge scheme is disclosed in, for example, Japanese Patent Laid-Open Publication No. 188171/1988. This Laid-Open Publication teaches a procedure in which the operator loads the toner supply section of a developing device with, among a plurality of toner cartridges, a cartridge having the largest size first. As the toner cartridge becomes empty due to the supply of toner, the operator inserts a new toner cartridge smaller than the largest toner cartridge into the latter. When the smaller toner cartridge is emptied, the operator inserts another new toner cartridge even smaller than the empty toner cartridge into the latter. This frees the operator from the need for removing a toner cartridge from the toner supply section of the developing device every time it becomes empty. However, since some toner still remains in the empty cartridge left in the toner supply section, it is likely that the insertion of a new cartridge into the empty cartridge generates a stream of air to scatter around the remaining toner to the outside through the opening of the empty cartridge. To eliminate this problem, the empty cartridge may be automatically transported from the toner supply section to a cartridge collecting section remote from the toner supply section by a transporting device, as disclosed in Japanese Patent Application No. 286418/1990 by way of example. Such a system not only prevents the toner remaining in the empty cartridge from being scattered around but also promotes easy and efficient handling of cartridges. However, the prerequisite with this kind of approach is that the extra section for collecting empty cartridges be as small as possible since the space available in the apparatus is limited.

On the other hand, it is a common practice with the above-described type of image forming apparatus to remove a toner remaining on a photoconductive element and collect it in a waste or used toner bottle which is mounted on the apparatus. The toner bottle has to be discarded when filled with the waste toner and before it becomes full. Further, the photoconductive element itself has to be replaced from time to time since it deteriorates due to aging and has the surface thereof scratched or otherwise damaged due to repetitive image formation. In this manner, the maintenance of an image forming apparatus includes various operations which are troublesome to perform.

To facilitate the maintenance of an image forming apparatus, i.e., supplying a toner, discarding a waste toner and replacing a photoconductive element, the photoconductive element and the waste toner bottle and toner supply section arranged around the element may be constructed into a unit which is bodily replaceable, as also proposed in the past. Although this approach makes it needless to, for example, replace a toner cartridge every time the cartridge becomes empty, it forces even a developing roller, charger, cleaning blade and other components which are still usable to be discarded when the cartridge becomes empty. That is, such a unit scheme is not practicable without wasting many parts which are still usable. While easy maintenance is one of extremely important factors from the product standpoint, discarding usable parts is not desirable when it comes to the effective use of limited resources.

SUMMARY OF THE INVENTION

It is, therefore, an object of the present invention to provide an image forming apparatus which promotes not only easy and efficient maintenance but also effective use of component parts thereof.

It is another object of the present inventin to provide an mage forming apparatus whose section for collecting empty toner cartridges is desirably small.

An image forming apparatus of the present invention comprises a body, an image carrier, a developing device for developing a latent image electrostatically formed on the image carrier by a developer, a cleaning device for collecting the developer remaining on the image carrier after image transfer, a waste developer storing section for storing the developer collected by the cleaning device, a developer container for storing a fresh supplementary toner, a loading section to be loaded with the developer container, a developer supply section to be supplied with the supplementary developer from the developer container, a first transporting mechanism for transporting the developer container from the loading section to the develoer supply section, a collecting section for collecting the empty developer container which has supplied the developer to the developer supply section, and a second transporting mechanism for transporting the empty developer container from the developer supply section to the collecting section. At least one of the collecting section and waste developer storing section is removably mounted on the body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
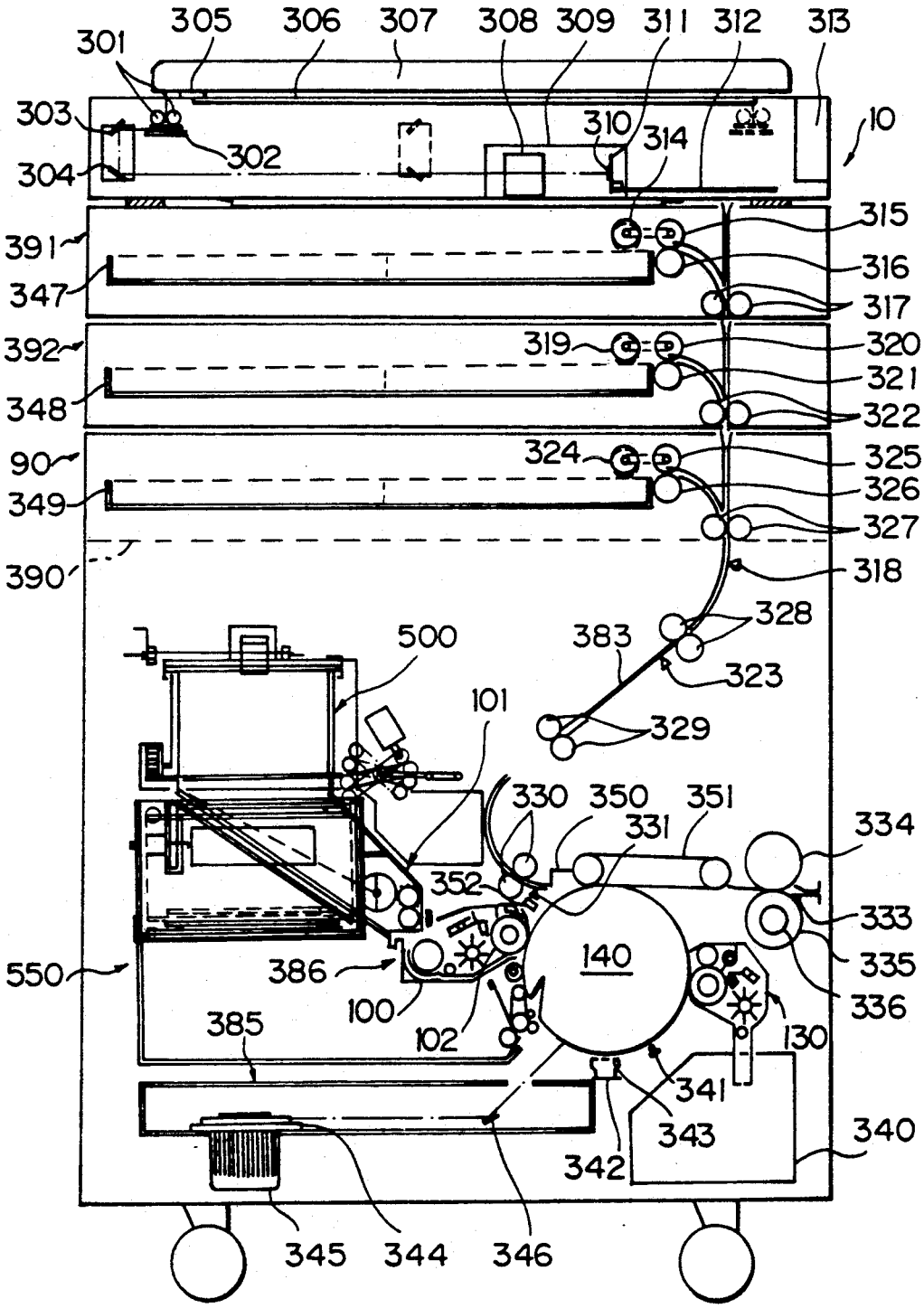
FIG. 1 is a front view of a digital copier embodying the present invention.

Referring to FIG. 1 of the drawings, an image forming apparatus embodying the present invention is shown which is implemented as a digital copier. As shown, the copier is generally made up of a reading device or scanner 10 for reading a document, and a copying device or printer 90 for effecting a process for reproducing a document read by the scanner 10 on a paper sheet.

Figures 2, 2A, 2B:
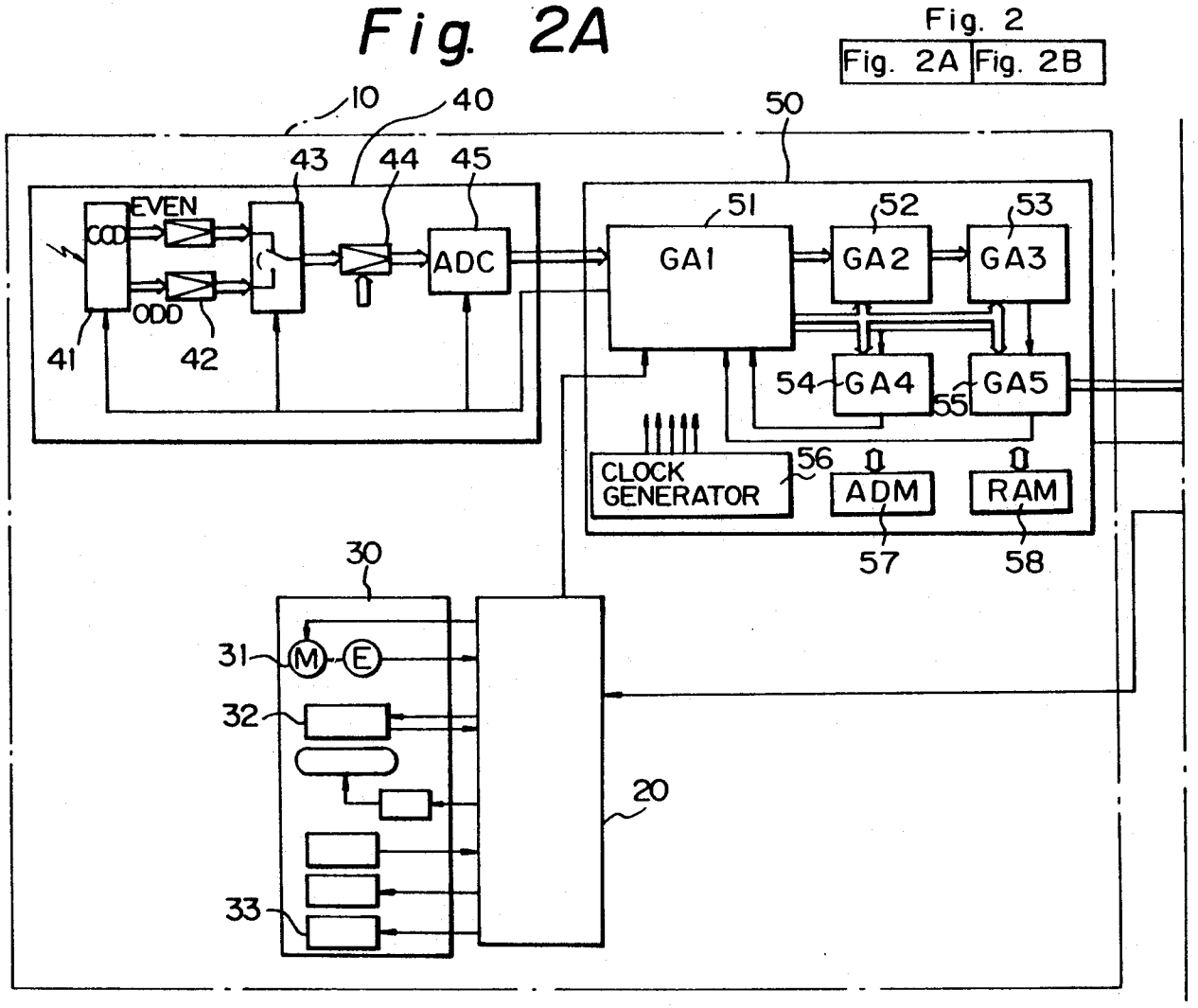
FIG. 2 is a block diagram schematically showing an electrical arrangement incorporated in the embodiment.
Figure 2B:
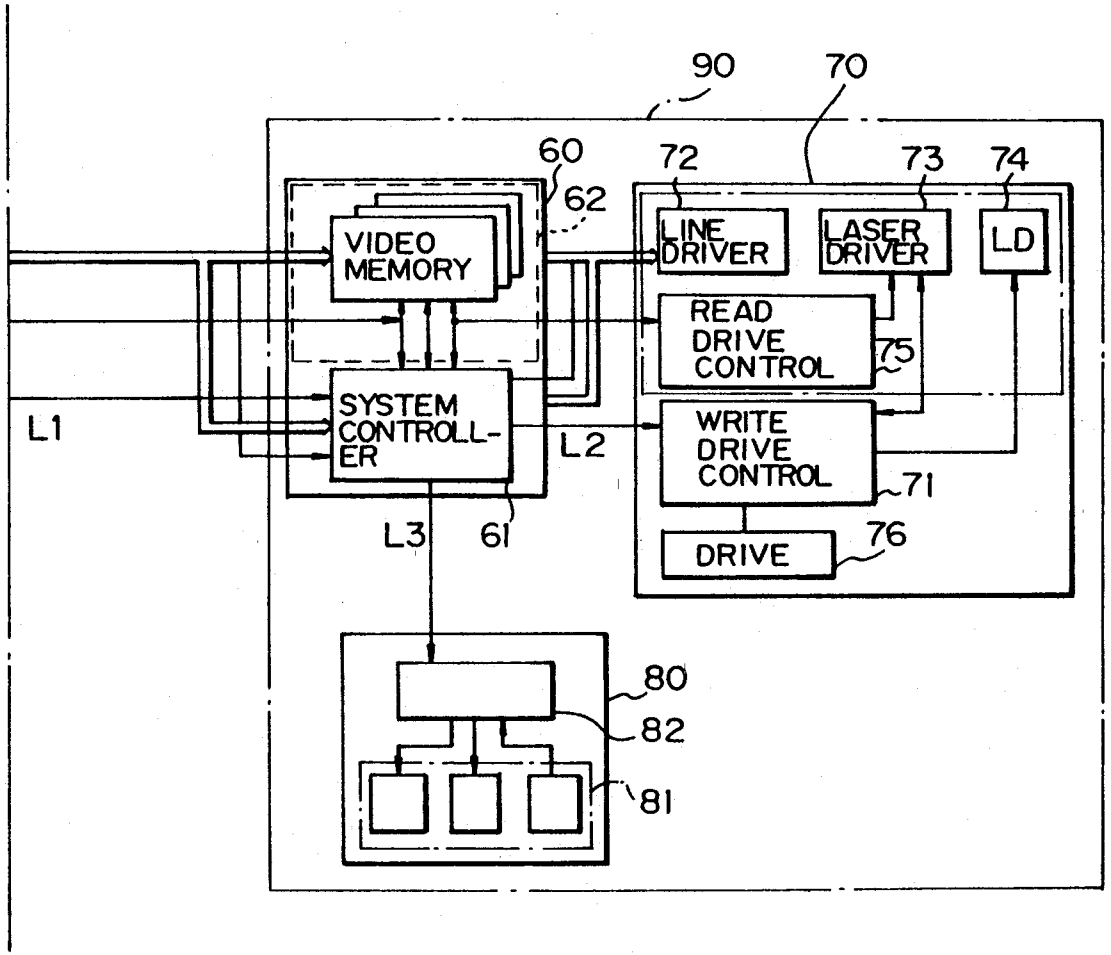

As shown in FIG. 2, the reading device 10 accommodates in the housing thereof a read control circuit 20, a read driver device 30, an image read circuit 40, and an image process circuit 50. On the other hand, the printer 90 has in the housing thereof a storage 60 for storing document data, a print circuit 70, a system controller 61, and an operation board 80 having keys which are accessible for entering various commands. The storage 60 is constituted by a video memory 62 and the system controller 61. The read control circuit 20, a write drive control circuit 71 included in the print circuit 70, and the operation board 80 are connected to the system controller 61 by signal lines L1, L2 and L3, respectively, and can interchange data with one another.

On receiving signals from the system controller 61 over the line L1, the read control circuit 20 performs various operations, e.g., controls the rotation speed of a scanner motor 31, controls a fluorescent lamp 32, commands the lamp 32 to turn on, controls a filter solenoid 33 which senses the size of a document, and controls a fan for cooling a scanner power source. The image read circuit 40 includes amplifiers 42, a switching element 43, a variable amplifier 44, and an analog-to-digital converter (ADC) 45. Two CCD arrays 41 convert a reflection or light image from a document to 400 dots per inch (dpi) analog signals. The amplifiers 42 amplify the resulting outputs of the CCD arrays 41 while dividing them it into an odd group and an even group, since the period of time per pixel is extremely short. The switching element 43 combines ODD and EVEN signals from the amplifier 42 to produce a composite analog signal. The variable amplifier 44 amplifies the analog signal from the switching element 43 by amplification command data AGC which corrects fluctuations in the illumination of the fluorescent lamp 32. The ADC 45 converts the analog signal from the variable amplifier 44 to a digital signal. The image process circuit 50 has five gate arrays 51–55, a clock generator 56, a ROM 57, and a RAM 58 for processing the image signal fed thereto from the image read circuit 40. The gate array 51 senses the quantity of light, controls timings, controls commands, edits and outputs data, and generates a CCD drive clock. The gate array 52 changes magnification in the main scanning direction. The gate array 53 executes halftone processing, binarization, and document size detection. The gate array 54 separates characters and halftone and performs white-on-black or similar blanking operations. The gate array 55 detects a marked area. The memory 62 is constituted by a memory board and a memory control board. The system controller 61 controls the entire system and generates a data read command and a data write command. The control over the entire system includes monitoring the ready state of the system, sensing the size and the remaining amount of paper sheets, commanding document reading and paper feed start, and controlling a scanner copy mode and a printer copy mode. In the event of commanding reading or writing of image data, the system controller 61 monitors the occupancy of the memory. The print circuit 70 has a line driver 72 which receives image data from the memory 62, a laser driver 73 for amplifying an image data signal from the line driver 72, a semiconductor laser or laser diode (LD) 74 driven by the laser driver 73, a read drive control circuit 75, a write drive control circuit 71, and a driving device 76. The operating device 80 has an operation panel 81 and an operation control circuit 82. A display for indicating various kinds of information and keys are arranged on the operation panel 81.

Referring again to FIG. 1, the reading device 10 has a glass platen 306 to be loaded with a document, a document scale 305 located at one edge of the glass platen 306, a cover plate 307 capable of covering the entire glass platen 306, a fluorescent lamp 301 disposed below the glass platen 306 for illuminating a document, a first to a third mirror 302, 303 and 304 for reflecting light from a document, a lens 308 enclosed by a cover 309 and to which the reflection from the mirror 304 is incident, an image read board 311 having two CCD arrays 310 thereon and provided with the ADC 45 therein, a board 312 provided with the image process circuit 50, and a fan 313 for cooling the interior of the copier.

After a document has been set on the glass platen 306, a copy start button provided on the operation panel 81 is pressed. The optics including the lamp 301 is moved below the glass platen 306 to scan the document. The resulting reflection from the document is incident to the CCD arrays 310 via the lens 308. The document image focused onto the CCD arrays 310 is outputted in the form of analog signals in synchronism with the clock fed from the image process circuit 50. The analog signals are amplified, combined, variably amplified, and then digitized by the ADC 45, as stated earlier. The digital signals from the ADC 45 are converted to digital image data by the signal processor 50 and then fed to the storage 60 of the copying device 90.

Figure 5:
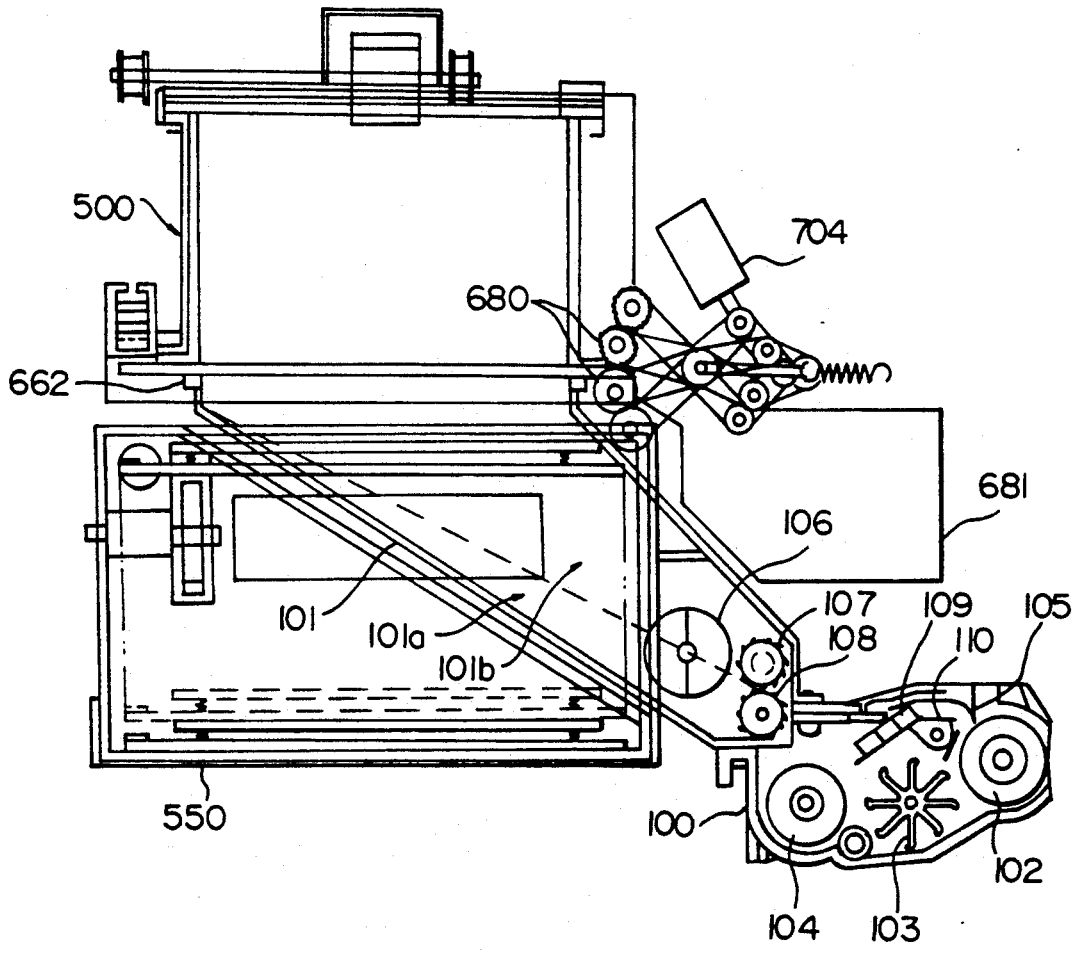
FIG. 5 is a front view showing a hopper opening and the neighborhood thereof included in a toner supply mechanism of the embodiment.
Figure 6:
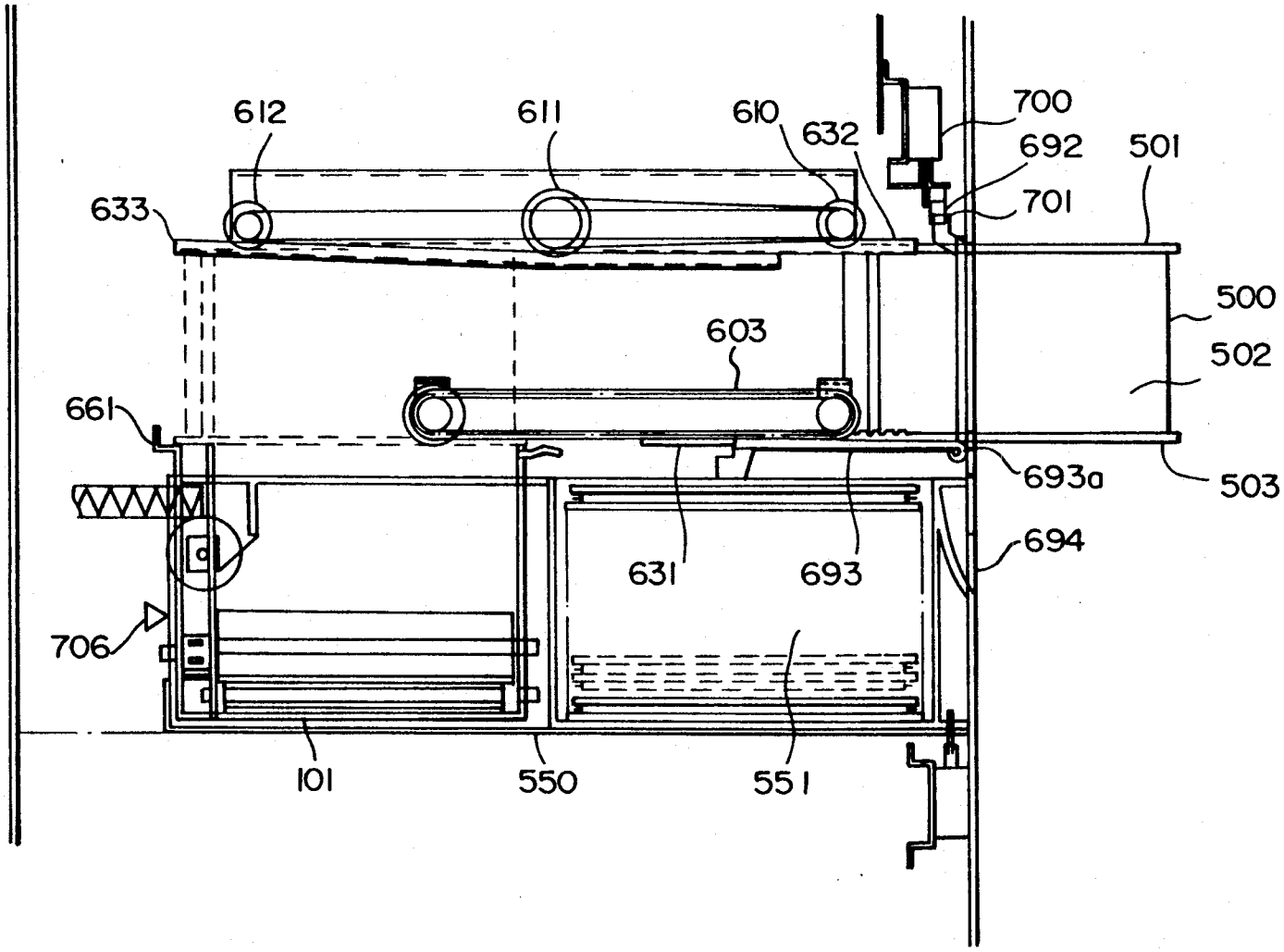
FIG. 6 is a side elevation as viewed from the left, showing the hopper opening and the neighborhood thereof.
Figure 7:
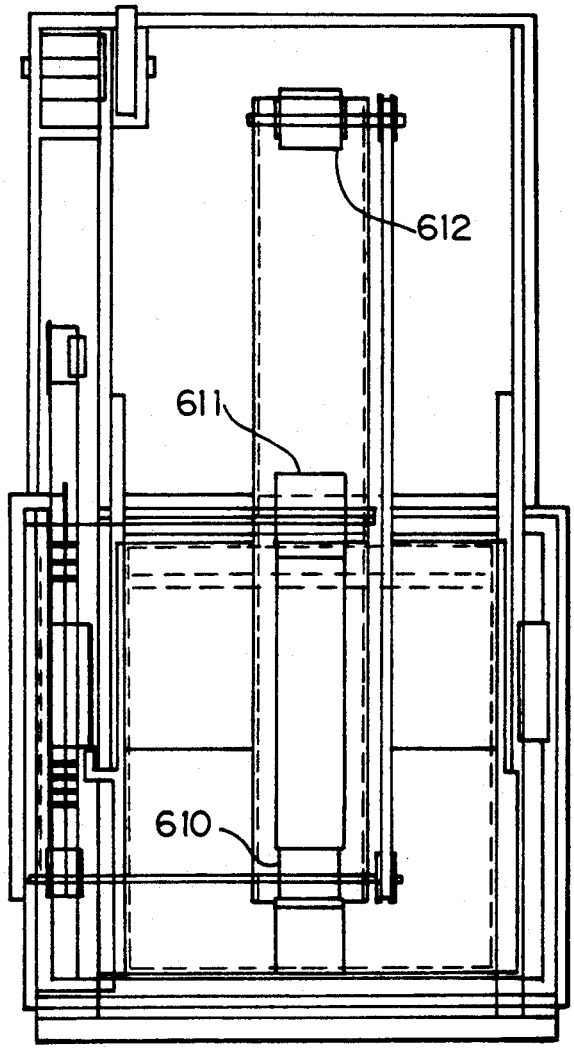
FIG. 7 shows the hopper opening and associated members, as viewed from the upper left.

The copying device 90 includes an image carrier implemented as a photoconductive drum 140 and rotatable clockwise. A transfer charger 350 is disposed above and faces the drum 140, defining an image transfer station. A horizontal paper tray 349 is disposed in an upper portion of the device 90. A paper transport path is defined between the image transfer station and the paper tray 349 by a guide 383, a first transit roller pair 327, and intermediate roller pairs 328 and 329. A pick-up roller 324, a feed roller 325 and a reverse roller 326 are associated with the paper tray 349 and constitute a paper feeding device 390. A register roller pair 330 is positioned on the transport path in close proximity to the image transfer station. A conductive separation and transport belt 351 and a fixing device are interposed between the image transfer station and a paper outlet. The fixing device is comprised of a press roller 334 and a heat roller 335 provided with a heater of 700 W or so thereinside and coated with Teflon. A cleaning device 130 is located at the right-hand side of the drum 140. A waste toner bottle 340 is disposed below the cleaning device 130 for collecting a toner having been removed from the surface of the drum 140. A discharge lamp 341 and a charger 342 having a grid 343 are located at an upper left position as seen from the waste toner bottle 340 side and faces the surface of the drum 140. The charger 342 is connected to a negative high voltage generating device so as to uniformly charge the surface of the drum 140 to −600 V. At an exposing station, the drum 140 is illuminated by a laser beam issuing from a writing optical unit 385 which extends horizontally in a lower portion of the copying device 90. The optical unit 385 has the semiconductor laser 74, FIG. 2, a cylindrical lens, not shown, a polygon mirror 344 driven by a polygon mirror motor 345 in a rotary motion, an f-theta lens, not shown, and a mirror 346. A developing device 386 is located above the optical unit 385 and constituted by a developing unit 100 having a magnet roller 102, and a toner hopper 101. The developing device 386 faces part of the surface of the drum 140 which moves upward. Specifically, as shown in FIG. 5, the developing unit 100 has, in addition to the magnet roller 102, a doctor blade 105 for regulating the thickness of a developer deposited on the magnet roller 102, a separator for guiding the developer being returned toward the bottom of the unit 100 by the doctor blade 105 and having a regulating plate 109, a transport member 103 for agitating the developer in a direction perpendicular to the axis of the magnet roller 102, and an agitator 104 for mixing a toner supplied from the toner hopper 101 with the developer. The toner hopper 101 is open toward the developing unit 100 at the bottom thereof, and a toner supply roller 108 is disposed in the open bottom. An agitator 106 is positioned in the toner hopper 101 for agitating a toner stored therein. The top of the toner hopper 101 is open (referred to as a hopper opening hereinafter) and forms a toner supply section where a cartridge 500 filled with a supplementary toner is removably mounted. A box 550 (see FIG. 6) is positioned in front of the toner hopper 101 on the viewer's side in the direction perpendicular to the sheet surface of FIG. 5. The box 550 includes a collecting section for accommodating empty cartridges 500 released their toner to the toner hopper 101, as will be described in detail later.

Optional paper feeding devices 391 and 392 are stacked on the top of the copying device 90 and have respectively paper trays 347 and 348, pick-up rollers 314 and 319, feed rollers 315 and 320, and reverse rollers 316 and 321. A second and a third transit roller pair 322 and 317 are associated with the paper feeding devices 392 and 391, respectively. The paper trays 349, 348 and 347 can be freely pulled out, and a set sensor and a size sensor, not shown, are associated with each of the trays. When any one of the trays 349, 348 and 347 is set, the associated set sensor senses it and drives an elevation motor, not shown, with the result that paper sheets stacked on the tray are elevated into contact with the associated pick-up roller 324, 314 or 319. A first and a second transition sensor 318 and 323 and a register sensor 331 are arranged to monitor the transport of paper sheets on the transport path.

Figure 3:
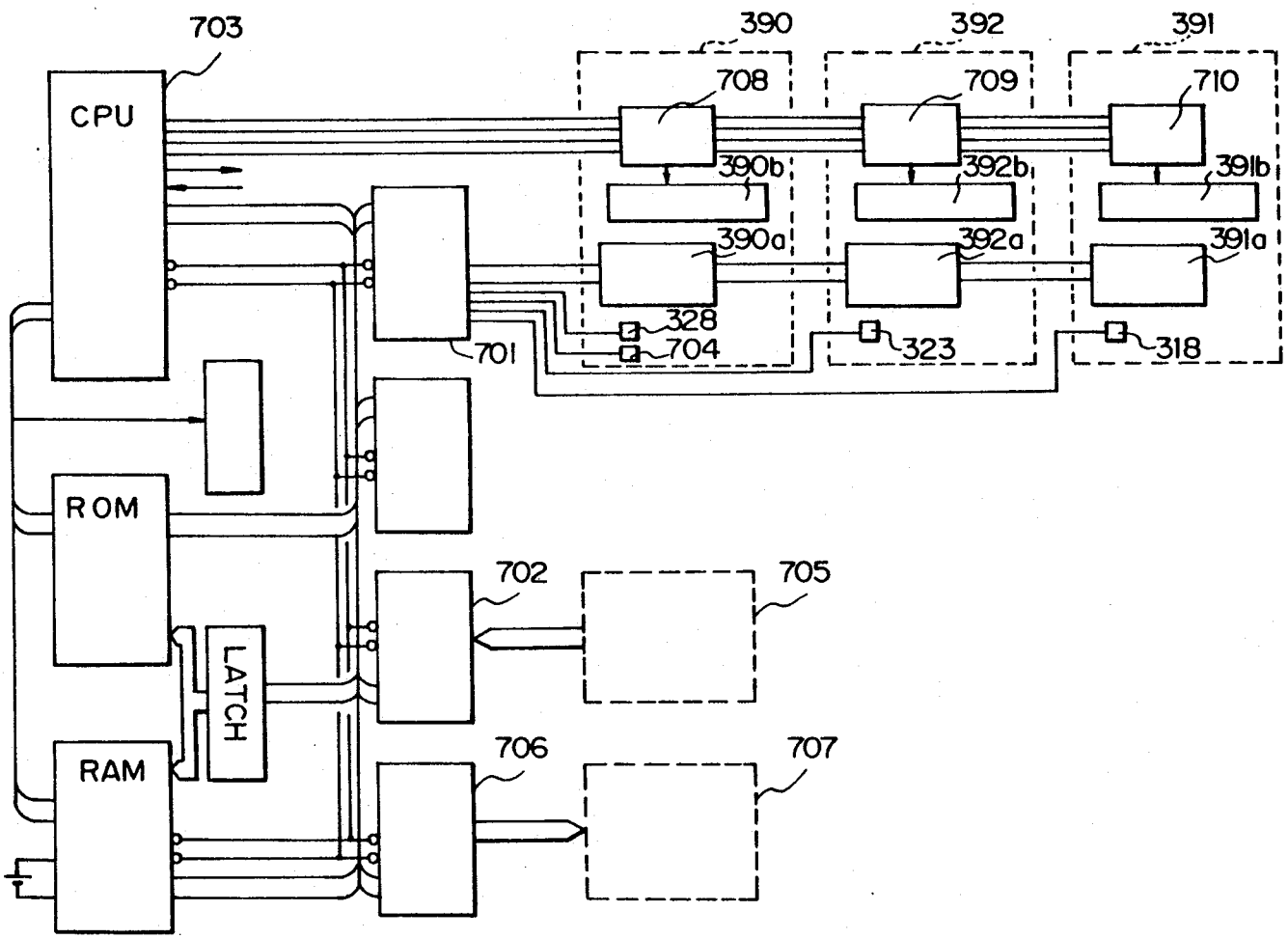
FIG. 3 is a block diagram schematically showing a specific construction of a write drive control circuit included in the arrangement of FIG. 2.

FIG. 3 shows a specific construction of the write drive control circuit 71 of FIG. 2. The outputs of the above-mentioned various sensors are applied to a CPU 703 via input gate arrays 701 and 702. Sensors 390*a*, 391*a* and 392*a* are associated with the paper feeding devices 390, 391 and 392, respectively, and include paper size sensors, paper end sensors, tray set sensors, and connection sensors. Also connected to the CPU 703 are the first and second transition sensors 318 and 323, and a door open sensor 704 associated with the paper feeding device 390. Sensors 705 are connected to the gate array 702 and include a toner sensor implemented by a photosensor 352, an insertion sensor associated with the box 550, FIG. 6, a drum sensor associated with the replacement of a photoconductive sheet, an electrometer, and a sheet leading edge sensor. Actuators 707 are connected to an output gate array 706 and include a transition clutch, an intermediate clutch, a register clutch, actuators associated with a cartridge, a main motor, a cleaning blade solenoid, a toner supply solenoid, the polygon motor 345, the fixing heater 336, a high-tension power source for charging, a high-tension power source for image transfer, the discharge lamp 341, and a toner sensor. The actuators associated with the paper feeding devices 390, 391 and 392, i.e., back-up solenoids, feed clutches, tray lock solenoids and elevation motors are connected to the output ports of the CPU 703 via serial/parallel receivers 708–710.

In operation, the semiconductor laser 74 included in the optical unit 285 is driven by digital image data generated by the laser driver 73 in the form of a bilevel signal having one bit (record/non-record) per pixel. The resulting laser beam is reflected by the polygon mirror 344 and then focused by the f-theta lens, not shown, onto the drum 140 via the mirror 346. Rotated by the polygon motor 345 at a constant speed, the polygon mirror 344 steers the laser beam horizontally, i.e., in a direction perpendicular to the moving direction of the drum 140.

The charger 342 uniformly charges the surface of the drum 140 to −600 V. As the laser beam is incident to the charged surface of the drum 140, the charge on the drum 140 flows to ground via the conductive layer of the drum 140 due to photoconduction. The laser 74 is turned on in portions where the document density is high (bilevel signal being in the record level) and turned off in portions where the document density is low (bilevel signal being non-record level). As a result, potentials of substantially −600 V and −100 V are respectively deposited in the portions of the drum 140 corresponding to the light portions of the document and the portions corresponding to the dark portions of the document. That is, a latent image matching the density distribution of the document is electrostatically formed on the drum 140. The developing device 386 develops the latent image to produce a corresponding toner image on the drum 140. The toner in the developing unit 100 is negatively charged by agitation while the magnet roller 102 of the unit 100 is biased to about −450 V by a bias generator. Consequently, the toner is deposited on the drum 140 except for the portions where the surface potential is lower than the bias voltage, thereby forming a toner image corresponding to the document image.

A paper sheet is fed from one of the three paper trays 349, 348 and 347 and then driven toward the image transfer station at a predetermined timing by the register roller 330. The transfer charger 350 transfers the toner image from the drum 140 to the paper sheet. The paper sheet carrying the toner image thereon is separated from the drum 140 by the transport belt 351 and then driven toward the heat roller 335 and press roller 334. After the toner image has been fixed on the paper sheet by the rollers 335 and 334, the paper sheet is separated by the separator or pawl 333 and then driven out to a copy tray, not shown. After the image transfer, the cleaning device 130 removes the toner remaining on the drum 140 after the image transfer, thereby preparing the drum 140 for another charging.

A mechanism for supplying a toner and an agent will be described with reference to FIGS. 4 and 5. As shown in FIG. 5, the developing unit 100 supplies a toner to the drum 140 by the magnet roller 102 and an agent so as to develop the latent image formed on the drum 140. The toner supply roller 108 supplies a supplementary amount of toner from the toner hopper **101*a* to the developing unit 100. The agent has to be replaced since it deteriorates as the copying operation is repeated. The illustrative embodiment replaces the agent automatically. A fresh agent for replacing the deteriorated agent is stored in an agent hopper 101*b* and supplied to the developing unit 100 by an agent supply roller 107**.

Figure 4:
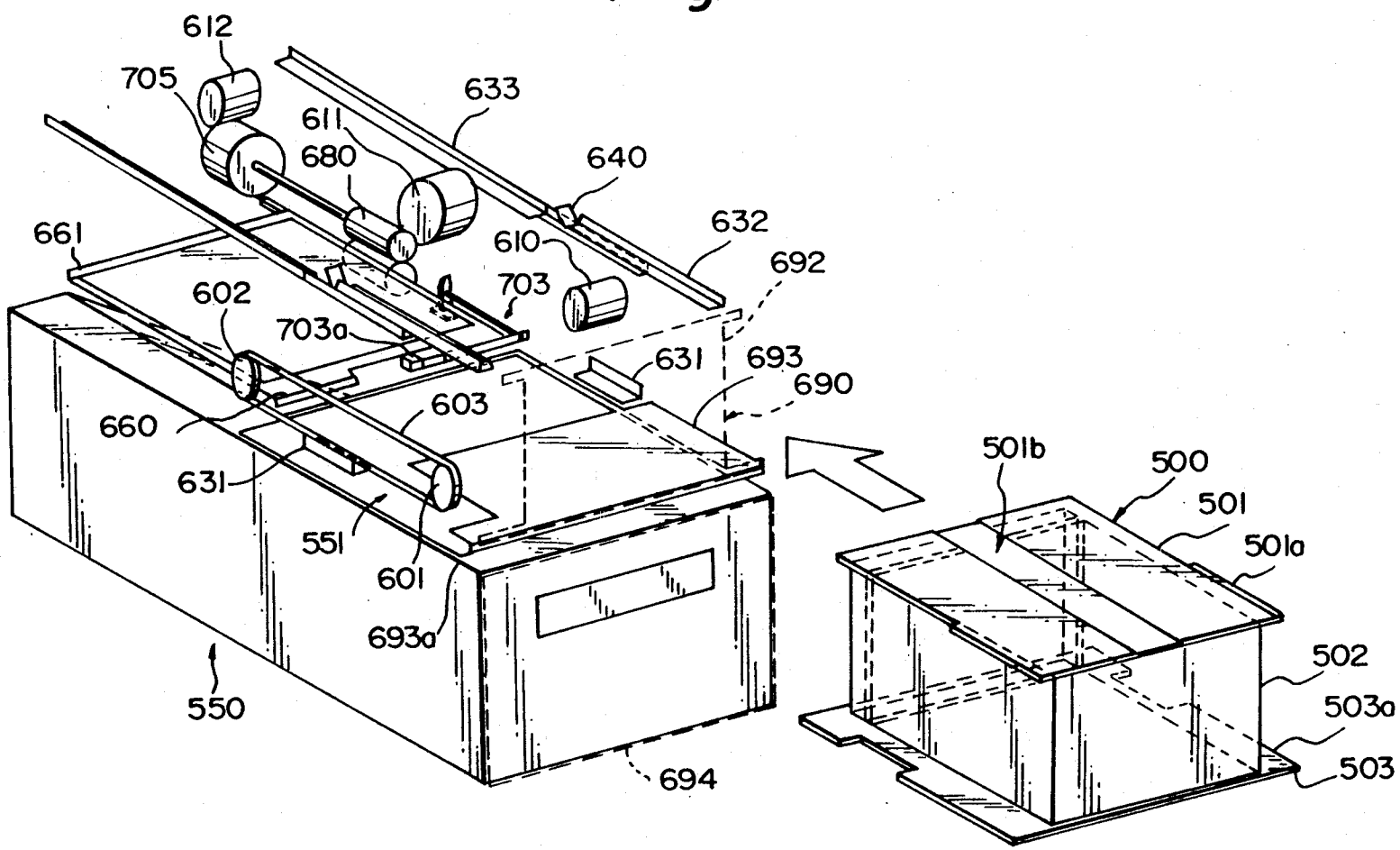
FIG. 4 is a perspective view of a toner supply mechanism of the embodiment.

As shown in FIG. 4, in the supply mechanism, a cartridge 500 is inserted into a loading section 690 provided on the front of the apparatus by the user. Then, a lower transport belt 603 and a first to a third transport roller 610–612 are driven to convey the cartridge 500 to a toner and agent supply section situated above the hopper 101. At the supply position, a seal 504 hermetically sealing the cartridge 500 is peeled off to let the toner and agent drop into the hopper 101. Before another cartridge is inserted due to the consumption of the toner, the empty cartridge is transported from the supply section to a cartridge collecting section 551 (see FIG. 6) provided in the box 550. The automatic replacement of the agent and the operation to be performed when the cartridge collecting section 551 is filled with empty cartridges 500 will be described later.

Figure 60:
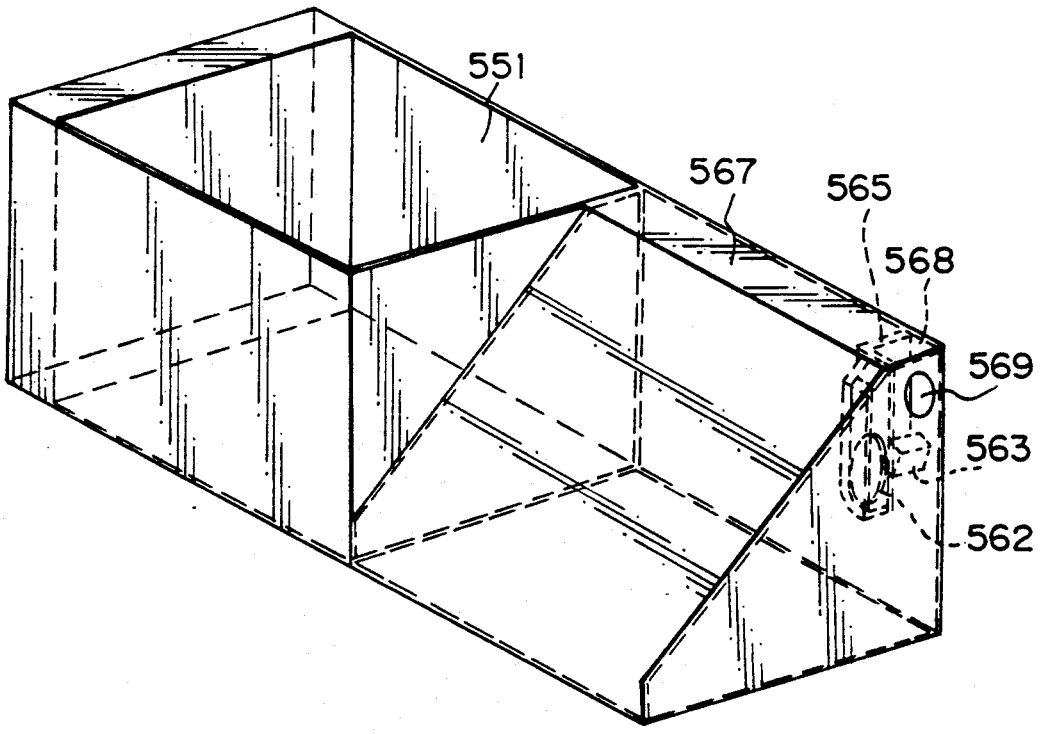
FIG. 60 is a perspective view of the box shown in FIGS. 59A–59C.
Figure 61:
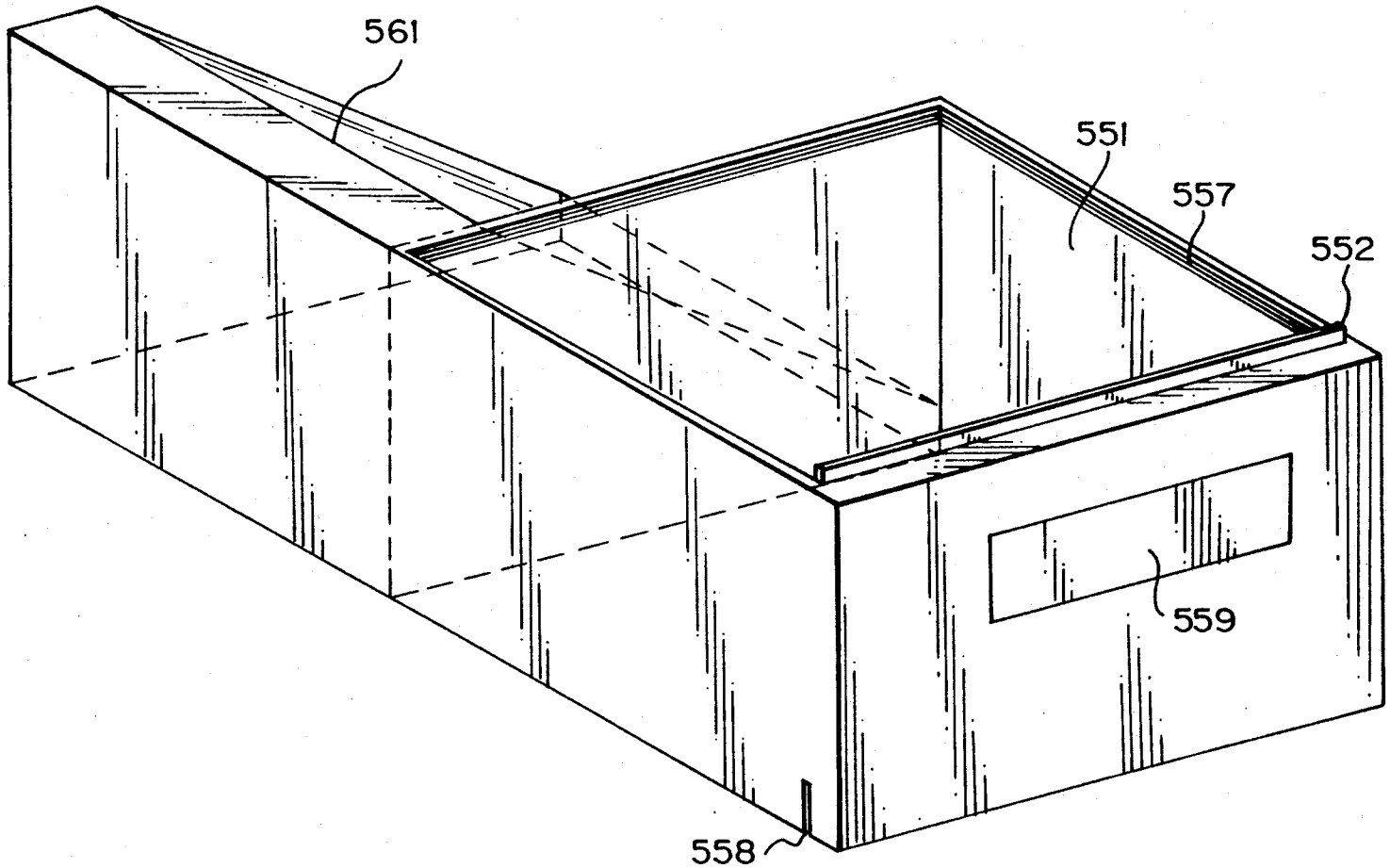
FIG. 61 is a perspective view of the box shown in FIGS. 59A–59C, as viewed from a different direction.
Figure 67:
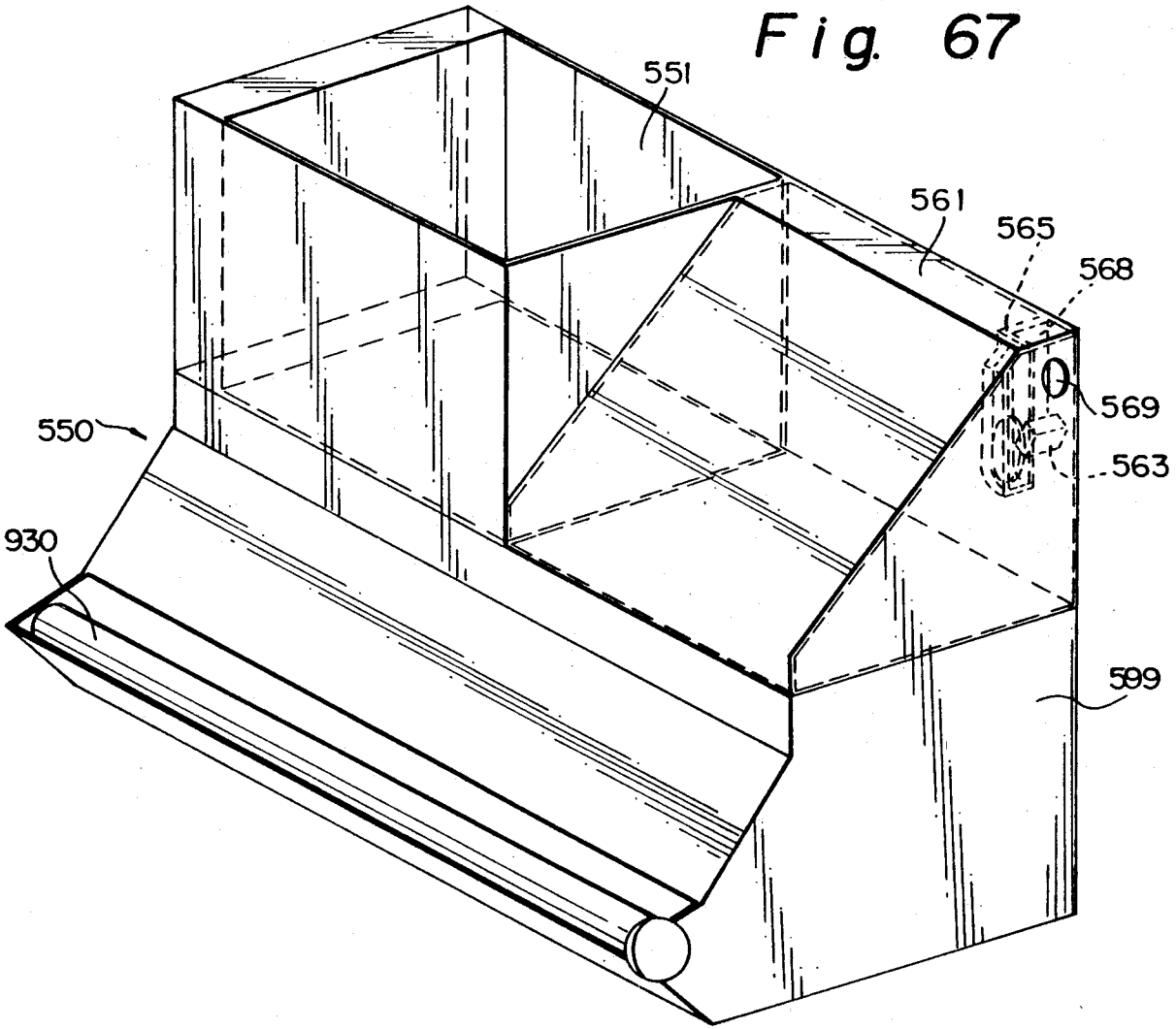
FIG. 67 is a perspective view of a box applicable to the copier of FIG. 1.

As shown in FIGS. 1 and 67, the box 550 is made up of the cartridge collecting section 551, a waste or used toner collecting section 561, and a photoconductive sheet storing or collecting section 599. However, regarding the toner and agent supply mechanism of the apparatus body and the cartridge 500, only the cartridge collecting section 551 and waste toner collecting section 561 are constructed integrally with each other, as shown in FIG. 60. For this reason, the description will proceed with drawings showing the configuration of the box 550 of FIG. 60 (FIGS. 4, 5, 8 and 23–29).

Figure 9:
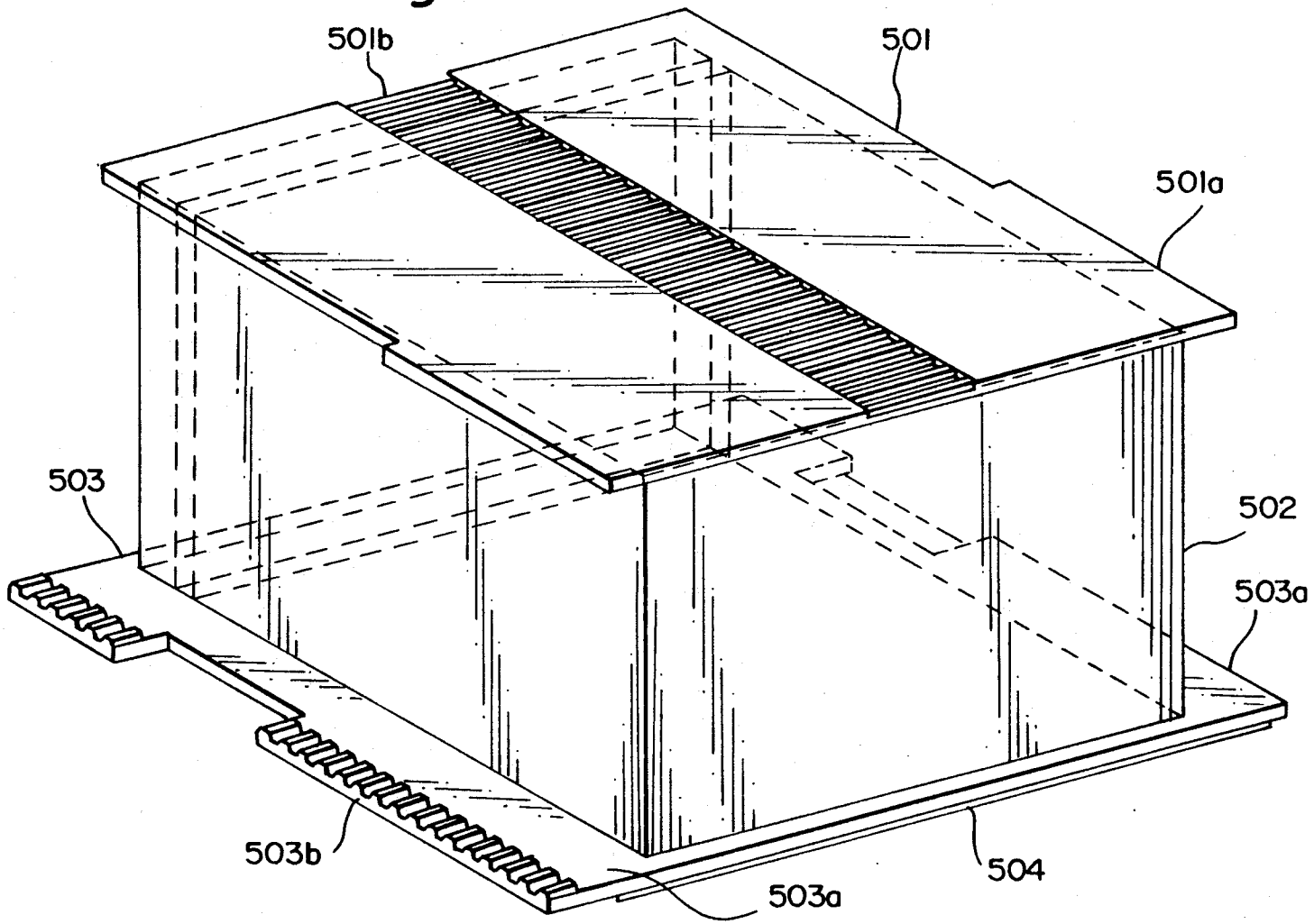
FIG. 9 is a perspective view of a cartridge applicable to the embodiment.
Figure 10A:
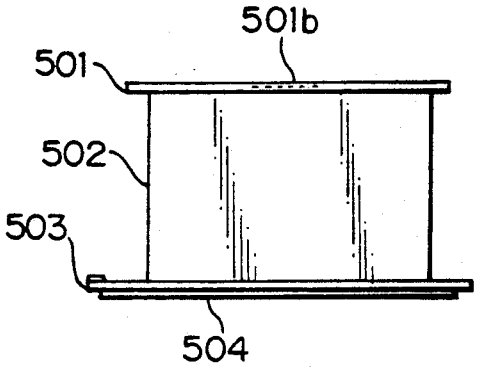
FIGS. 10A, 10B and 10C show the cartridge in a front view, side elevation as viewed from the left, and plan view, respectively.
Figure 10B:
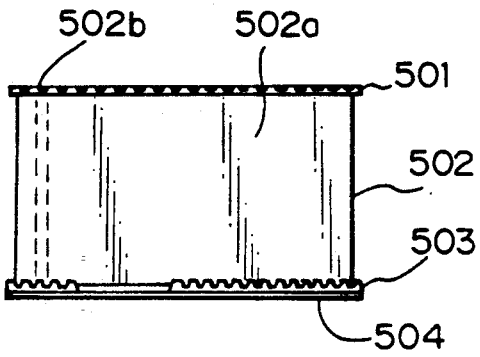
Figure 10C:
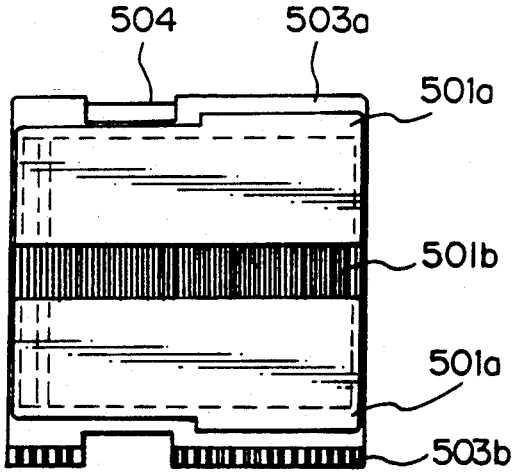

As shown in FIGS. 9, 10A–10C, 11 and 12, the cartridge 500 has a flat top plate 501 and a flat bottom plate 503 which are connected to each other by a cartridge film 502. The interior of the cartridge 500 is partitioned by a double film made of the same material as the cartridge film 502 so as to form compartments **502*a* and 502*b* for storing respectively a toner and an agent, as shown in FIG. 10B. Flange portions extend out from the right and left of the top plate 501. These flange portions each has a flap 501*a* extending further outward and from the front end to midway between the front and rear ends. A timing groove 501*b* is formed in the upper surface of the top plate 501 and at substantially the center with respect to the right-and-left direction. The timing groove 501*b* extends from the front end to the rear end of the top plate 501. The cartridge film 502 is implemented by a soft member, e.g., a film-like member made of polyester or an elastic member made of polyurethane rubber, so that the cartridge 500 may be accommodated in the cartridge collecting section 551, FIG. 6, in a collapsed position. Flange portions extend out from the right and left ends of the bottom plate 503. These flanges each has a pair of spaced flaps 503*a* extending further outward and aligned with the flaps 503*a* of the other flap 503*a*. A timing groove 503*b* is formed in the upper surfaces of the flaps 503*a* which extend from the left flange of the bottom plate 503. The distance between the outer edges of the left flaps 503*a* and the left end of the cartridge film 502 is greater than the distance between the outer edges of the right flaps 503*a* and the right end of the cartridge film 502. The portion of the bottom plate 503 surrounded by the lower edge of the cartridge film 502 is open to allow the toner and agent to flow out of the cartridge 500. When the toner and agent are stored in the compartments 502*a* and 502*b*, respectively, the opening of the bottom plate 503 is closed by the seal 504. When the cartridge 500 is positioned above the hopper opening 124, an unsealing device which will be described adjoins the right flanges of the cartridge 500. Hence, after adhesive has been applied to the front, rear, right and left flanges of the bottom plate 503, the seal 504 is adhered to, for example, the right flange, then sequentially adhered to all the other flanges, then folded back, then extended to the outer edge of the right flange, and then adhered to the right flange at the free edge thereof. In the illustrative embodiment, the top plate 501 and bottom plate 502 are 3 mm thick each while the entire cartridge 500 is 86 mm high. Preferably, the sides and top of the cartridge 500 is configured such that the upper portion of the cartridge 500 can be projected onto the bottom plate 503 (see FIG. 10C). This is to prevent, when the cartridge 500 is to be dropped into the cartridge collecting section 551, the portions of the cartridge 500 other than the bottom plate 503 contact members having guided the bottom plate 503**.

The toner and the agent stored in the cartridge 500 should preferably be in a ratio of 1:1 to 3:1 in weight. Specifically, in the illustrative embodiment, the agent is automatically replaced every time a new cartridge 500 is loaded due to the consumption of toner. Hence, all the toner stored in the cartridge 500 has to be consumed before the life of the developer ends. In the embodiment, 150 grams of agent is stored in the cartridge 500, and the life of the agent ends when about 10,000 copies are produced. Regarding the toner, therefore, an amount which will be consumed by 8,000 copies is assumed taking account of some margin. The amount of toner consumption depends on the area of black portions of a document, i.e., it is 150 grams when the mean of the area of black portions is 3% or 450 grams when the mean is 9%. Consequently, the weight ratio of the toner to the agent to be consumed is 1:1 when the above-mentioned mean is 3% or 3:1 when the mean is 9%. Since the area of black portions generally lies in the range of 3% to 9%, the preferable ratio of the toner to the agent is 1:1 to 3:1, as mentioned above. In the illustrative embodiment, the toner storing section and the agent storing section have volumes of 120 cc and 100 cc, respectively.

Figure 11:
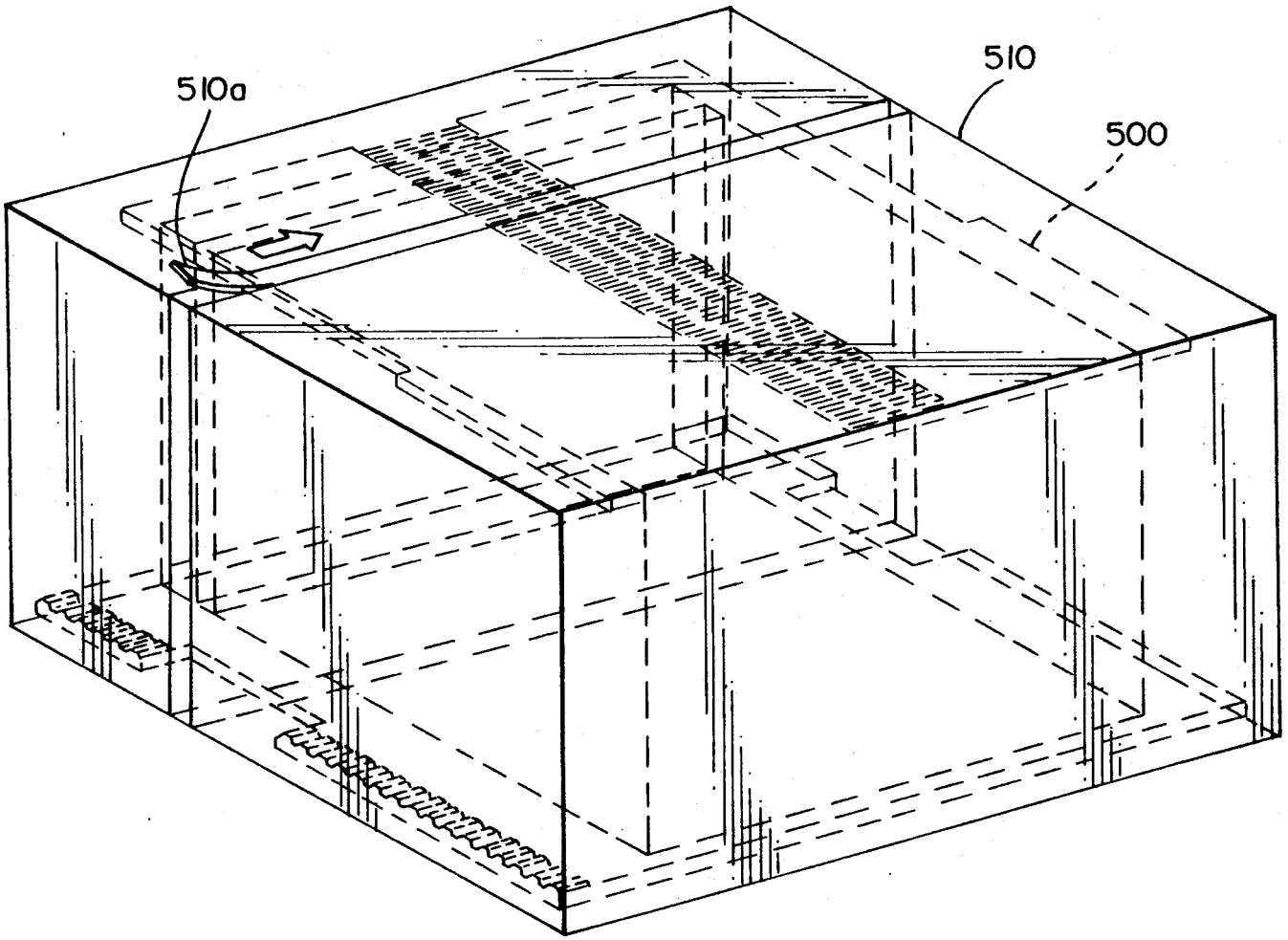
FIG. 11 is a perspective view showing the cartridge housed in a case.
Figure 12:
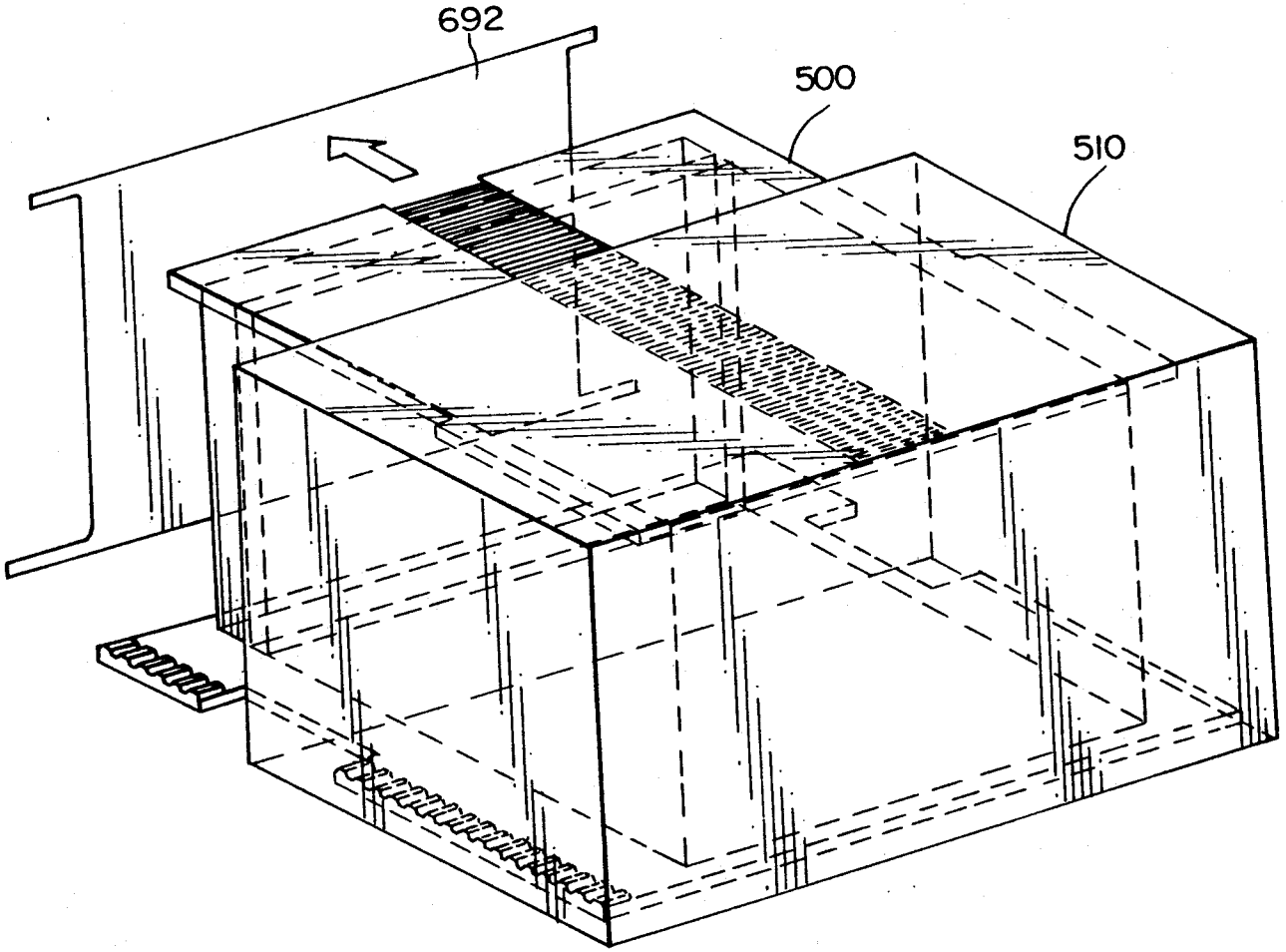
FIG. 12 is a perspective view showing how the cartridge is inserted into the apparatus.
Figure 13A:
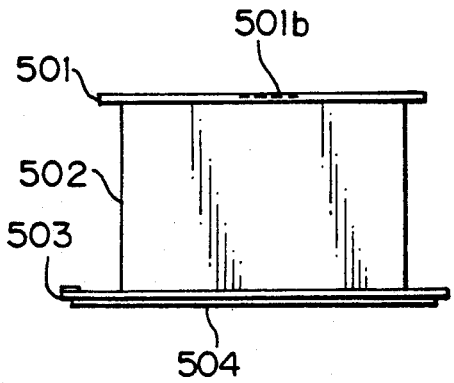
FIGS. 13A, 13B and 13C show a modified form of the cartridge in a front view, side elevation as viewed from the left, and a plan view, respectively.
Figure 13B:
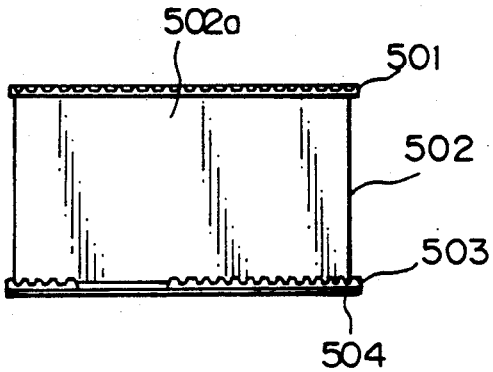
Figure 13C:
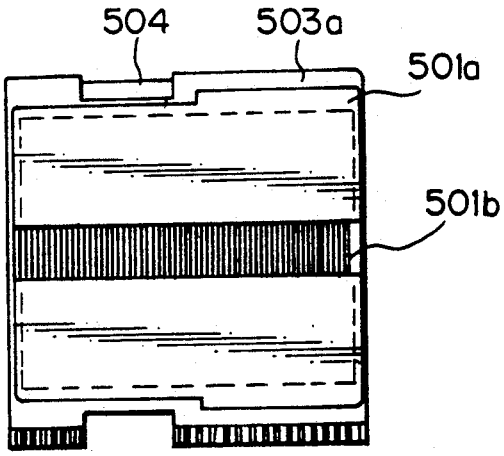

As shown in FIG. 11 specifically, it is preferable to store the cartridge 500 in a case 510 made of hard material, e.g., corrugated cardboard, so that the cartridge 500 having elastic or film-like sides may be handled with ease. To insert the cartridge 500 into the apparatus, one tears off a tab 510*a* of the case 510 to expose part of the cartridge 500 and then inserts the exposed part of the cartridge 500 into an opening 692 formed in the apparatus body by holding the case 510 (see FIG. 12). This insures easy and accurate insertion of the cartridge 500. Preferably, only the part of the case 510 that covers the end portion of the cartridge 500 to be inserted into the opening 692 first should be removable. When the cartridge 500 slips out of the case 510 by accident, one will insert the cartridge 500 into the apparatus body by holding the cartridge 500. In such a case, if the cartridge 500 is provided with a dimension in the intended direction of insertion greater than the right-and-left dimension of the opening 692, one is prevented from inserting it sidways. Further, the right and left flaps 503*a* of the cartridge bottom plate 503 have different dimensions. Hence, the cartridge 500 is prevented from being inserted tailfirst since the film 502 and bottom plate 503 will not match the opening 692. In addition, the cartridge 500 is prevented from being inserted upside down since the top plate 501 and the bottom plate 503 have different dimensions (in the embodiment, the top plate 501 has a width in the right-and-left direction which is greater than the width of the bottom plate 503 and the width of the portion of the opening 692 corresponding to the bottom plate 503). Hence, the cartridge 500 can be surely inserted into the apparatus body in the predetermined position. It is to be noted that the cartridge 500 itself is applicable to an apparatus of the type supplying the agent without using a cartridge. For such an application, the partition dividing the toner storing section 502*a* and the developer storing section 502*b* may be removed, as shown in FIGS. 13A–13C.

Figure 8:
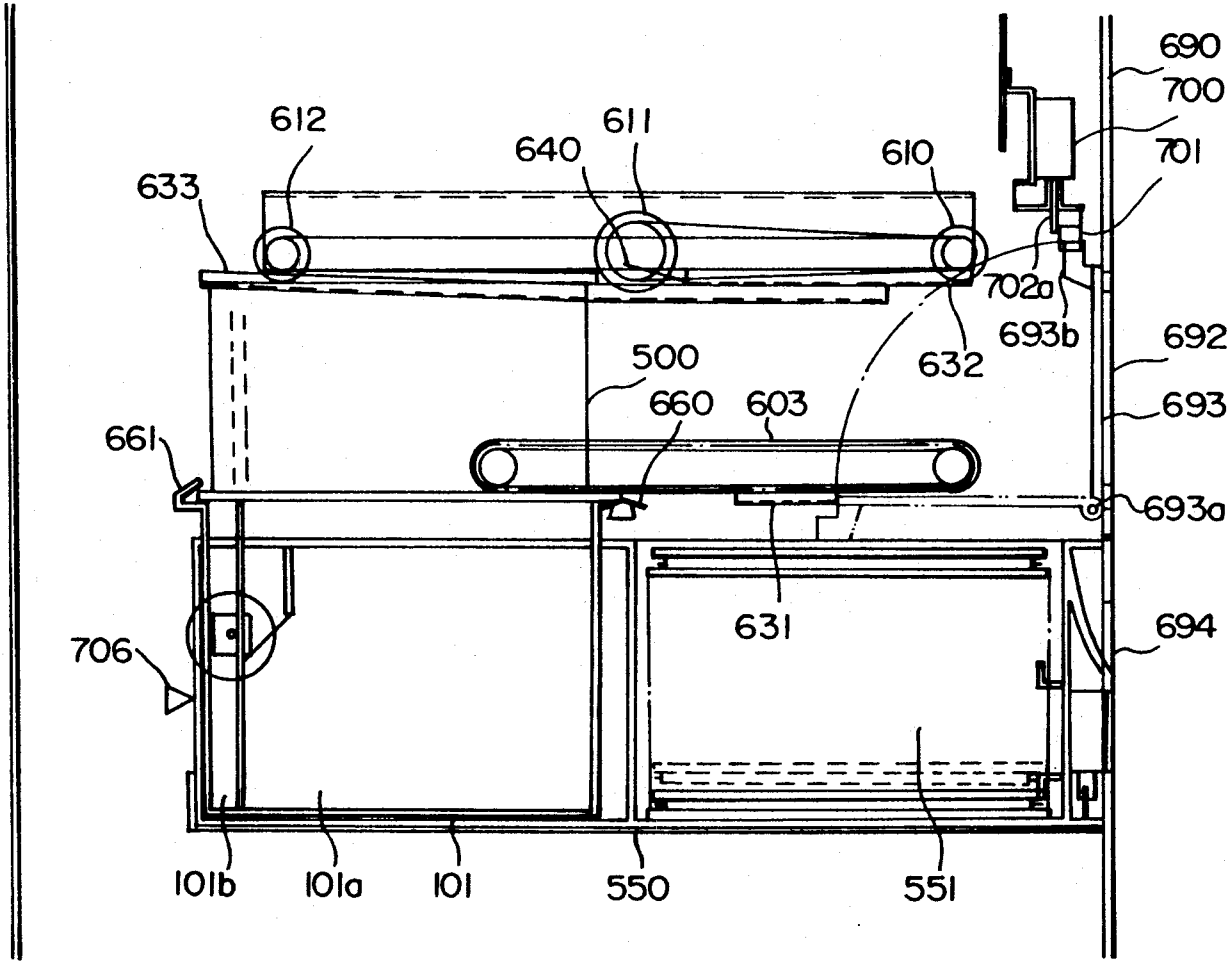
FIG. 8 is a side elevation as viewed from the left, showing a cartridge positioned above the hopper opening.

A mechanism incorporated in the apparatus body for supplying the toner and agent will be described with reference to FIGS. 4, 8 and 5. As shown, the apparatus body has a trimming 690 at the front end thereof. The opening 692 is formed through the trimming 690 to implement a cartridge inserting section. A toner and agent supplying section is provided on the rear of the apparatus body and implemented by the hopper 101. Unsealing means for unsealing the cartridge 500 is located at the right-hand side of the hopper opening and has an unseal roller 680. A seal collecting section, FIG. 5, has a box 681 and is located to face the unseal roller 680. A cartridge collecting section is interposed between the hopper 101 and the trimming 690 and constituted by the cartridge collecting box 550. Transporting means has the lower transport belt 603 and lower rails 631. Another opening 694 is formed through the trimming 690 to allow the box 550 assigned to empty cartridges to be moved into and out of the apparatus body. In FIGS. 4, 8 and 5, the box 550 has the configuration shown in FIG. 60 in place of the configuration shown in FIG. 67, so that the opening 694 has a configuration matching the section of the box 550 shown in FIG. 60. However, in the embodiment, the window 694 is configured in matching relation to the section of the box shown in FIG. 67. The opening 692 has dimensions greater than those of the cartridge 500 when the latter is viewed in a section perpendicular to the intended direction of insertion. Therefore, the portions where the flaps 501*a* and other portions of the cartridge 500 pass are provided with lengths matching the length of the latter. This is successful in preventing the cartridge 500 from being inserted in an incorrect position, e.g., sideways or tailfirst.

A shaft 693*a* extends at the inside of and parallel to the trimming 690. A door 693 is rotatably supported by the shaft 693*a* at the lower end thereof and covers the entire opening 692 when brought to a closed position. Biasing means, not shown, constantly biases the door 693 in the closing direction and usually holds it the closed position. When the door 693 is pushed into the apparatus body against the action of the biasing means, the door 693 can rotate about 90 degrees about the horizontal shaft 693*a*. Assuming that the door 693 is in the closed position, a plate 693*b* (see FIG. 8) extends out from the upper end of the inner surface of the door 693 that faces the inside of the apparatus. The plate 693*b* has a projection extending to the outside beyond the leading edge thereof. A locking mechanism is mounted on the inner surface of the trimming 690 above the opening 692 and has a door sensor 701, an unlock solenoid 700, and a lock plate 700*a* affixed to the plunger of the solenoid 700. The door sensor 701 has a light emitting element and a light-sensitive element and is positioned such that projection of the plate 693*b* intervenes between the light emitting element and the light-sensitive element when the door 693 is closed. The locking mechanism is located such that the lock plate 700*a* mates with the plate 693*b* from the opposite side to the trimming 690 when the plunger of the unlock solenoid 700 is pulled out while the door 693 is closed or does not mate with the plate 693*b* when the plunger is pulled in.

As shown in FIG. 5, a seal member 662 is adhered to the upper edge of the toner supply section surrounding the hopper opening, so that a clearance may not be formed between the upper edge and the underside of the flanges of the cartridge 500. As shown in FIG. 8, a hopper guide 660 is located closer to the trimming 690 than the hopper opening. An abutment in the form of a wall 661 is located closer to the rear end of the apparatus than the hopper opening and is inclined toward the opening 692 for positioning the cartridge 500 in a position above the hopper opening. The lower surface of the inclined abutment 661 and the upper edge of the hopper opening to which the seal member 662 is adhered to define a wedge-shaped clearance which is open toward the opening 692.

Figure 14:
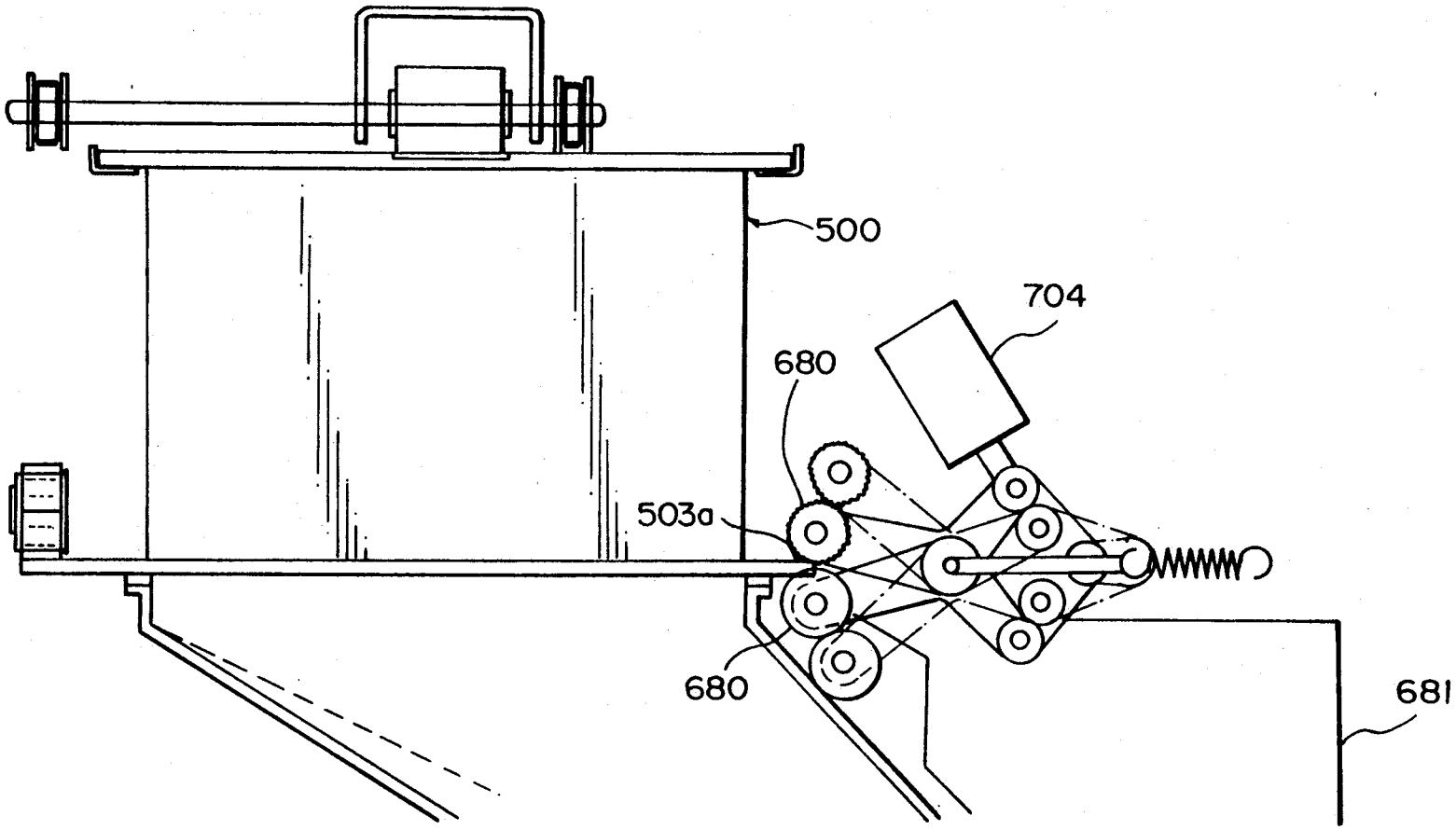
FIG. 14 is a front view showing an unseal roller included in the toner supply mechanism together with associated parts.
Figure 15:
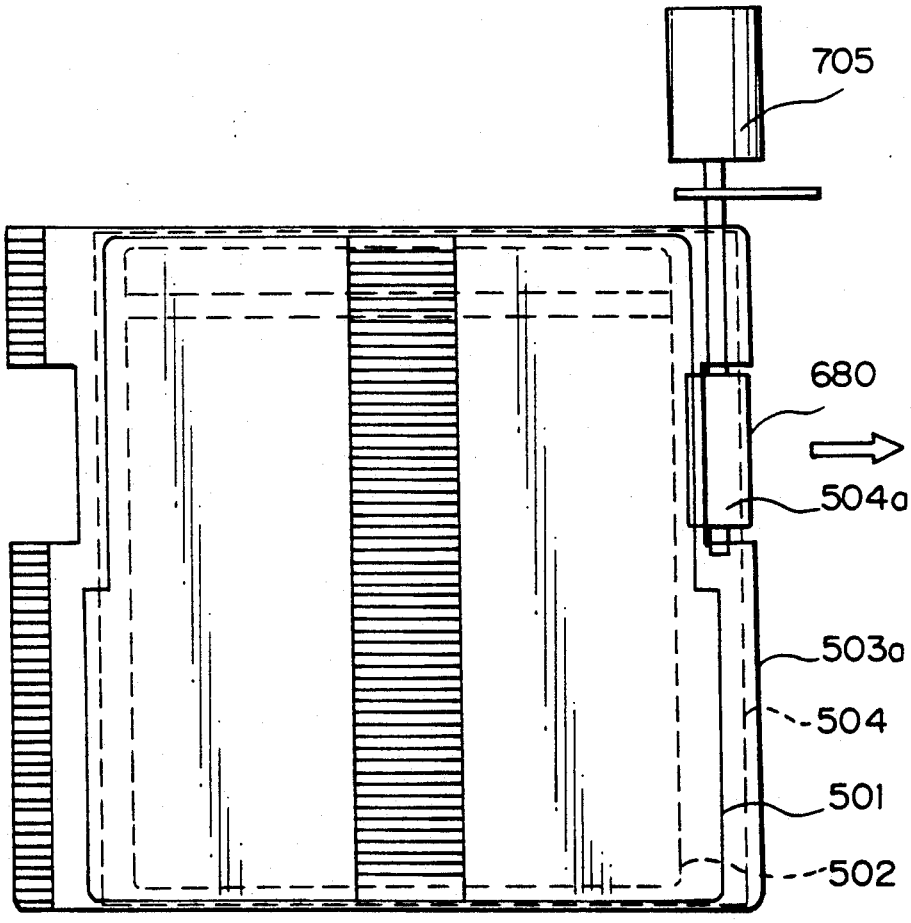
FIG. 15 is a plan view showing a positional relation between the unseal roller and the cartridge.
Figure 16:
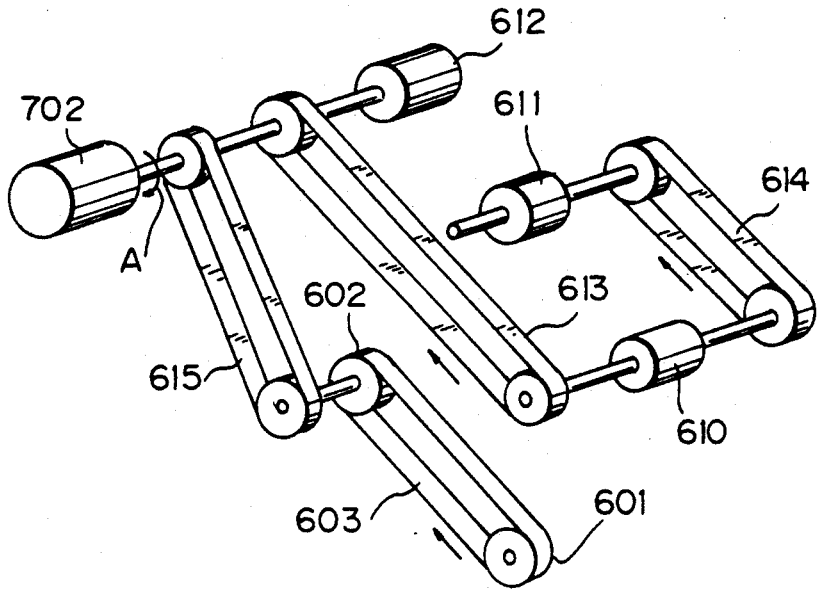
FIG. 16 is a perspective view showing an arrangement for driving a cartridge transport mechanism.

As shown in FIGS. 14 and 15, the unseal roller 680 of the unsealing means is constituted by an upper roller and a lower roller each having a predetermined length corresponding to the distance between the front and rear flaps 503*a* of the right flange of the cartridge 500. The lower and upper rollers 680 are respectively implemented as an elastic cylindrical roller and an undulated roller, so that they may surely pull the seal member 504 sealing the cartridge 500. The shafts on which the rollers 680 are mounted are rotatably supported by a link mechanism capable of changing the distance between the shafts. An unseal motor 705, not shown, drives the rollers 680. The link mechanism includes a spring for constantly spacing apart the two shafts from each other by at least a distance which allows the flaps 503*a* to pass through the gap between the rollers 680. A pinch solenoid 704 is connected to the link mechanism and capable of reducing the distance between the two shafts against the action of the spring to allow the rollers 680 to nip the seal member 504.

The seal collecting box 681 has an opening for receiving the seal member 504 which is removed from the cartridge 500. The cartridge collecting box 113 has an opening for receiving the cartridge 500 at the top thereof and is removable from the apparatus body. This box 113 will be described in detail later.

Figure 18:
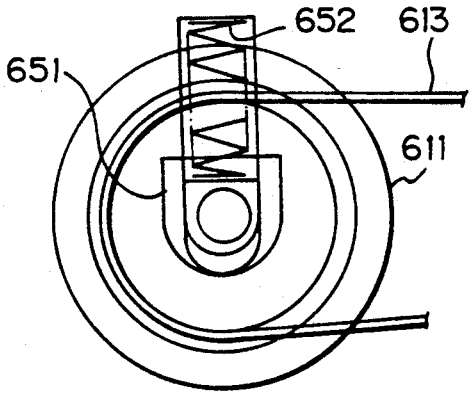
FIG. 18 is a side elevation as viewed from the left, showing a mechanism for supporting a second transport roller included in the cartridge transport mechanism.

As shown in FIGS. 4, 8 and 14, the transporting means has a reversible transport motor 702 (see FIG. 4) for driving the previously mentioned transport rollers 610–612 and lower transport belt 603. A first upper rail pair 632 and a lower rail pair 633 support the top plate 501 of the cartridge 500 in contact with the underside of the flaps 501*a*. Lower support rails 631 support the bottom plate 503 of the cartridge 500 in contact with the underside of the flaps 503*a*. Also provided in the transporting means are the hopper guide 660 and opening 693. As shown in FIG. 14, the transport roller 612 is mounted on the output shaft of the motor 702. The transport roller 610 is driven by the motor 702 via a belt 613. The transport roller 611 is driven by the shaft of the transport roller 610 via a belt 614. The lower transport belt 603 is driven by the motor 702 via a belt 612. The transport rollers 610–612 are so located as to be capable of facing the timing groove 501*a*, FIGS. 4 and 9, provided on the upper surface of the top plate 501 of the cartridge 500, i.e., they play the role of timing pulleys capable of meshing with the timing groove 501*a*. As shown in FIG. 18, the transport roller 611 is supported by bearings 651 which are mounted on the side panels of the apparatus body and movable up and down. A spring 652 constantly biases the bearings 654 downward. The lower transport belt 603 is passed over belt wheels 601 and 602 and implemented as a timing belt having teeth on both surfaces thereof. The teeth provided on the underside of the belt 603 are capable of meshing with the timing groove 503*b* of the flaps 503*a* of the bottom plate 503. As shown in FIG. 14, when the output shaft of the motor 702 is rotated in a direction indicated by an arrow A, it drives the rollers 610–612 and belt 603 in a direction for transporting the cartridge 500 toward the rear end of the apparatus. When the output shaft of the motor 702 is reversed, the rollers 610–612 and belt 603 move the cartridge toward the front end of the apparatus. Preferably, the transport roller 610 and belt wheel 601 closest to the front end of the apparatus should be positioned such that the leading end of the cartridge 500 reach them while the leading end of the cartridge 500 is still located outside the cartridge 500. Then, the operator does not have to force the whole cartridge 500 into the apparatus by inserting the hand deep into the apparatus.

Figure 19:
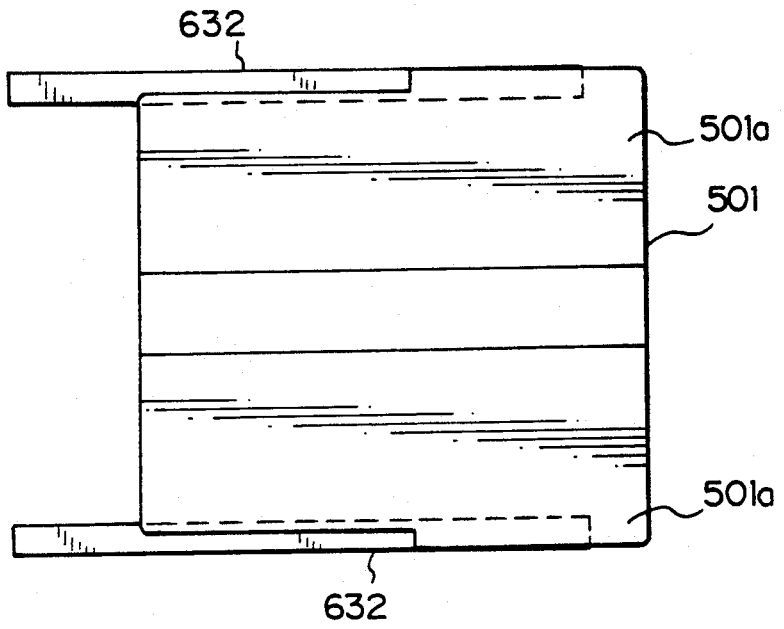
FIG. 19 shows a positional relation between first upper rails included in the cartridge transport mechanism and the cartridge.
Figure 21:
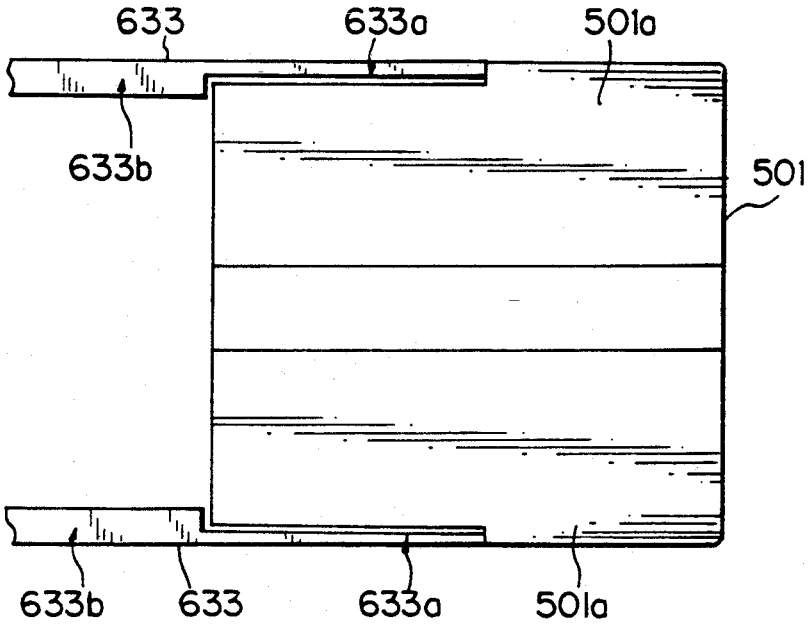
FIG. 21 shows a positional relation between the first upper rails and the cartridge in a particular condition in which the cartridge starts dropping.

The rails 632 and 633 each has a generally L-shaped section, i.e., a vertical portion and a horizontal portion extending from the lower end of the vertical portion toward the cartridge transport path 500. The rails 632 and 633 are paired at the right-hand side and left-hand side of the transport path. The rails 632 are disposed above the cartridge collecting section 551 of the box 550 and extend as far as a position below the transport roller 610 on one hand and a position just before the transport roller 611 on the other hand. The horizontal portions of the rails 632 are so configured as to allow the flanges and flaps 501 of the cartridge top plate 501 to rest thereon (see FIG. 19). The cartridge top plate 501 are capable of moving through the gaps between the upper surfaces of the horizontal portions of the rails 632 and the lower portion of the roller 610. The rails 633 are located above the cartridge collecting section 551 and the hopper 101. The ends of the rails 633 close to the rear wall of the apparatus are positioned such that the flanges and flaps 501*a* of the cartridge top plate 501 can pass through the gaps between the upper surfaces of the horizontal portions and the lower portion of the transport roller 610. The rails 633 extend from the above-mentioned ends toward the front of the apparatus in an inclined position as far as a position below the transport roller 611 and extend further to a position above the intermediate portion of the collecting section 551 along the underside of the rails 632. As shown in FIG. 21, the horizontal portions of the rails 633 are so configured as to allow the flanges and flaps 501*a* of the cartridge top plate 501 to rest on the portions 633*a* close to the front of the apparatus and to allow the flanges and flaps 501*a* of the top plate 501 to rest on the portions 633*b* close to the rear of the apparatus. The portions 633*a* each has a length corresponding to the distance between the rear end of the flap 501*a* and the rear end of the flange of the top plate 501.

As shown in FIGS. 4 and 8, a leaf spring 640 is affixed to the underside of the rear end of each rail 632 and extends rearward and upward toward the the rear of the apparatus. As the cartridge top plat 501 is guided to the upper rails 633 during the reverse transport of the cartridge 500, which will be described, the leaf springs 640 allow the top plate 510 to be guided by the upper rails 633 in a position above the upper rails 632.

Figure 20:
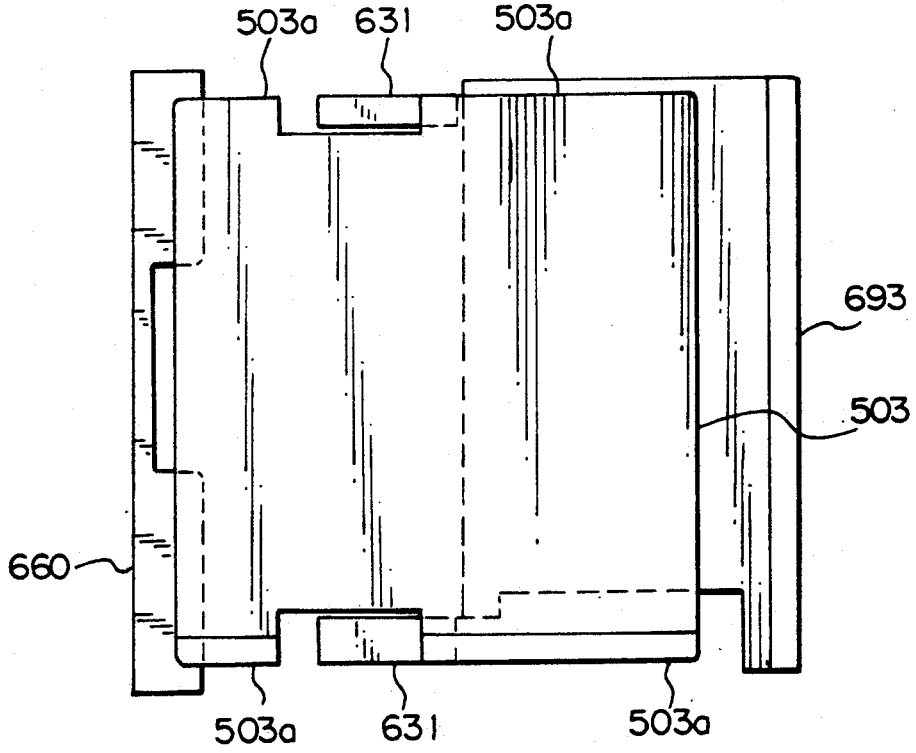
FIG. 20 shows a relation between lower rails included in the cartridge transport mechanism and the cartridge.
Figure 22:
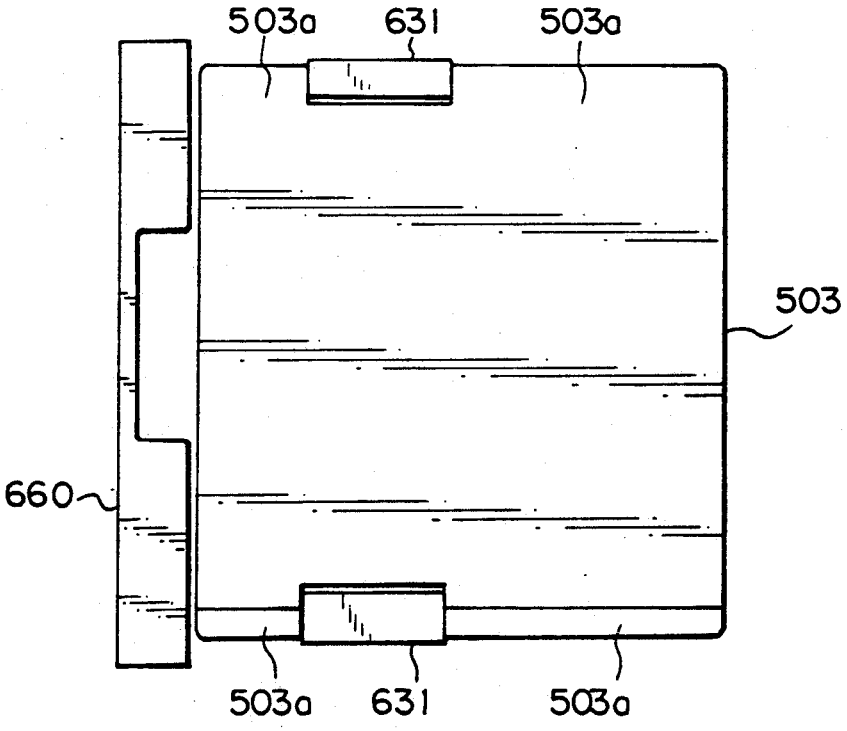
FIG. 22 shows a positional relation between the lower rails and the cartridge.
Figure 23:
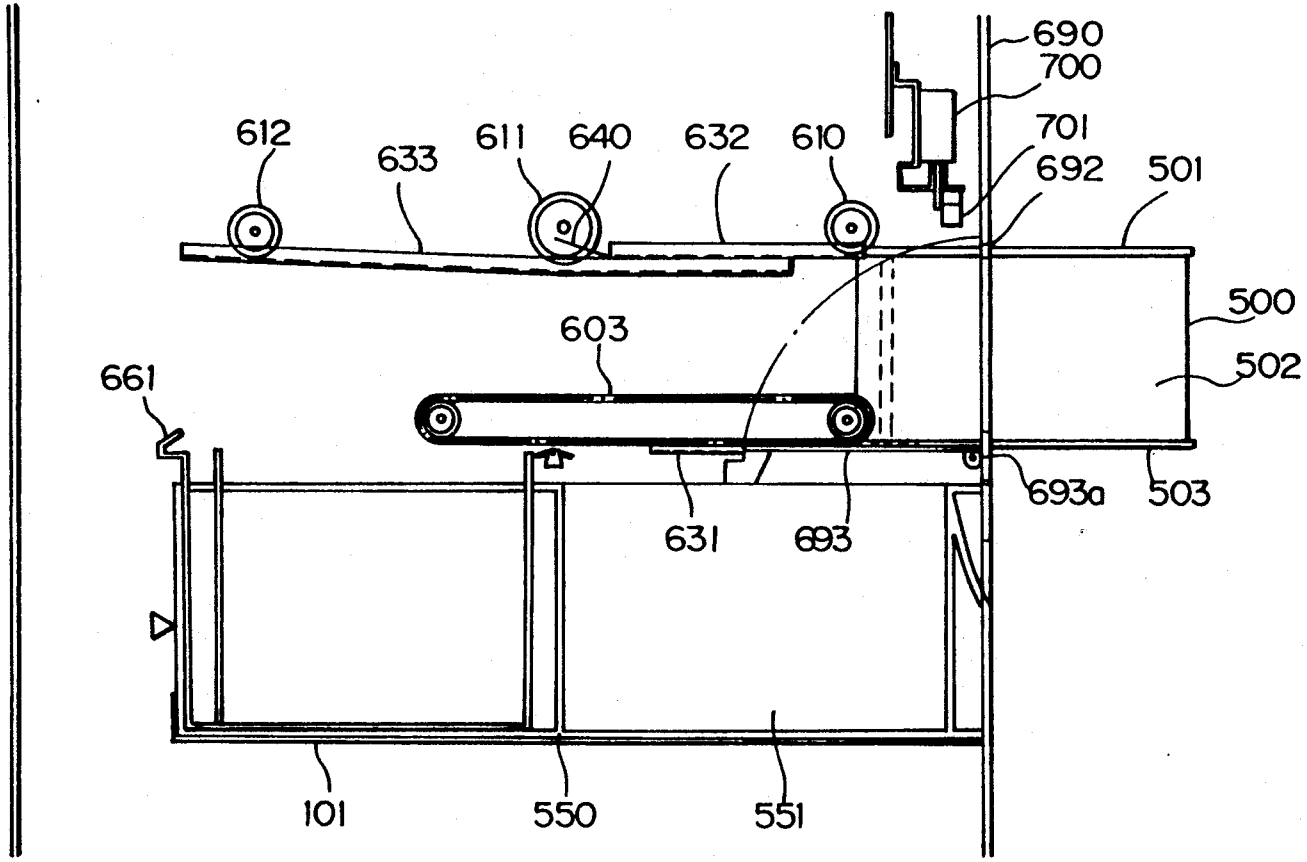
FIG. 23 is a side elevation of the cartridge being inserted, as viewed from the left.
Figure 24:
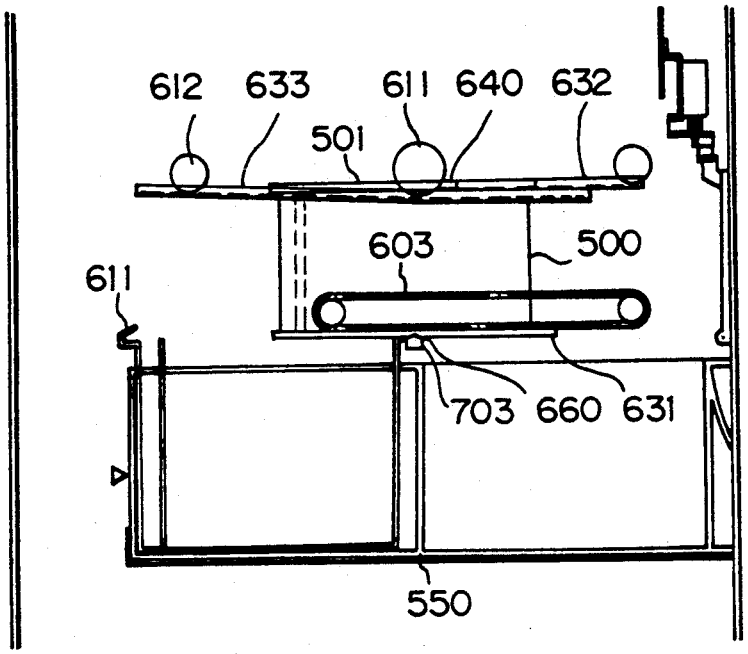
FIG. 24 is a side elevation as viewed from the left, showing the cartridge being transported toward the hopper opening.

The lower rails 631 also have a generally L-shaped section constituted by a vertical portion and a horizontal portion extending from the lower end of the vertical portion toward the cartridge transport path. The lower rails 631 are provided in a pair at the right-hand side and left-hand side of the cartridge transport path and at a a position above the cartridge collecting section 551 and closer to the rear of the apparatus than the intermediate portion of the collecting section 551. As shown in FIG. 20, the horizontal portions of the rails 631 are so shaped to allow the flanges and flaps 501*a* of the cartridge top plate 501 to rest thereon. At the same time, the horizontal portions are located at such a level that the flanges and flaps 501*a* can pass the gaps defined between the upper surfaces of the horizontal potions and the underside of the transport belt 551. The rails 631 have a length in the front-and-rear direction which is the same as the distance between the front and rear flaps 503*a* of the cartridge bottom plate 503. As shown in FIG. 22, the rails 631 are positioned such that when the notch between the front and rear flaps 503 provided at each side of the cartridge bottom plate 503 are aligned with the rails 631 during the reverse transport of the cartridge 500 and, therefore, the cartridge 500 begins to drop, the cartridge 500 is located at substantially at the center of the collecting section 551 in the front-and-rear direction. When the notches between the associated flaps 503*a* of the bottom plate 503 are aligned with the rails 631 as mentioned above, the lower transport roller 610 and belt 603 are still ready to further transport the cartridge 500. However, since the door 693 has already been moved away from the position above the opening of the collecting section 551, nothing supports the cartridge 500 from below with the result that the cartridge 500 starts dropping into the box 550. The upper rails 633 are positioned relative to the lower rails 631 such that the cartridge top plate 501 also starts dropping at the position where the bottom plate 503 starts dropping.

Figure 17:
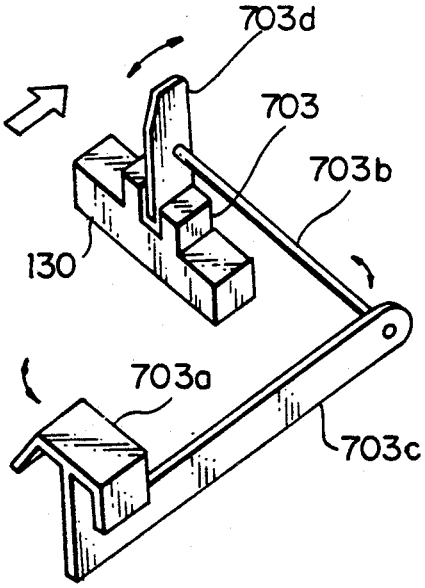
FIG. 17 is a perspective view of an unseal sensor included in the toner supply mechanism.

A feeler 703*a* is provided on the transport path between the box 550 and the hopper opening to monitor the transport condition of the cartridge 500 (see FIG. 4). When the cartridge 500 reaches the feeler 703*a*, the underside of the front flanges thereof urge the feeler 703*a* downward. Specifically, as shown in FIG. 17, a rotary shaft 703*b* is constantly biased by a coil spring, not shown, in such a manner as to rotate in the clockwise direction. The feeler 703*a* is affixed to the free end of an arm 703*c* which is affixed to the shaft 703*b*. Also mounted on the shaft 703*b* is another feeler 703*d*. As the seal 504 is sequentially peeled off the cartridge 500, the leading edge thereof urges the feeler 703*d* to the right of the apparatus. The biasing force acting on the shaft 703*b* is determined such that when both of the feelers 703*a* and 703*d* are free, the biasing force balances with the moment of rotation ascribable to the weight of the arm 703*c* and other members to position the lower end of the feeler 703*d* between the light emitting element and light-sensitive element of the sensor 130.

The operation of the toner supply mechanism having the above construction will be described with reference to FIGS. 23-29, 7 and 71. First, how the cartridge 500 inserted through the opening 692 is transported to the supply position in the apparatus body. The unlock solenoid 700 is usually deenergized to maintain the door 693 in a locked or closed position. In a toner near end condition or similar condition wherein the cartridge 500 should be inserted into the apparatus body, the unlock solenoid 700 is energized to unlock the door 693. As the operator inserts the cartridge 500 into the apparatus body by pressing the door 693 by the end of the cartridge 500, the door 693 rotates about 90 degrees about the shaft 693*a* to a position shown in FIG. 23. In this position, the door 693 covers part of the opening of the cartridge collecting section 551 to prevent the cartridge 500 from dropping into the collecting section 551. At the same time, the door 693 forms a transport path in cooperation with the lower rails 631 for supporting the cartridge bottom plate 501 from below. As soon as the door 693 starts rotating toward the position shown in FIG. 23, the free end of the plate 693*a* affixed to the door 693 leaves the gap between the light emitting element and light-sensitive element of the door sensor 701. As a result, the door sensor 701 is turned on to show the opening of the door 693 ((1), FIG. 71). On the elapse of a predetermined period of time T1 after the door opening has been sensed, the transport motor 702 starts rotating forward. Then, the cartridge 500 is pulled into the apparatus with the top plate 501 and bottom plate 503 thereof driven by the transport rollers 610 and lower transport belt 601, respectively. Since the top plate 501 and bottom plate 503 reach respectively the transport roller 610 and the lower transport belt 603 at the same time and, therefore, receive a transporting force at the same time, the cartridge 500 can be stably transported despite that the sides thereof are constituted by a film-like or elastic member.

Figure 25:
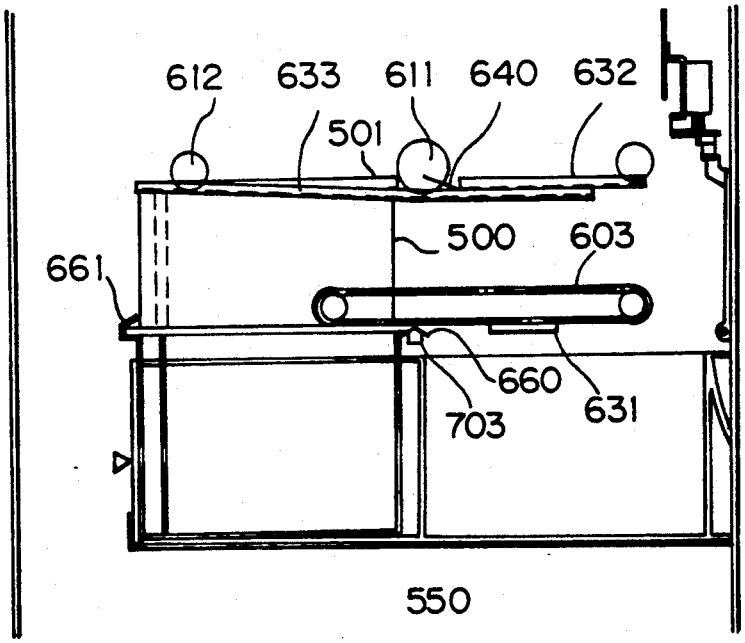
FIG. 25 is a side elevation as viewed from the left, showing the cartridge having arrived a position above the hopper opening.
Figure 30:
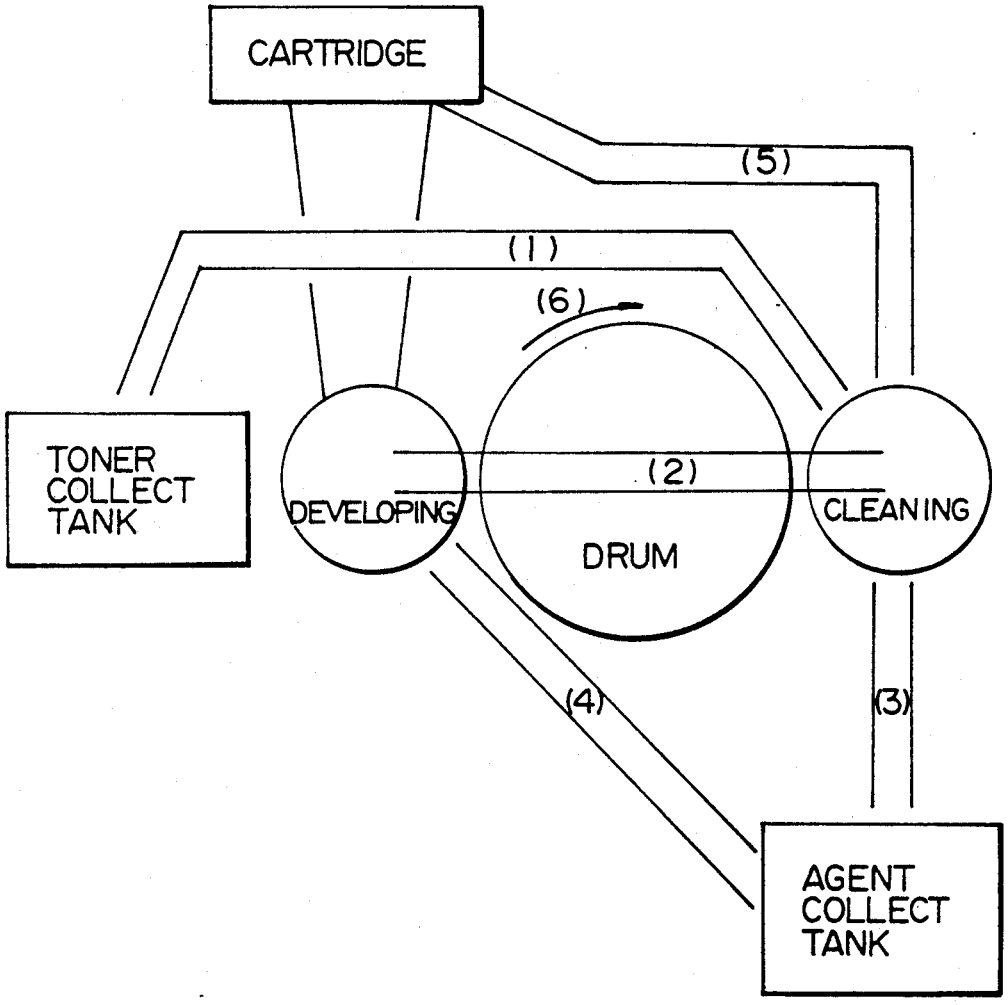
FIG. 30 shows various transport paths available with an image forming apparatus for transporting a developer and other agents.

The bottom plate 503 and top plate 501 of the cartridge 500 are guided by the door 693 and lower rails 631 and the upper rails 632, respectively (see FIGS. 20 and 30). As the top plate 501 advancing toward the rear of the apparatus reaches the leaf springs 640 provided on the upper rails 632, it is further transported by pressing the leaf springs 640 downward until it abuts against the lower portion of the transport roller 611. The top plate 501 receives a transporting force from the transport roller 610 and is, therefore, pressed downward by the spring 652, whereby the transport roller 611 is urged upward. Then, the transport roller 611 meshes with the timing groove 501*b* of the top plate 501 to thereby drive the top plate 501 (FIG. 24) toward the position above the hopper opening. When the leading end of the cartridge 500 reaches the feeler 703*a*, the sensor 130 is turned on. Thereafter, the cartridge 500 is further transported until the trailing end thereof moves away from the feeler 703*a* and thereby turns off the sensor 130 ((2), FIG. 71). As the trailing edge of the cartridge 500 moves away from the door 693, the free edge of the door 693 is rotated upward to close the opening 692 with the result that the door sensor 701 is turned off. At the time when the sensor 130 is turned off ((2), FIG. 71), the cartridge 500 has already been brought to the toner supply position above the hopper opening and where it abuts against the wall 661. To further insure such a position of the cartridge 500, the transport motor 702 is rotated forward for a predetermined period of time (T2, FIG. 71). As a result, the leading edge of the bottom plate 503 is restricted in the position in the transport direction and urged against the hopper 101 since the wall 661 forms a tapering or wedge-shaped clearance. This, coupled with the fact that the trailing edge of the bottom plate 503 is pressed by the lower transport belt 603, causes the plate 503 to stop in tight contact with the hopper 101 (FIG. 25). The seal 662, FIG. 5, surrounding the hopper opening provides sealing between the hopper 101 and the cartridge 500. This surely prevents the toner from being scattered around by a simple implementation. On the elapse of the period of time T2, the transport motor 702 is deenergized to start of an operation for unsealing the cartridge 500.

The top plate 501 of the cartridge 500 moved away from the transport roller 610 is further transported by the transport roller 611 to the transport roller 612. When the top plate 501 reaches the toner and developer supply position (FIG. 25) driven by the roller 612, it is guided by the upper rails 633. As the trailing edge of the top plate 501 moves away from the transport rollers 611, the rollers 611 are returned to its original position by the spring 652.

The transport of the cartridge 500 has been described in relation mainly to the top plate 501. During such transport, the bottom plate 503 is driven by the lower transport belt 603 at the same speed as the top plate 501 while being guided by the lower rails 631 and hopper guide 660.

Figure 26:
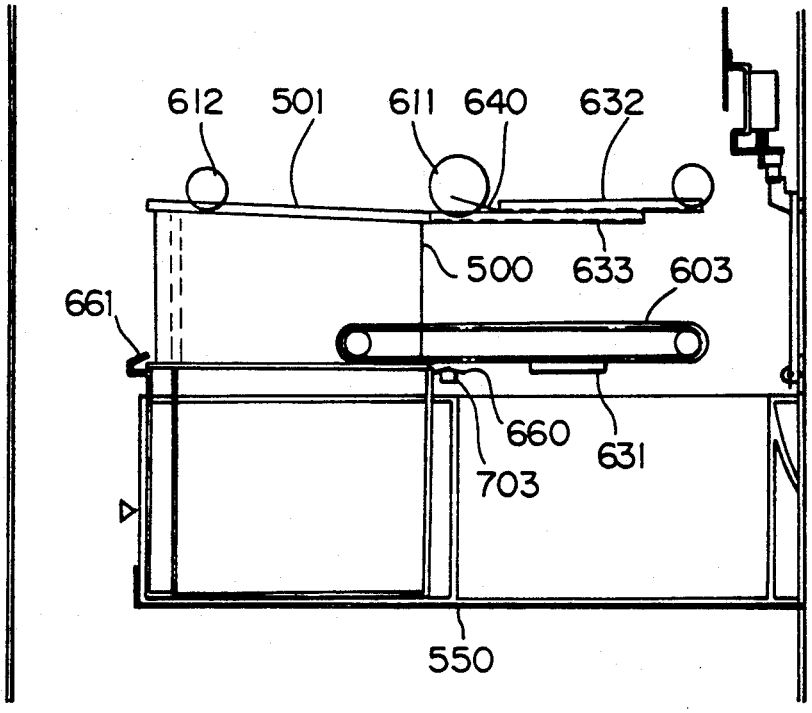
FIG. 26 is a side elevation as viewed from the left, showing the cartridge having fully supplied a toner in the position above the hopper opening.
Figure 71:
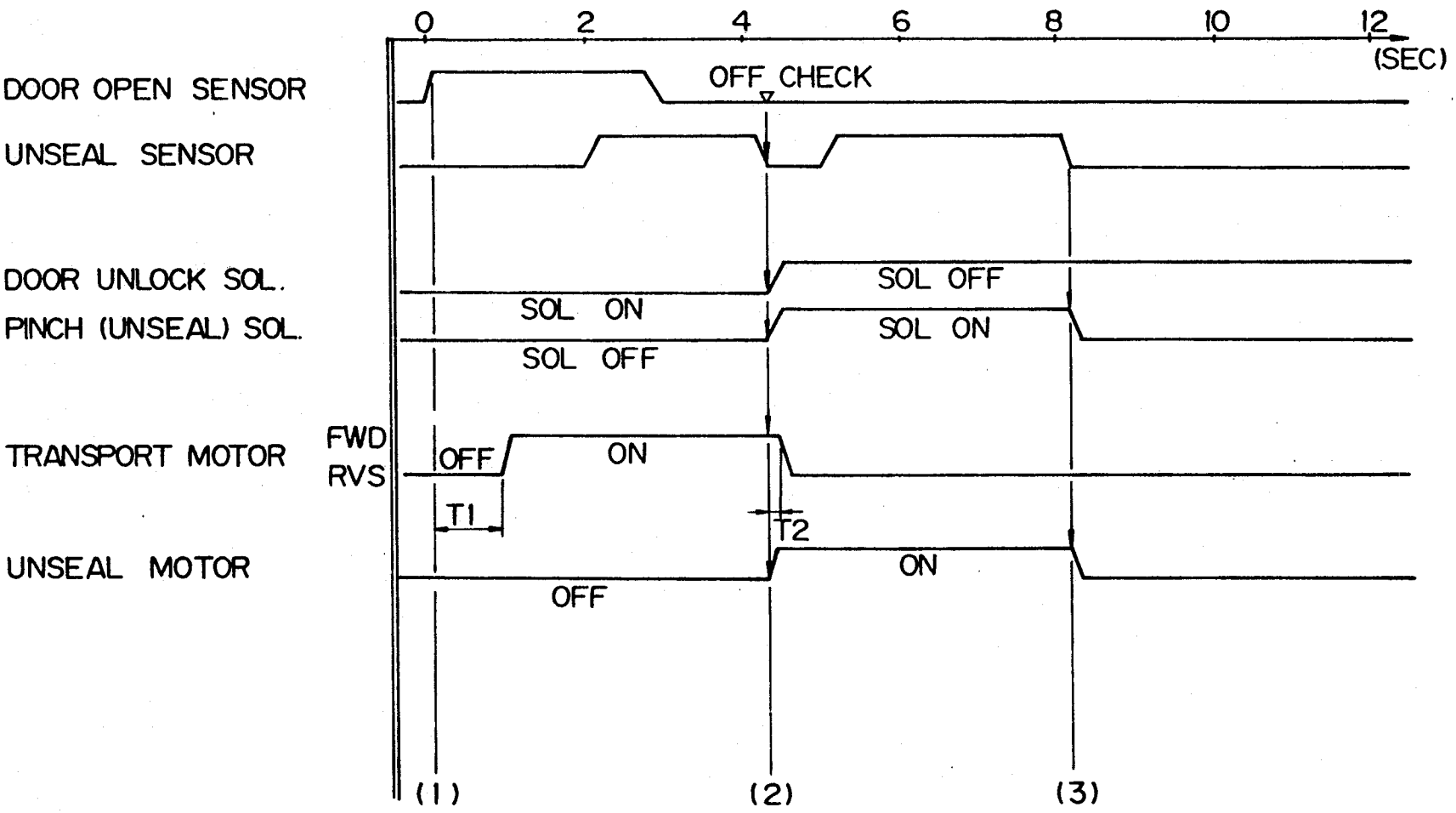
FIG. 71 is a timing chart demonstrating control to be executed by the copier of FIG. 1 in the event of insertion of the cartridge.
Figure 72:
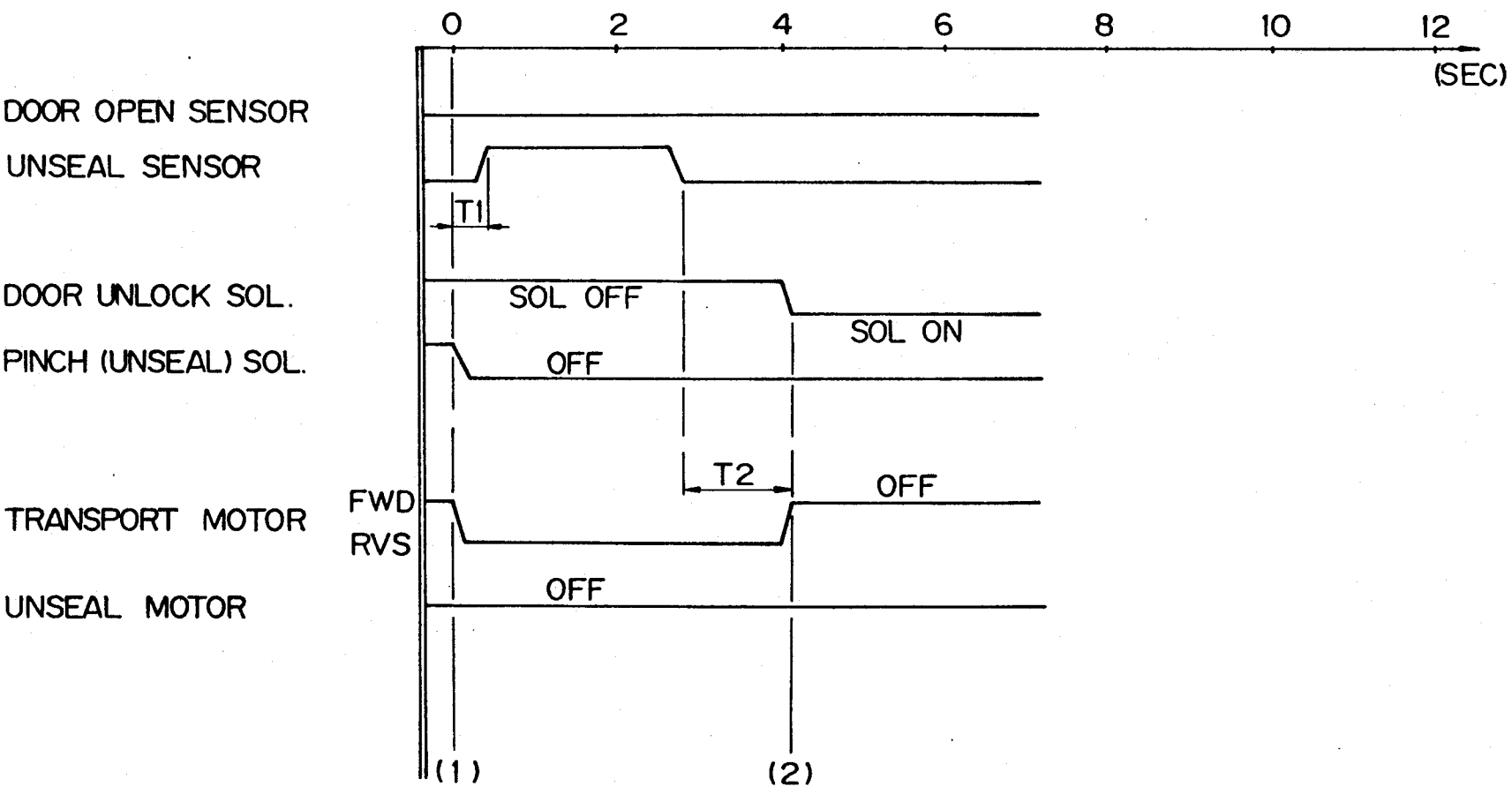
FIG. 72 is a timing chart representative of control to be executed by the copier of FIG. 1 in the even of transport of the cartridge to the collecting section.

A reference will be made to FIGS. 14, 15 and 71 for describing the operation for unsealing the cartridge 500. To begin with, at the time when the sensor 130 has been turned off ((2), FIG. 71), the closed position of the door 693 is confirmed on the basis of the output of the door sensor 701, and then the unlock solenoid 700 is deenergized. As a result, the door 693 is locked in the closed position. The pinch solenoid 704 is energized to cause the unseal rollers 680 to nip the free edge of the seal 504 which is positioned between the front and rear right flaps 501*a* of the top plate 501. At the same time, the unseal motor 705 is turned on to rotate the unseal rollers 680, thereby starting peeling off the seal 504 from the underside of the cartridge 500. As the seal is sequentially peeled off the cartridge 500, the leading edge thereof reaches the feeler 130*b* to turn on the unseal sensor 130. As the unsealing operation proceeds, the leading end portion of the seal 504 is sequentially collected in the seal collecting section 681. When the trailing edge of the seal 504 moves away from the feeler 130*b*, the sensor 130 is turned off ((3), FIG. 71) to indicate that the cartridge 500 has been fully unsealed. Then, the pinch solenoid 704 and motor 705 are turned off to return the rollers 680 to the retracted position. On the unsealing of the cartridge 500, the toner and agent are let fall from the cartridge 500 to the respective collecting sections 101*a* and 101*b* of the hopper 101. Then, the trailing edge of the top plate 501 of the empty cartridge 500 is ready to fall onto the upper rails 633 (FIG. 26).

The toner and agent supplied to the hopper 101 by the above procedure are fed to the developer 100 by supply control which will be described later. Flags representative of the sequence of steps described above are set (ONE) or reset (ZERO) in a nonvolatile RAM, so that the sequence may be continued even when the power supply is momentarily shut off. As the hopper 101 runs out of the toner due to the repetitive copying cycle, a new cartridge is loaded to supply a toner and a agent. Before the insertion of the new cartridge, the empty cartridge 500 disposed on the hopper 101 is shifted to the cartridge collecting section 551, as follows.

Figure 27:
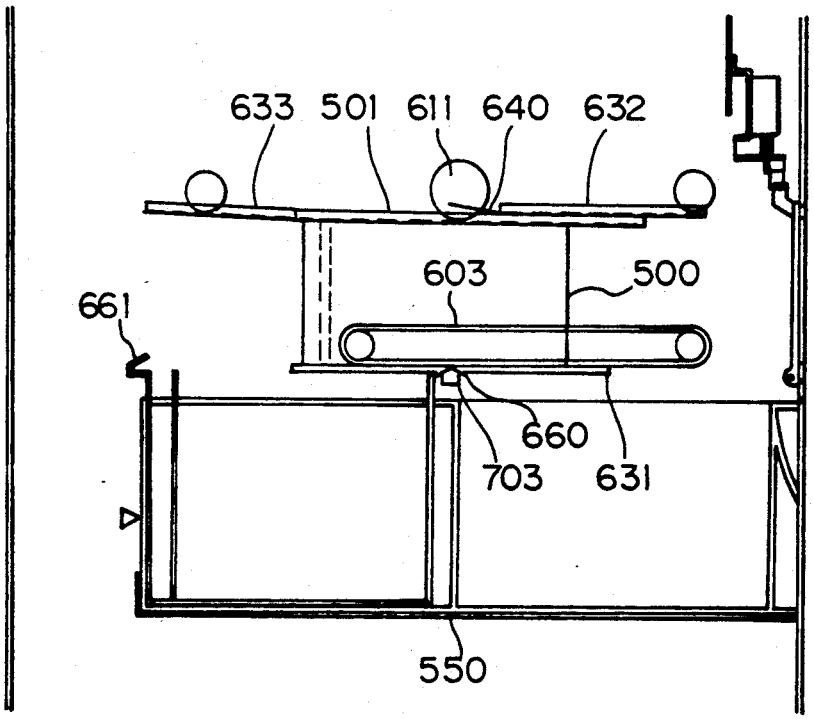
FIG. 27 is a side elevation as viewed from the left, showing a condition just after the start of reverse transport of the cartridge.
Figure 28:
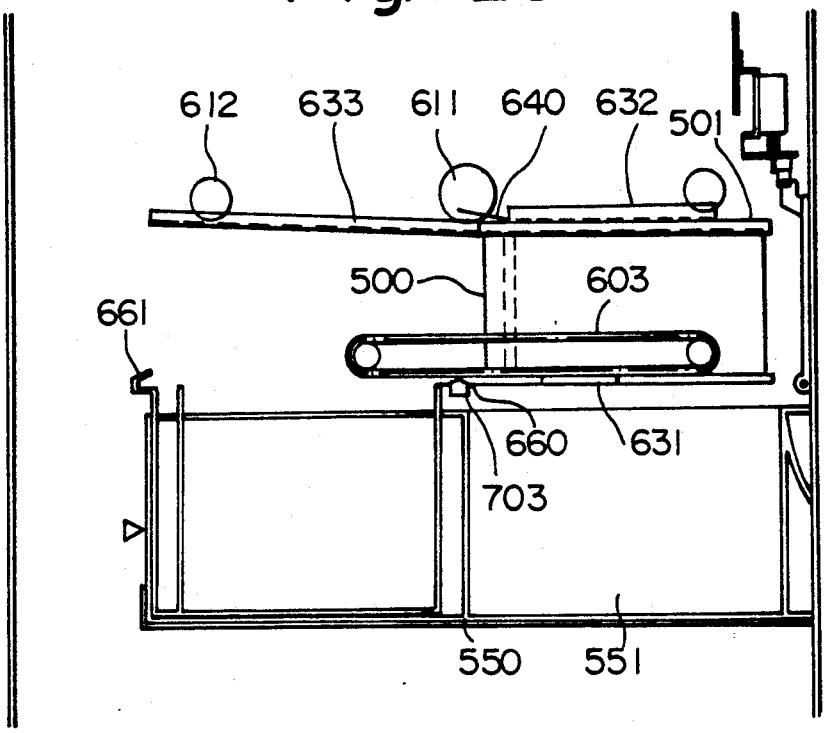
FIG. 28 is a side elevation as viewed from the left, showing the cartridge having arrived at a position above a cartridge collecting section.
Figure 29:
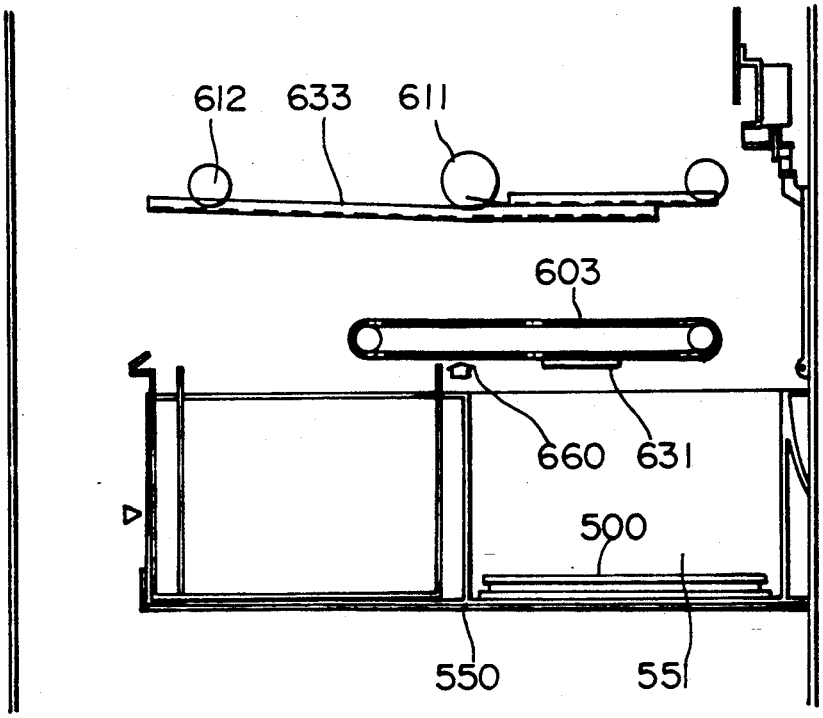
FIG. 29 is a side elevation as viewed from the left, showing the cartridge having dropped into the collecting section.

Referring to FIGS. 27, 28, 29 and 72, the operation for shiting the empty cartridge 500 to the collecting section 551 begins after a near end condition has been written to the nonvolatile RAM. The retraction or reverse transfer of the empty cartridge 500 from the hopper opening should only be completed before the insertion of the next cartridge. In the embodiment, however, only when a toner near end condition needing the next cartridge 500 is set up, the empty cartridge 500 is moved away from the hopper opening toward the collecting section 551. First, the pinch solenoid 704 is turned off to move the unseal roller 680 to the retracted position, so that the roller 680 may not interfere with the cartridge 500. Then, the transport motor 702 is reversed to start on the reverse transport of the cartridge 500. The trailing end of the cartridge 500 (on the opening 692 side) reaches the feeler 703*a* at a particular timing, turning on the unseal sensor 130. As the cartridge 500 is further transported in the reverse direction until the entire cartridge 500 moves away from the feeler 703*a*, the unseal sensor 703 is tuned off. While the top plate 501 of the cartridge 500 is guided by the upper rails 2 (622), it is led to below the upper rails 1 (632) by the springs (FIG. 27). The bottom plate 503 is transported at the same speed as the top plate 501 by being guided by the hopper guide 660 and lower rails 631. In this manner, the top plate 501 and bottom plate 503 are brought to a position above the cartridge collecting section (FIG. 28) and where nothing guides the plate 501 or the plate 503 (FIGS. 21 and 22). In this condition, while the two plates 501 and 503 re ready to drop, the embodiment continues the reverse rotation of the motor 702 for a predetermined period of time (T2, FIG. 72) so as to insure the arrival of the plates 501 and 503 at the position above the collecting section 551. The period of time T2 is selected to be longer than the time necessary for the cartridge 500 to drop by gravity at the above-mentioned position and the time necessary for the cartridge 500 to be transported from the unseal sensor 703 to the same position (by taking account of the sleep ratio and other factors).

After the above sequence of steps, a counter provided in the non-volatile RAM for counting empty cartridge 500 accommodated in the cartridge collecting section 551 is incremented by 1 (one). In this condition, the apparatus is ready to receive a new cartridge 500. Then, the unlock solenoid 700 is turned on to unlock the door 693 while a toner near end condition is displayed. The empty cartridge 500 collapses (FIG. 29) when dropped into the collecting section 551, since it has a plate at the top and bottom thereof and a film-like or elastic member at the sides. Specifically, the cartridge 500 which is 86 mm high before the drop collapses to a height of about 10 mm and, therefore, occupies a minimum of space in the collecting section 551. Since the empty cartridge 500 drops into the box 133 in a horizontal position, it generates a stream of air in the collecting section 51 by forcing air downward. The stream of air in turn generates an ascending air stream along the inner periphery of the collecting section 551. It is likely, therefore, that the toner accumulated on the bottom of the collecting section 551 is scattered around to the cartridge transport path via the top opening of the collecting section. In light of this, the top plate 501 of the cartridge 500 may be formed with openings each having a filter to thereby reduce the air stream. Further, an elastic member such as sponge may be affixed to the bottom of the collecting section 551 to absorb the shock ascribable to the fall of the cartridge 500 and to thereby further prevent the toner from being scattered around. If desired, openings may be formed through, for example, the side walls of the collecting section 551 for releasing the air stream to the outside.

How the developer is supplied will be described hereinafter.

Generally, in an image forming apparatus, a developing device and a cleaning device are the units which use a developer. A plurality of developer transport paths are available for supplying a developer to the two units, as shown in FIG. 30 schematically. Table 1 shown below lists six different developer replacing systems, i.e., patterns A, B, C, D, E and F each using particular ones of the paths.

TABLE 1

| | REUSE OF TONER | PATHS |
|---|---|---|
| PATTERN A | yes | (2) (3) |
| PATTERN B | yes | (2) (3) (6) |
| PATTERN C | yes | (2) (3) (4) (5) |
| PATTERN D | no | (1) (3) (4) (5) |
| PATTERN E | no | (1) (2) (3) |
| PATTERN F | no | (1) (3) (6) |

In Table 1, the bracketed numerals correspond to the bracketed numerals designating the different paths shown in FIG. 30. Also, the word "reuse" refers to returning the toner removed by a cleaning device after image transfer to a developing device to use it again.

The pattern A replaces the developer by using only the paths (2) and (3). A developer used in a cleaning device is discharged to a collecting tank via the path (3). Then, one half of a developer existing in a developing unit is fed to the cleaning device by, for example, the reverse rotation of a toner recycle screw which is provided on the path (2). Subsequently, a fresh developer fed from, for example, a cartridge to a hopper is introduced into the developing unit. The toner collected in the cleaning device is reused for development by the forward rotation of the recycle screw. The pattern A using only the paths (2) and (3) has an advantage that the path arrangement is simplest.

The pattern B uses the paths (2), (3) and (6). The developer used in the cleaning device is discharged to the developer collecting tank via the path 3, and then one half of the developer existing in the developing unit is fed to the cleaning device by being electrically deposited on a photoconductive drum. Subsequently, a fresh developer supplied from, for example, a cartridge to the hopper is delivered to the developing unit. The toner collected in the cleaning device is fed to the developing unit by the recycle screw and reused. Since the pattern B uses only tubings constituting the paths (2) and (3) and the patch (6), it completes the replacement of the developer within a short period of time.

The pattern C uses the paths (2), (3), (4) and (5). The developer used in the cleaning device is collected in the developer collecting tank via the path (3), and then a fresh developer is supplied from the cartridge to the cleaning device via the path (5). On the other hand, the developer used in the developer is discarded to the developer collecting tank via the path (4), and a fresh developer is fed from the cartridge to the developing unit via the hopper. The toner in the cleaning device is reused for development by the forward rotation of the recycle screw. The advantage of this pattern C is that the developer is replaced in both of the developing device and cleaning device at the same time, completing the replacement most rapidly. In addition, the toner consumption is reduced due to toner recycling.

The pattern D uses the paths (1), (3), (4) and (5). The developer used in the cleaning device is discarded to the developer collecting tank via the path (3), and then a fresh developer is supplied from the cartridge to the cleaning device via the path 5. On the other hand, the developer used in the developing unit is discarded to the developer collecting tank via the path 4, and a fresh developer is supplied from the cartridge to the developing unit via the hopper. The toner collected in the cleaning device is discarded to a waste toner collecting tank by a screw provided on the path (1). This pattern D, like the pattern C, completes the replacement of the developer within the shortest period of time. In addition, the pattern C produces attractive images since the recycled toner to be reused is excluded.

The pattern E uses the paths (1), (2) and (3). The developer used in the cleaning device is discarded to the developer collecting tank via the path (3), and then one half of the developer existing in the developing unit is fed to the cleaning device via the path (2). Subsequently, a fresh developer is supplied from the cartridge to the developing unit via the hopper. The toner collected in the cleaning device is dicarded to the waste toner tank by the screw provided on the path (1). The pattern E which also excludes the recycled toner has an advantage that the resulting image is attractive. The developer is surely conveyed by the screw.

The pattern F uses the paths (1), (3) and (6). The developer used in the cleaning device is discarded to the developer collecting tank via the path (3), and then one half of the developer existing in the developing unit is delivered to the cleaning device by being electrically deposited on the drum. Subsequently, a fresh developer is supplied from the cartridge to the developing unit via the hopper. The toner collected in the cleaning device is discarded to the waste toner collecting tank by the screw provided on the path (1). The pattern F which also excludes the recycled toner insures attractive images. In addition, the pattern F reduces the cost since it uses only the tubings constituting the paths (1) and (3).

It is to be noted that the path (3) included in all the six patterns described above is not essential. Alternatively, the waste developer may be collected in an exclusive region provided in the cleaning device. The mechanism for automatically transporting the cartridge 500 in the apparatus as stated earlier is practicable with any one of the six patterns. For example, the automatic cartridge transport is applicable to an image forming apparatus shown in FIGS. 31, 32, 33 and 34 and including the developer transport route corresponding to the pattern A. An automatic replacement system applicable to such a specific developer transport route will be described hereinafter.

Figure 31:
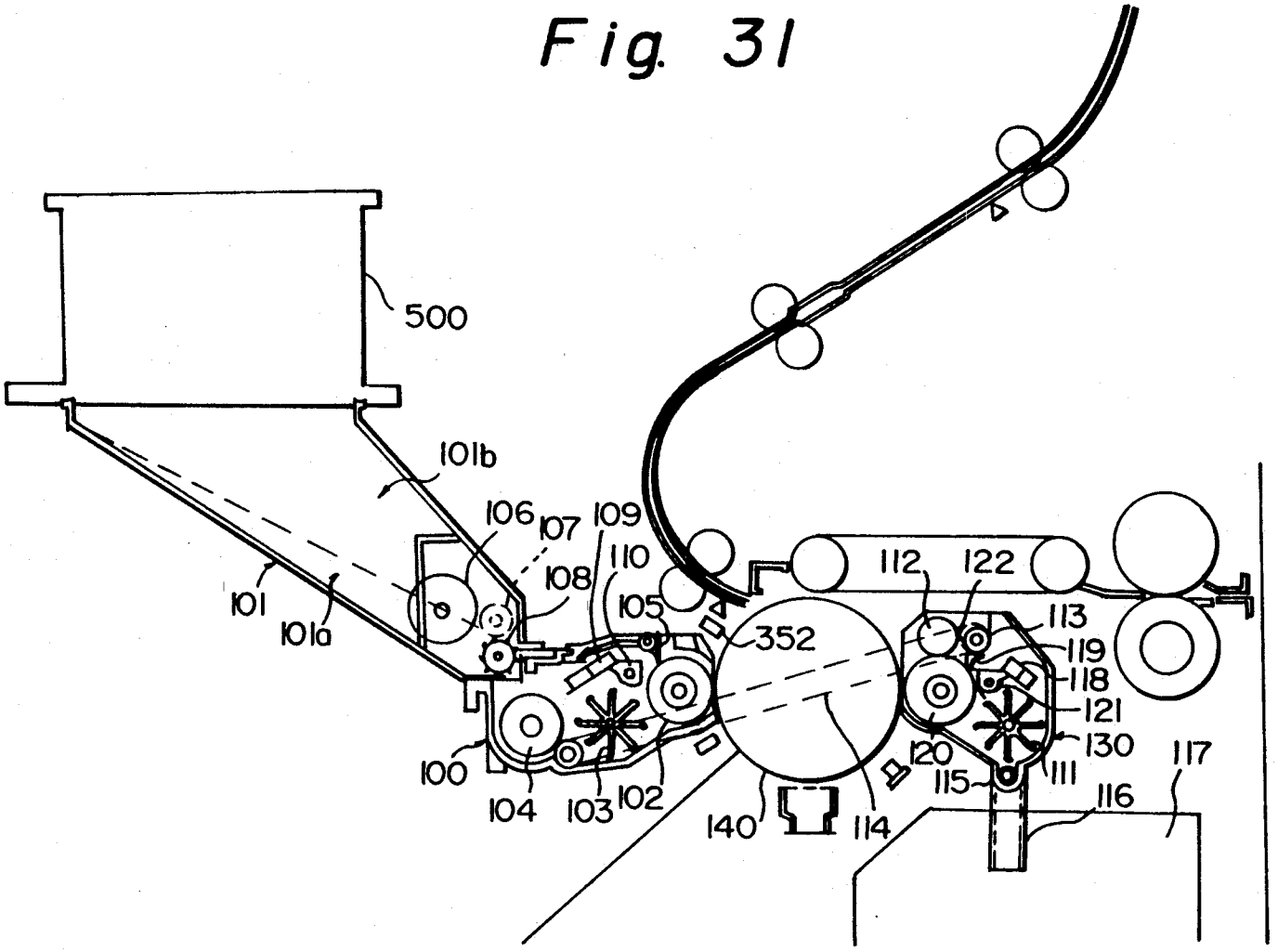
FIG. 31 shows a photoconductive element included in a toner recycle type digital copier together with associated parts.
Figure 32A:
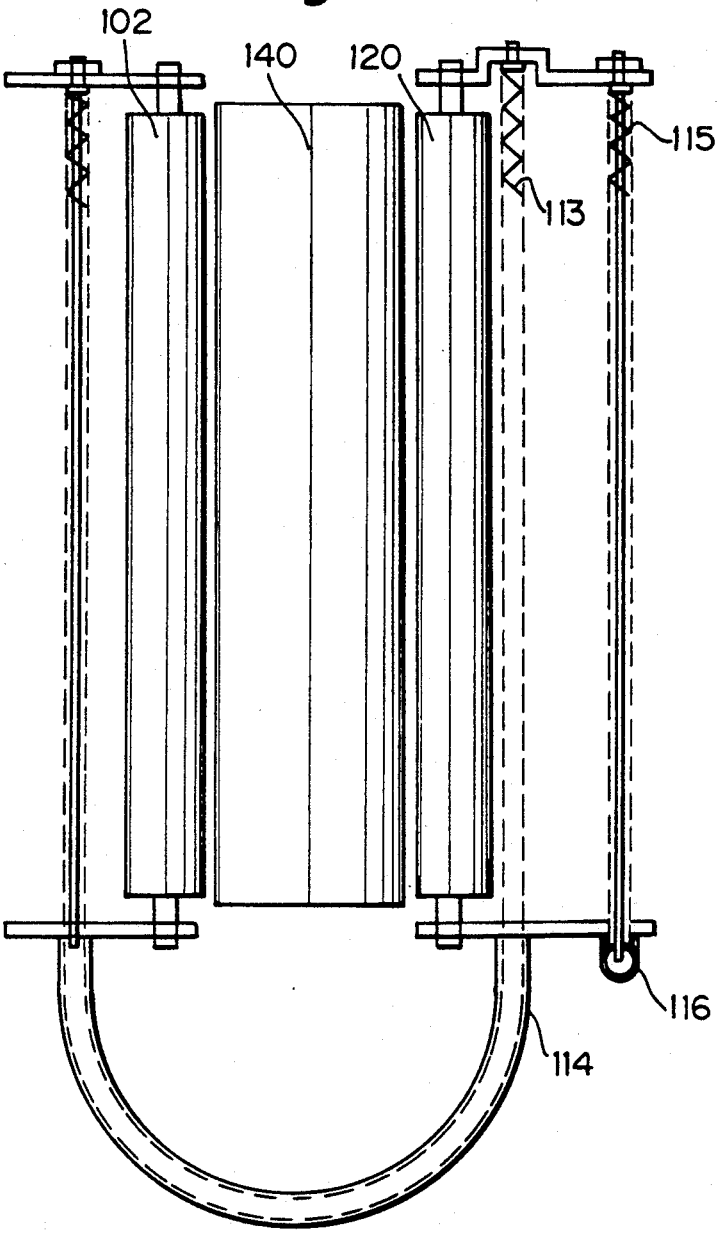
FIGS. 32A and 32B show a developer transport mechanism included in the copier of FIG. 31 in a plan view and a front view, respectively.
Figure 32B:
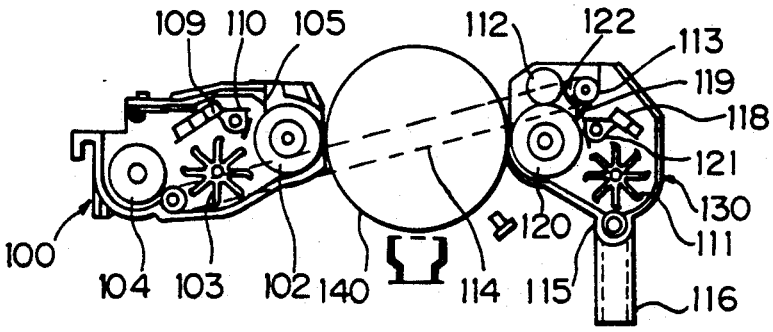
Figure 33:
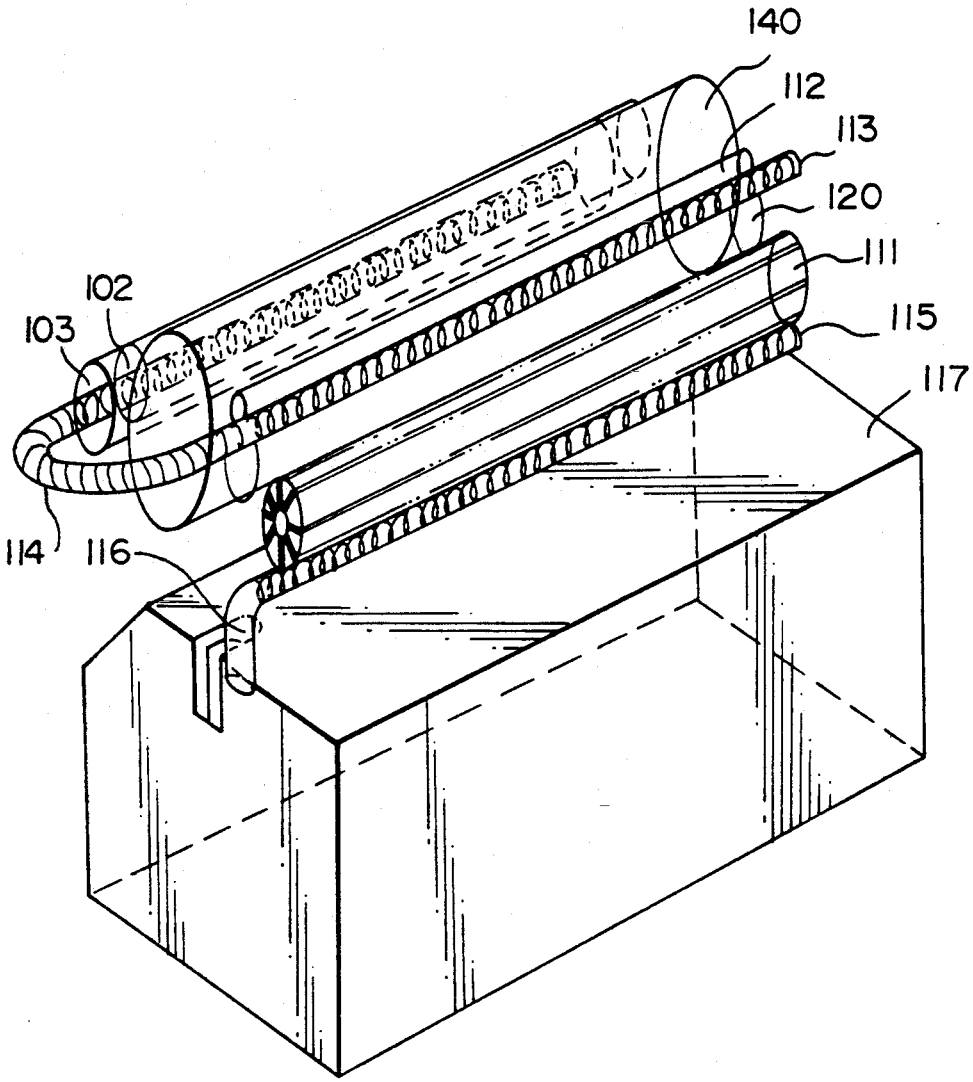
FIG. 33 is a perspective view of the developer transport mechanism.
Figure 34:
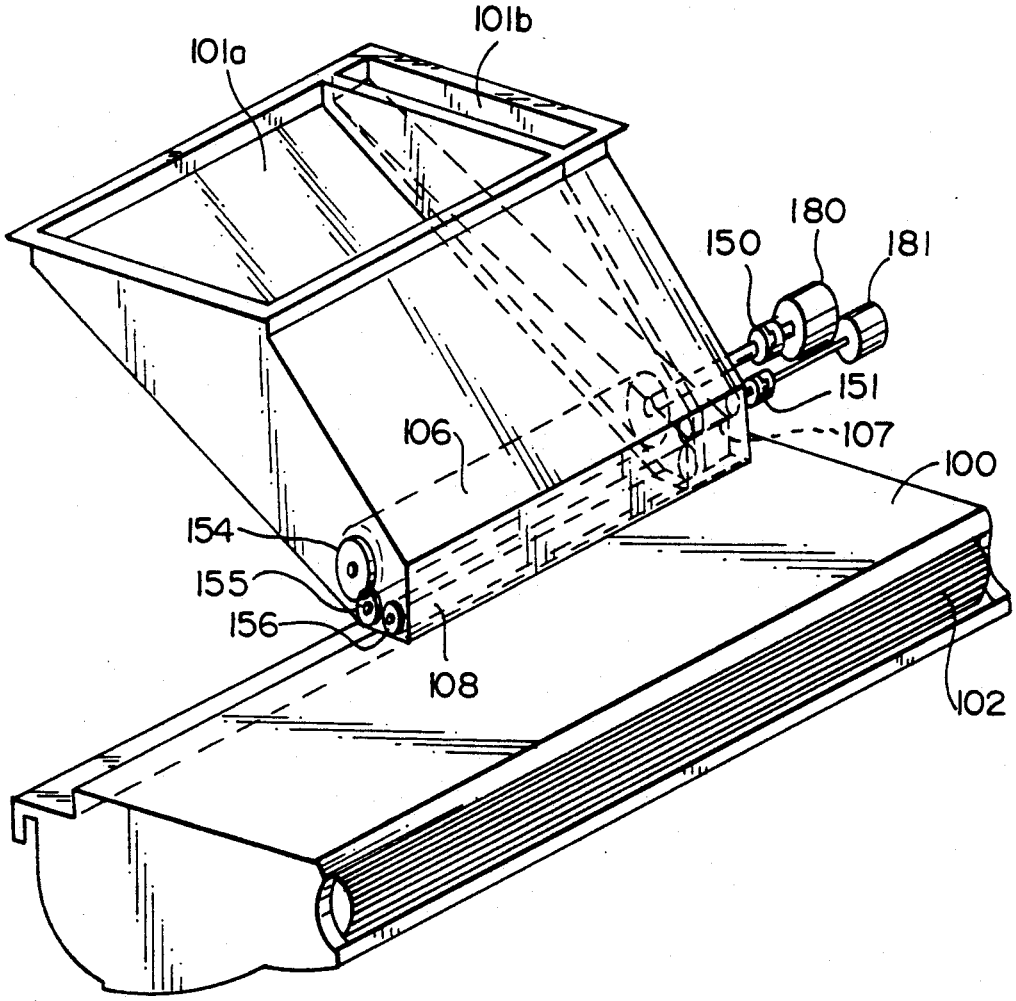
FIG. 34 is a perspective view of a developing device included in the toner recycle type digital copier.
Figure 35:
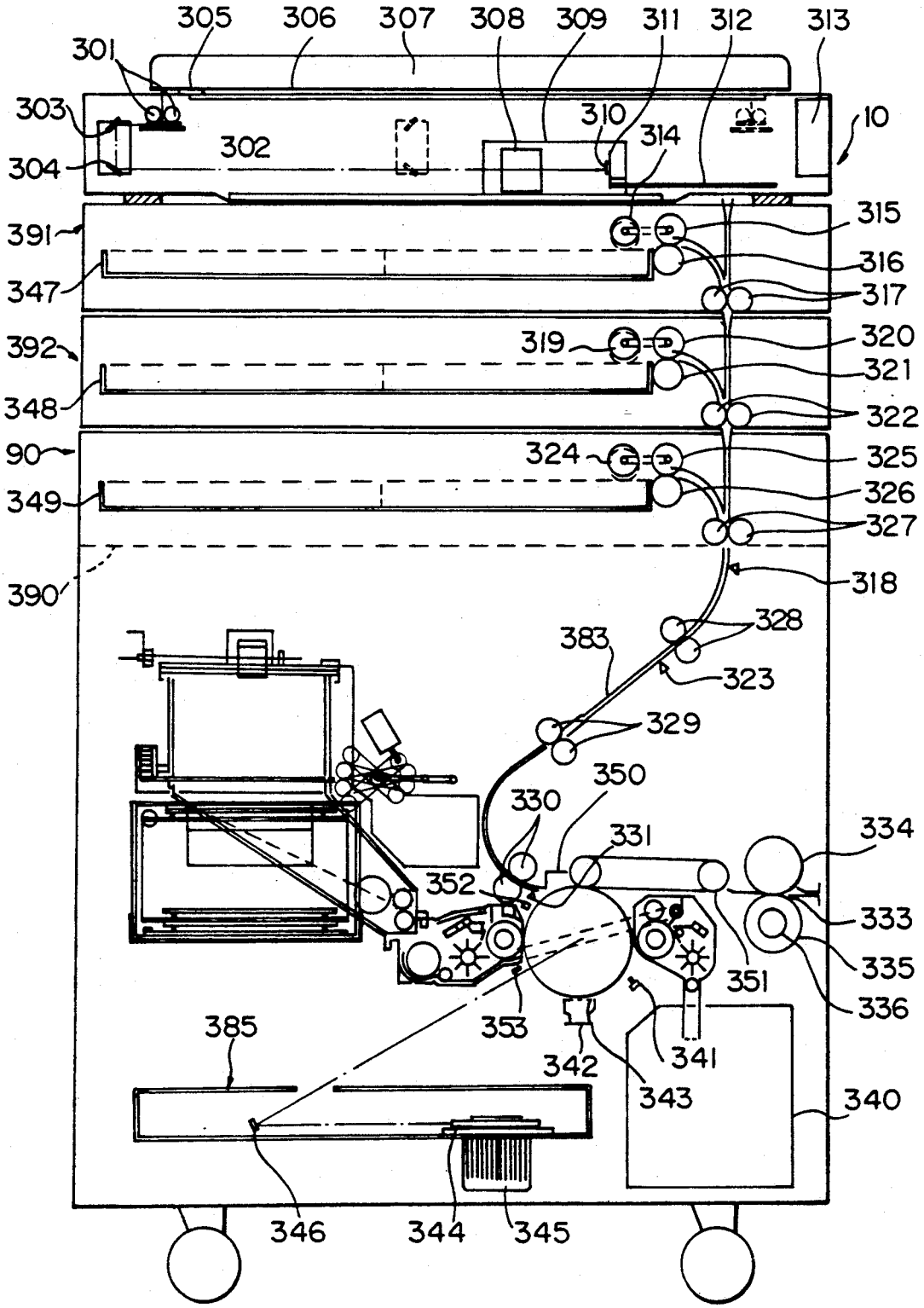
FIG. 35 is a front view of the toner recycle type digital copier.

In FIG. 31, the developing device has the boy 100 and hopper section 101 which is made up of the toner hopper 101*a* and agent hopper 101*b*. The toner and agent supplied from the cartridge 500 is introduced into the toner hopper 101*a* and agent hopper 101*b*, respectively. The toner is agitated by the agitator 106 and then supplied to the developing unit 100 by the toner supply roller 108. The toner concentration in the developing unit 100 is controlled by the amount of the supplied toner. For example, as shown in FIG. 1, a reflection type optical density sensor (P sensor) 352 reads the density of a reference image formed on the drum 140 which is representative of the toner concentration. On the other hand, the agent is supplied to the developing unit 101 by the agent supply roller 107. The agent supply roller 107 and toner supply roller 108 each has a particular cross-section. Specifically, the agent supply roller 107 is provided with one or more deep grooves for conveying a great amount of developer rapildy from the hopper 101*b* to the developing unit 100, while the toner supply roller 108 is provided with one or more shallow grooves for conveying the toner in a small amount. Alternatively, the rollers 107 and 108 may be provided with the same cross-section, in which case their rotation speeds will be changed to change the amounts of supply. The toner supply roller 108 and the agent supply roller 107 are operatively connected to electromagnetic clutches 180 and 181 via couplings 150 and 151 (see FIG. 34). The agent supply roller 107 may be implemented as a shutter in place of a roller so long as the amount of supply per unit time can be controlled.

The agent and toner supplied are mixed together by the mixing and agitating member 104 and then conveyed to the magnet roller 102 by the transport member 103. The agent and toner mixture deposited on the magnet roller 102 is regulated to a predetermined amount by the doctor blade 105, so that the mixture left on the roller 102 is conveyed toward the drum 140. At this instant, the regulating member 109 and screw 110 agitate the mixture in the developing unit 100 in the left-and-right direction to produce a uniform developer.

A magnet brush celaning device 130 removes the toner remaining on the drum 140 after the image transfer. The toner removed by the agent deposited on the magnet roller 120 is collected by a bias roller 112 to which a voltage is applied, and then it is collected by a bias blade 122. The collected toner is returned to the developing unit 100 via a recycle tubing 114 by a recycle screw 113 to be used again. The transport member 111, flow regulator 118, screw 121 and doctor blade 119 function respectively in the same manner as the transport member 103, flow regulator 109, screw 110 and doctor blade 105 included in the developing unit 100. A screw 115 is used to collect the agent existing in the cleaning device 130, i.e., it is rotatable to drive the agent to an agent collecting tank 117 via a tubing 116. In the illustrative embodiment, the agent collecting tank 117 has a volume of 7,000 cc which corresponds to 750,000 copies. While the volume of the tank 117 should preferably be as great as possible, the minimum necessary volume is 750 cc corresponding to 80,000 copies.

Figure 73:
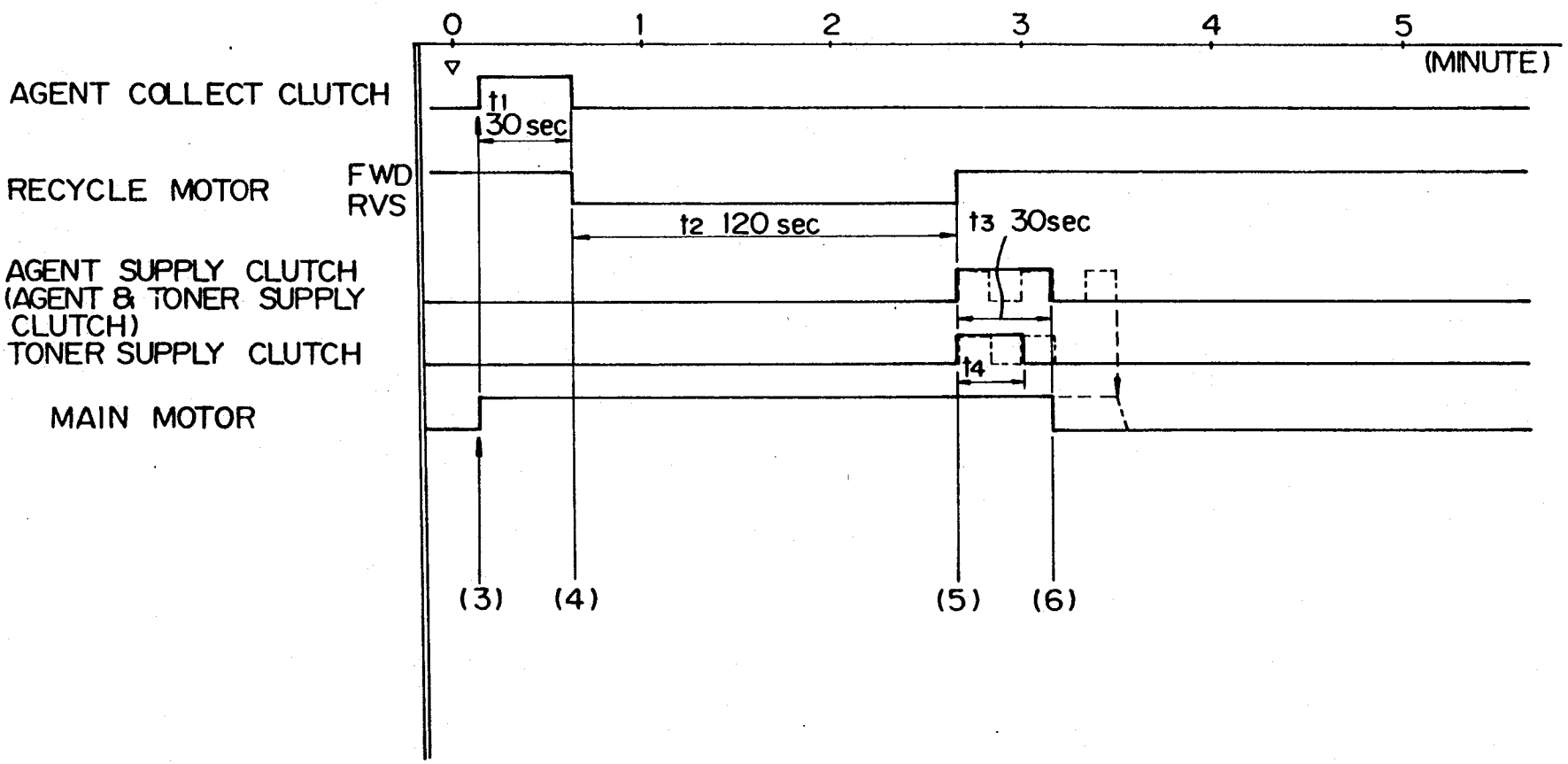
FIG. 73 is a timing chart representative of control to be executed by the copier of FIG. 35 in the event of unsealing the cartridge.

The automatic collection of the agent will be described with reference to FIG. 73. Assume that the cartridge 500 is replaced with new one due to short toner. When a new cartridge is positioned above the hopper opening, an agent replacing system is activated. Specifically, when the insertion of the cartridge 500 is completed, i.e., when the unseal sensor 703 is turned off ((3), FIG. 71), a main motor for driving the supply rollers 110 and 170 and agitator 103 of the developing device 386 is energized. On the elapse of a period of time necessary for the motor to rise, an agent collecting clutch is coupled ((3), FIG. 73). As a result, the agent collecting screw 115 is rotated to collect all the developer existing in the cleaning device 130 in the agent collecting tank 117 via the tubing 116. After the screw 115 has been rotated for 30 seconds, long enough to collect the agent, the clutch is uncoupled to stop the rotation of the screw 115. At the same time, the recycle screw 113 being used to recycle the toner is reversed to convey the developer from the developing unit 100 to the cleaning device 130 ((4), FIG. 73). After the screw 113 has been reversed for 120 seconds, long enough to transfer about one half of the agent to the cleaning device 130, a recycle motor is deenergized to stop the rotation of the screw 113. At the same time, the developer supply roller 107 is rotated (t3=30 seconds) ((5), FIG. 73) to supply all the agent existing in the agent hopper 101*b* to the developing unit 100. When both the agent supply clutch and the toner supply clutch are uncoupled, the main motor is deenergized to end the replacement.

The developing unit 100 and cleaning unit 130 use the same agent. In the illustrative embodiment, the cleaning device 130 and the developing unit 100 accommodate 150 grams of agent and 300 grams of agent, respectively. Specifically, there is repeated a sequence of steps of discarding 150 grams of agent from the cleaning device 130 to the agent collecting tank 117, transferring about 150 grams of agent being used from the developing unit 100 to the cleaning device 130, and adding 150 grams of fresh developer from the cartridge 500 to the developing unit 100. It has been customary to locate the recycle screw 113 at a high level in the developing unit 100 so as to drop the recycled toner onto the agent existing on the bottom of the unit 100. By contrast, the embodiment disposes the recycle screw 113 at a low level in the developing unit 100 and introduces the recycled toner into the agent in order to transfer the agent from the unit 100 to the cleaning device 130 by the reversal of the recycle screw 113. The developing unit 100 accommodates a twice greater amount of agent than the cleaning device 130, as stated above. Such a ratio is successful in reducing the deterioration of the agent in the developing unit 100 and dealing with a high-speed developing system. Specifically, the amount of agent ready to effect development should be increased with the increase in developing speed. While the cleaning device 130 may also accommodate 300 grams of agent, the embodiment assigns 150 grams of agent thereto for a space saving purpose.

Figure 36:
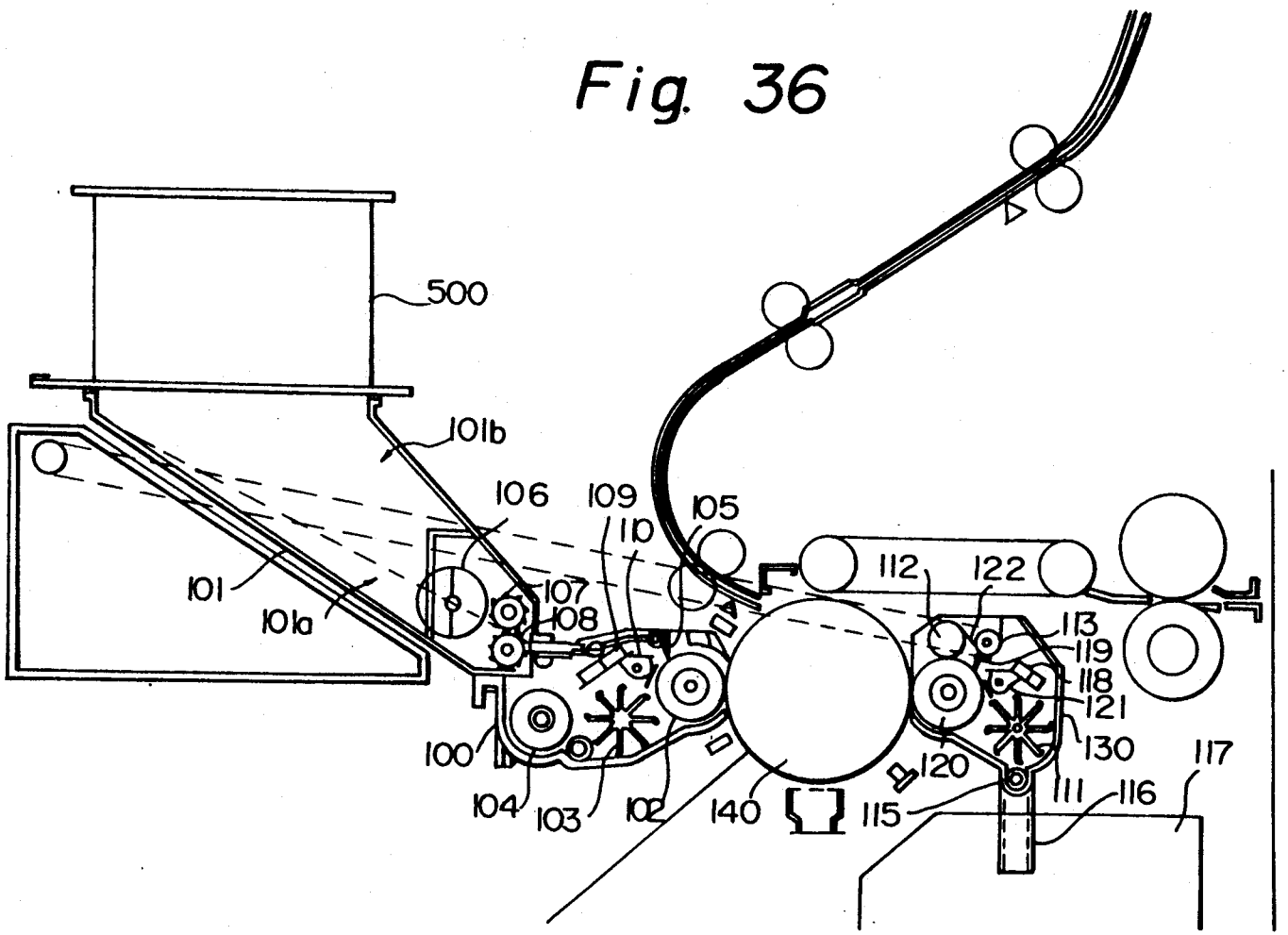
FIG. 36 shows a photoconductive element and associated parts included in a toner non-recycle type digital copier.
Figure 37:
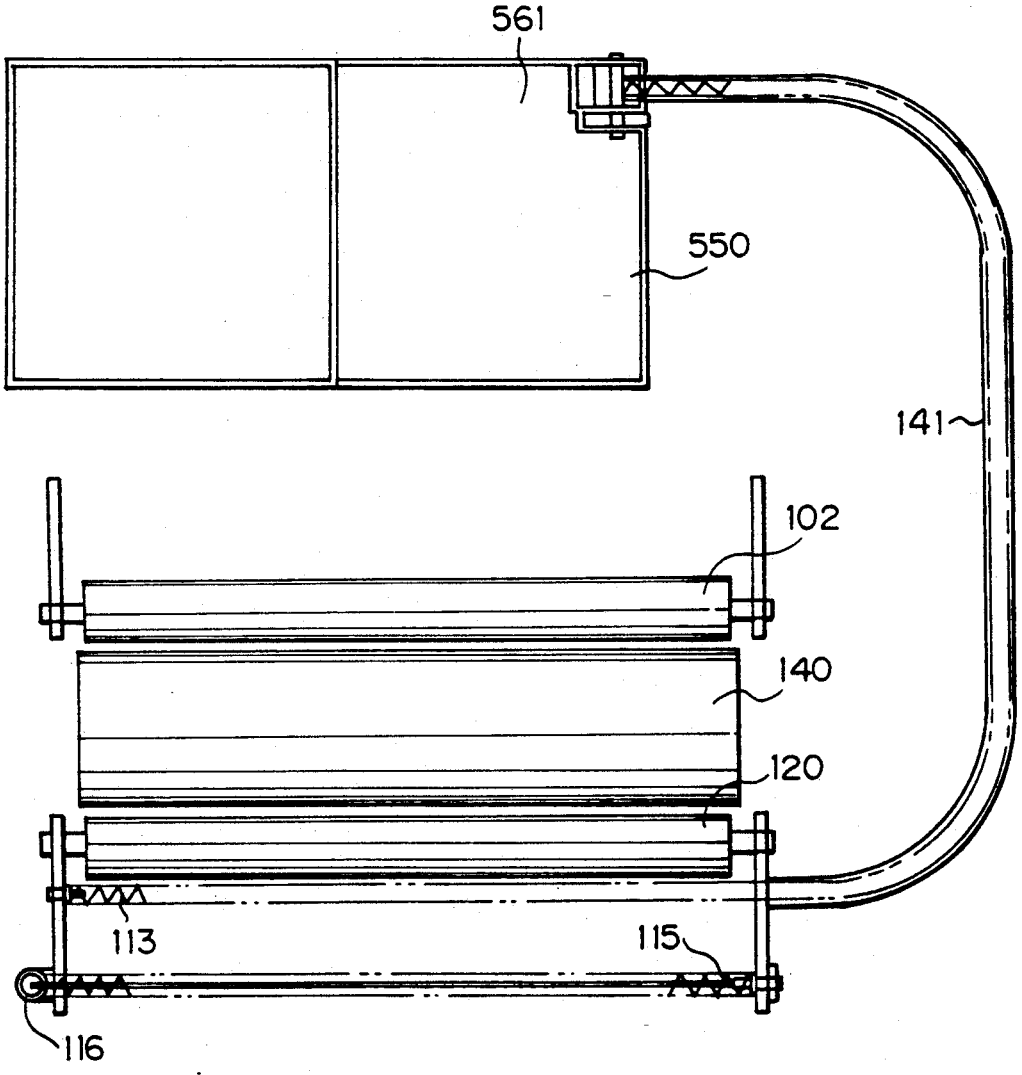
FIG. 37 is a plan view of a developer transport mechanism included in the toner non-recycle type copier.
Figure 87:
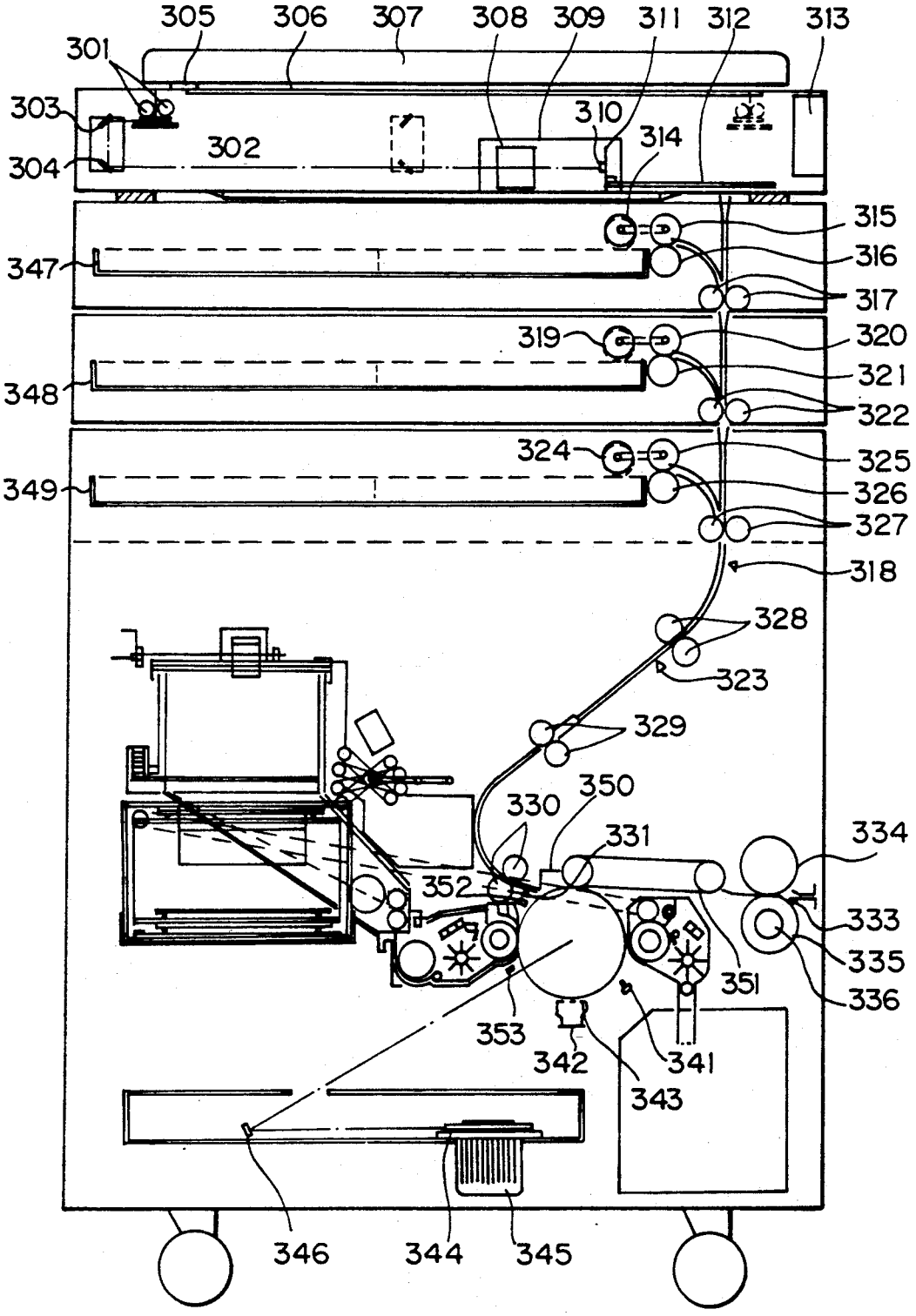
FIG. 87 is a front view of a toner non-recycle type digital copier.
Figure 88:
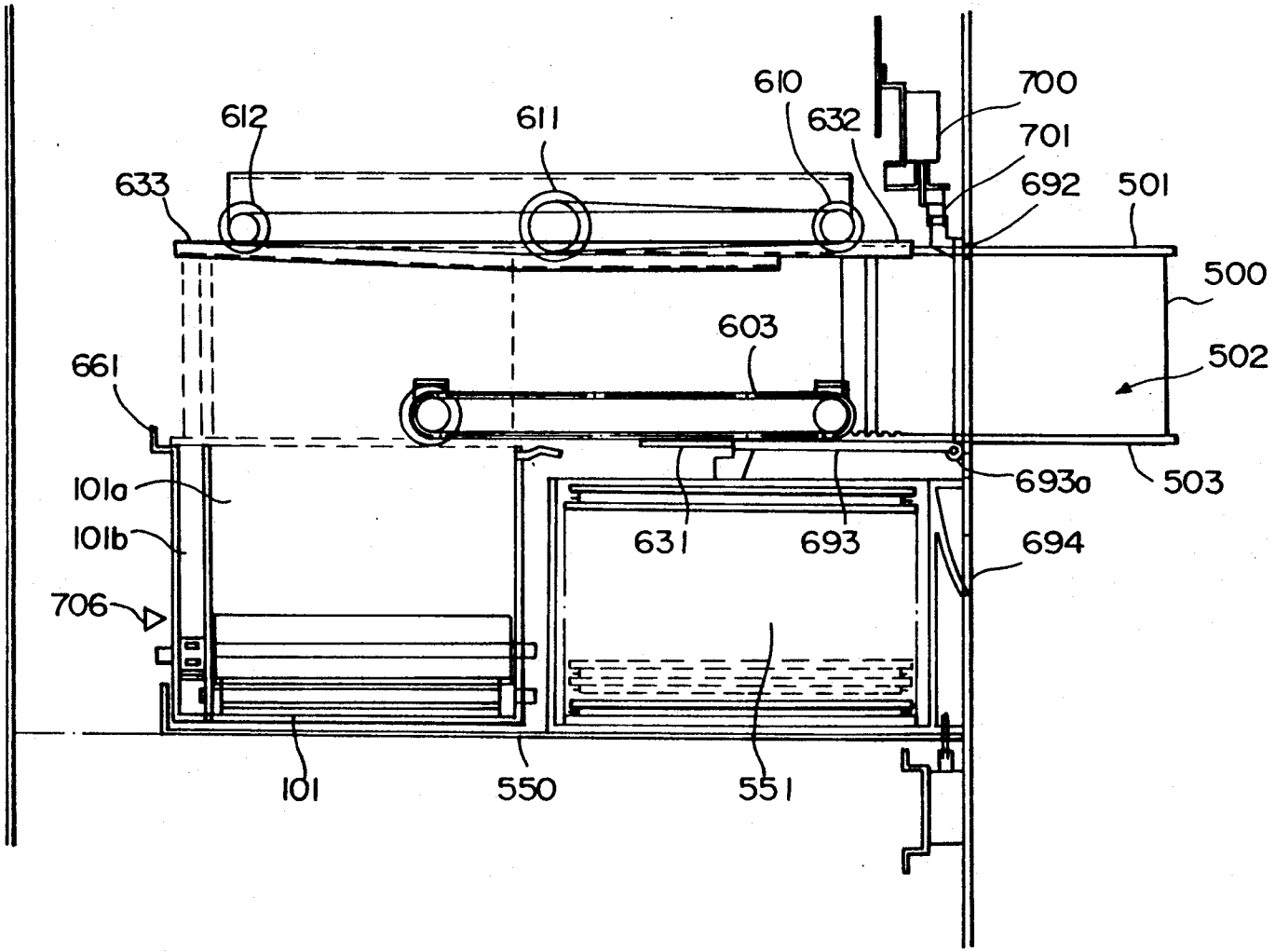
FIG. 88 is a side elevation as viewed from the left, showing a toner supply mechanism included in the copier of FIG. 35.
Figure 89:
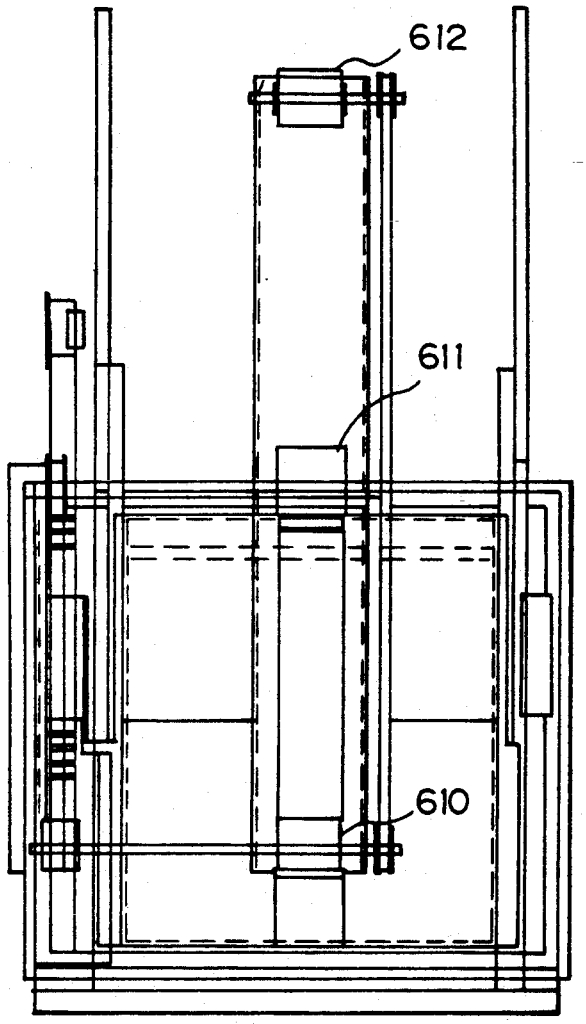
FIG. 89 is a plan view of the mechanism of FIG. 88.

The automatic replacement of the agent particular to the embodiment is as follows. The automatic replacement is practicable with a copier of the type using the box 550, FIG. 60, having the cartridge collecting section 551 and waste toner collecting section 561. Hence, the procedure will be described with reference to FIGS. 36 and 37 showing a mechanism for automatic replacement practicable with a copier shown in FIG. 87 which is a specific form of the above-mentioned type of copier.

The agent replacement system which will be described belongs to the previously stated pattern F. The toner collected by the cleaning device 130 is transferred to the waste toner collecting section 561 via the tubing 141 for toner collection. Since the waste toner collecting section 561 forms part of the box 550, the toner collected in this section 561 is not reused and is discarded together with the box 550, as will be described later specifically. The automatic agent replacing system is substantially similar to the toner recycling system described above, except for the method of transferring the agent from the developing unit 100 to the cleaning device 130. Specifically, the embodiment transfers the carrier from the developing unit 100 to the cleaning device 130 by the drum 140 and then collects it by the magnet roller 120 of the cleaning device 130, instead of transferring the agent to the cleaning device 130 by the reversal of the recycle screw 113. The agent, like the toner, is caused to deposit on the drum 140 by the potential of the drum 140 and the control over the bias of the magnet roller 102. At this instant, the potential of the drum 140 and the bias of the magnet roller 102 are 0 V and about −400V, respectively. To promote easy collection of the agent in the cleaning device 130, positive DC may be applied at the image transfer stage (350). Such an effect is also achievable with pretransfer charging (PTC). A bias of about +400 V is applied to the cleaning device 130. Causing the drum 140 to transport the agent as stated above is successful in omitting tubings and other mechanical components and, therefore, in reducing the cost.

After the cartridge 500 has been positioned in the apparatus body, the agent and toner are supplied from the hopper 101 to the developing unit 100, as follows. The agent and toner are supplied in essentially the same manner as described with reference to FIG. 73. Specifically, when the insertion of the cartridge 500 is completed, i.e., when the unseal sensor 703 is turned off ((3), FIG. 71), the main motor for driving the supply rollers 110, 107 and 108 and agitator 103 included in the developing device 386 are turned on. On the elapse of a period of time necessary for the motor to rise, the agent collecting clutch is coupled to collect the agent existing in the cleaning device 130. When the collection is completed, the agent collecting clutch is uncoupled. At the same time, this embodiment causes the agent to deposit on the drum 140 on the basis of the 0 V potential of the drum 140 and the −400 V bias of the magnet roller, thereby transporting it to the cleaning device 130. As soon as the transport of the agent to the cleaning device 130 compelets, the agent supply clutch is coupled to supply the agent to the developing unit 100. At the same time, the toner supply clutch is coupled to supply the toner to the developing unit 100 ((5), FIG. 71). When both the agent supply clutch and the toner clutch are uncoupled, the main motor is deenergized.

When the agent supply roller 107 and toner supply roller 108 are so configured as to supply the agent and toner over the same period of time, the agent supply clutch and toner supply clutch may be implemented as a single clutch. If desired, the agent supply clutch and toner supply clutch may be operated intermittently, as indicated by phantom lines in FIG. 73. Then, the agent and toner will be smoothly agitated in the axial direction of the magnet roller 102. This alternative scheme, however, will delay the end of supply. The agent supply roller 107 and toner supply roller 108 may each be implemented as a shutter, in which case the duration $t_3$ of the coupled state of the agent supply and the duration $t_2$ of cleaning agent supply (reversal of recycle motor) will be reduced and the agent will be supplied in a standby state after a predetermined number of copying cycles. When the agent is fed to the cleaning device 130 without the intermediary of the developing device 100, $t_2$ in FIG. 73 will be zero and the agent will be fed to the device 130 at the timing (5). In this case, too, the reversal of the recycle motor is not necessary. During or after the sequence of steps described above, flags representative of the various states are set or reset (ONE or ZERO) in the non-volatile RAM for the previously stated purpose.

Control which allows an image reading operation to be effected while the replacement of the developer is under way will be described. It has been customary with a digital image forming apparatus to inhibit all the image forming operations while the replacement is under way, reducing the productivity. To improve the productivity, the embodiment allows an image reading operation which does not need the recording section arranged around the drum 140 and including the developing device 386 and cleaning device 130 to be effected even when the replacement of the developer is in progress.

Figure 77A:
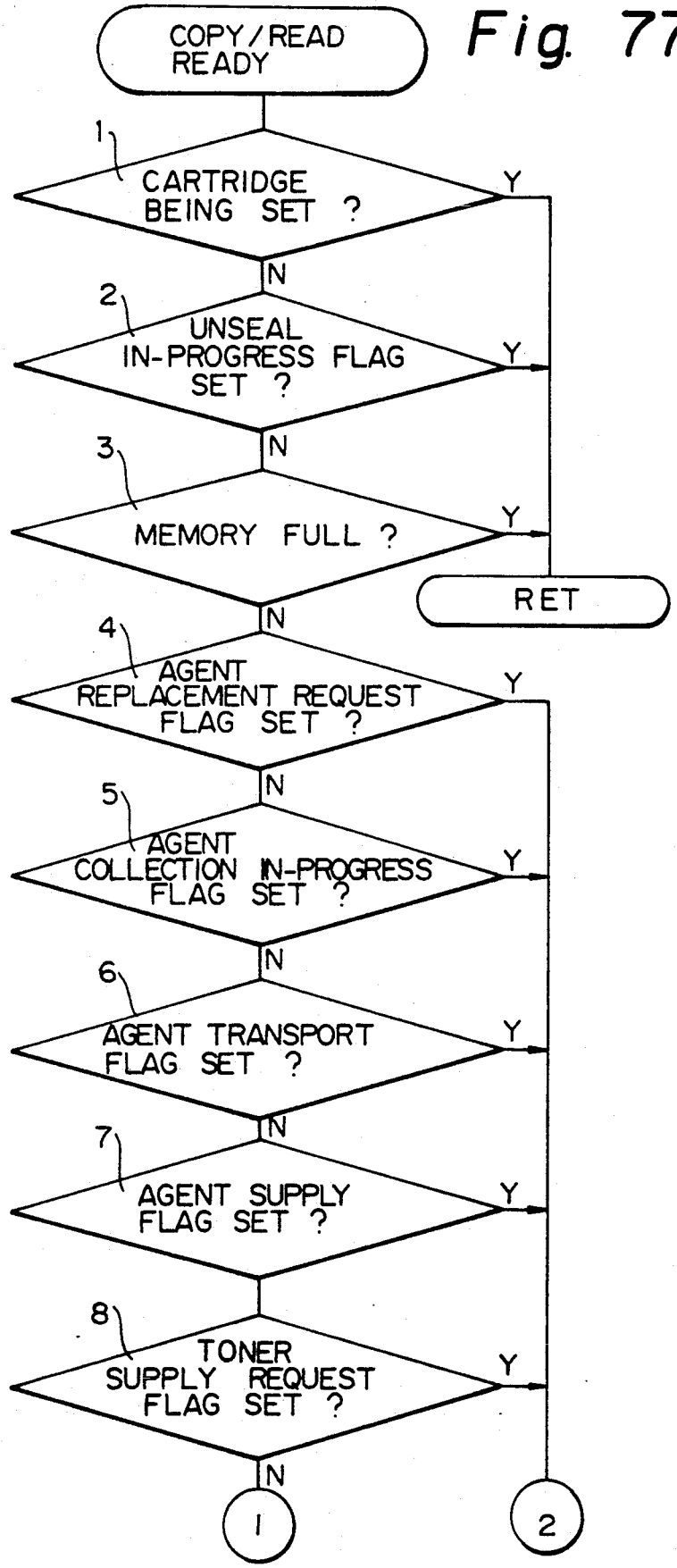
FIGS. 77A and 77B are flowcharts demonstrating a subroutine for allowing a document to be read.
Figure 77B:
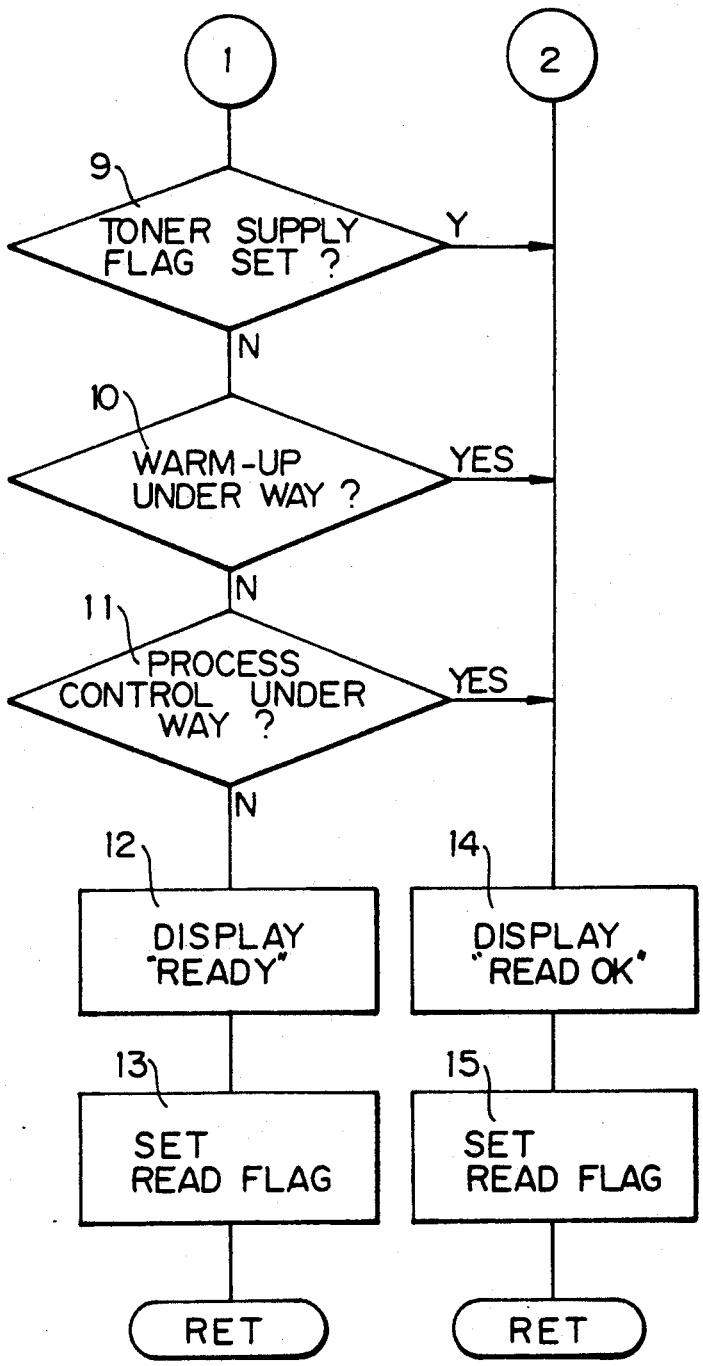
Figure 78:
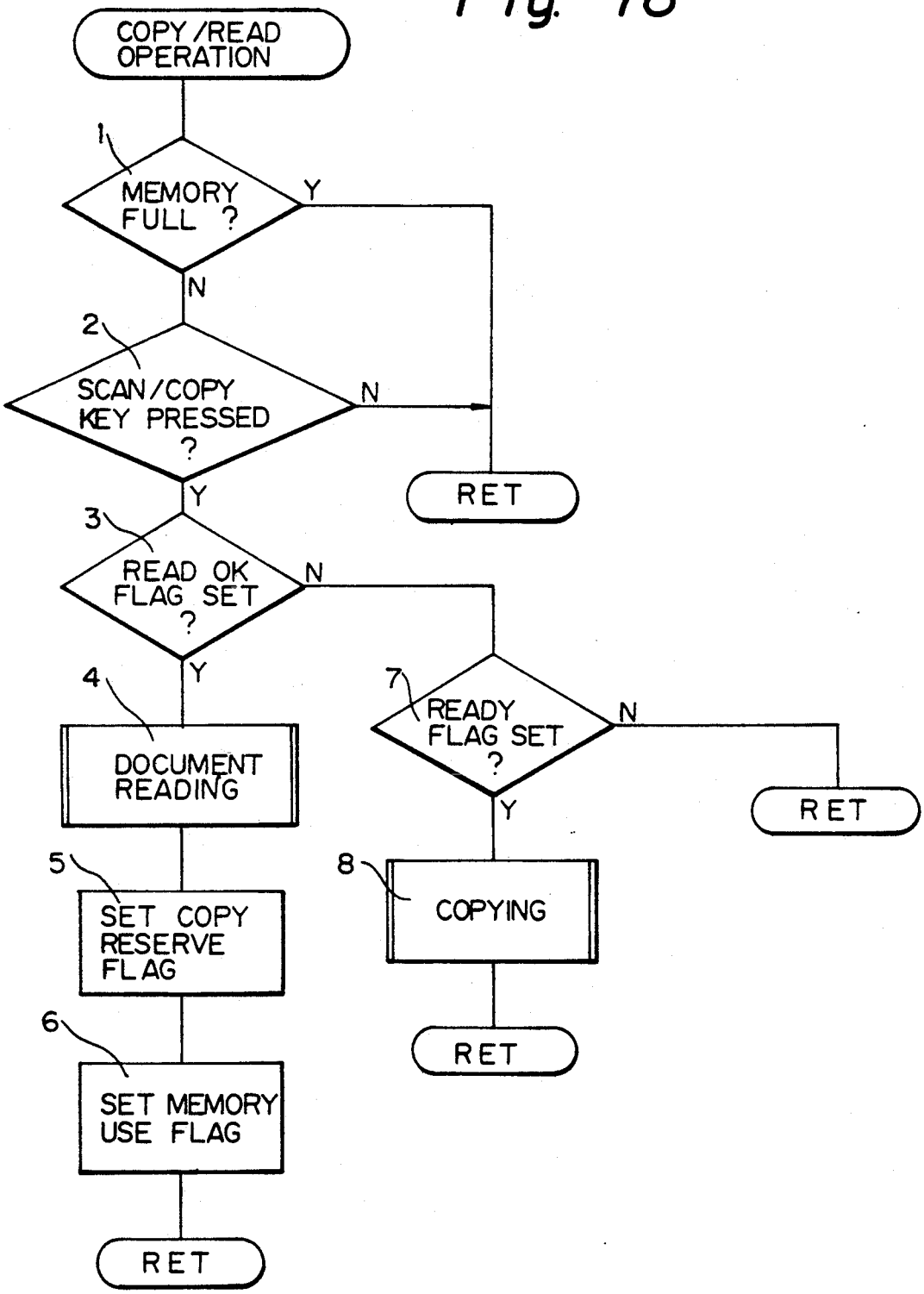
FIG. 78 is a flowchart showing another subroutine.

Specifically, as shown in FIGS. 77 and 78, whether or not the cartridge 500 is being set, whether or not an unseal in-progress flag is set, and whether or not the video memory is full are determined (steps 1-3). The unseal in-progress flag (step 2) is set when the seal 504 of the cartridge 500 is being removed. If the answer of any one of the steps 1-3 is positive, Y, the program returns to a main routine. If all the answers are negative, NO, steps 4-11 are executed to determined whether to accept a copy start command or to accept only a document read command, depending on whether or not the recording section is usable. Specifically, the program checks an agent replacement request flag which remains set from the end of unsealing to the start of agent collection (step 4), an agent collection in-progress flag which is set during collection and reset at the start of transport to the cleaning device 130 (step 5), an agent transport flag which is set during transport from the developing unit 100 to the cleaning unit 130 and reset on the start of supply (step 6), an agent supply flag remaining set during supply after the transport (step 7), a toner supply request flag set at the end of unsealing and reset at the beginning of supply after the transport of the agent (step 8), and a toner supply flag remaining set from the beginning of toner supply to the end of the same after the transport of the agent (step 9). If even one of such flags is set, meaning that the recording section is not usable, the step 14 is executed for displaying a message indicating that the apparatus can read a document. Then, in a step 15, a read OK flag is set. If none of the flags is set as determined in the steps 4-9, whether or not a warm-up operation for fixation is under way and whether or not process control is under way are determined. (seps 10 and 11). If the answer of the step 10 or 11 is Y, meaning that the recording section is not usable, the steps 14 and 15 are executed again. If the answer of the step 10 or 11 is N, meaning that the recording section is usable, a message indicating that the apparatus is ready to operate is displayed (step 12) and a ready flag is set (step 13). Thereafter, the program awaits the operation of a scan/copy key by executing a subroutine shown in FIG. 78.

In FIG. 78, whether or not the video memory is full and whether or not the scan/copy key is pressed are determined (steps 1 and 2). The operation returns to the main routine until the scan/copy start key is pressed while the video memory is not full. When the scan/copy start key is pressed in such a condition, whether or not a read flag (see step 15, FIG. 77) is set is determined (step 3). If the answer of the step 3 is Y, meaning that the recording section is not usable, a document reading operation is effected (step 4), a copy reserve flag is set (step 5), and a memory use flag is set (step 6). The copy reserve flag is set when a document is read while the replacement of the agent is under way; 1-4 are sequentially set in matching relation to the number of documents. The memory use flag indicates which locations of page memories capable of accommodating four pages of document data of A4 size are occupied; flags assigned to memories 1-4 are selectively used. If the read OK flag is not set as determined in the step 3, whether or not the ready flag (see step 13, FIG. 77) is set (step 7) is determined. If the answer of the sep 7 is Y, meaning that the recording section is usable, a copying operation is executed (step 8); if otherwise, the program returns to the main flow.

As stated above, the embodiment includes control means which allows, under predetermined condition, documents to be read even when the replacement of the agent is under way. Hence, even during the replacement of the agent, i.e., when the recording section is not operable, a document reading operation is executed prior to the operation of the recording section or writing means. Such a procedure increases the productivity of an image forming apparatus.

Figure 38A:
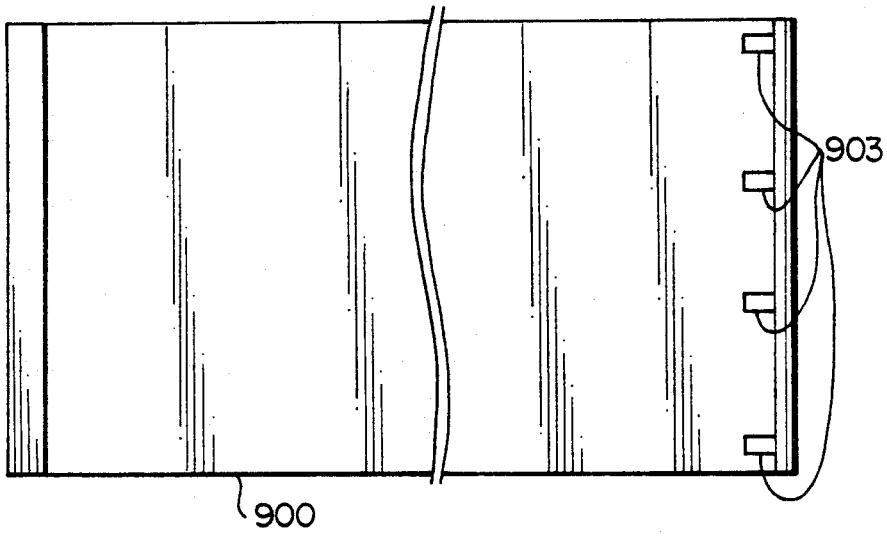
FIGS. 38A and 38B show a photoconductive sheet included in the copier of FIG. 1 in a plan view and a front view, respectively.
Figure 38B:
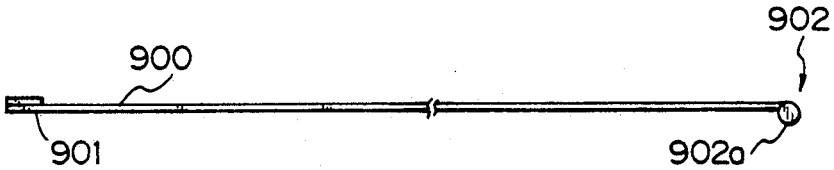
Figure 39:
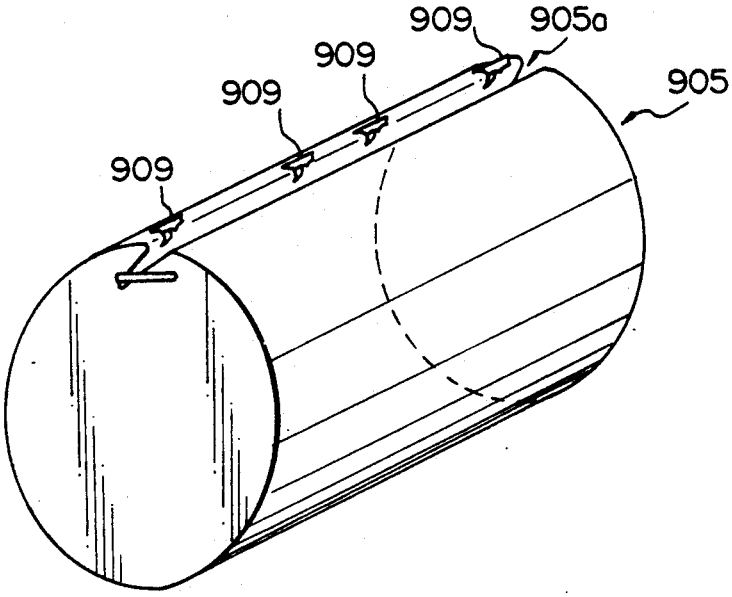
FIG. 39 is a perspective view of a hollow cylindrical support supporting the photoconductive sheet.

The photoconductive element or image carrier 140 is replaced by the following procedure. In the embodiment, the drum 140 is made up of a hollow cylindrical support 905 and a photoconductive sheet 900 wrapped round the support 905. The sheet 900 can be taken up or wrapped automatically. Specifically, as shown in FIGS. 38A and 38B, the sheet 900 is dimensioned slightly longer than the circumferential length of the support 905 (see FIG. 39) and has substantially the same width as the support 905. The leading edge 901 of the sheet 900 defines a reference position (wrap start position) for the sheet 900 to be wrapped round the support 905. Hence, the leading edge 901 is bent or otherwise treated to have a greater thickness than the other part of the sheet 900 to insure gripping and to prevent the sheet 900 from bending or curling. The trailing edge 902 of the sheet 900 with respect to the wrapping operation defines a reference position in the event of take-up operation and is, therefore, bent or otherwise treated in the same manner as the leading edge 901. However, the trailing edge 902 has an entirely different configuration from the leading edge 901, i.e., a shaft 902*a* is affixed to the trailing edge 902. Four notches are formed in the trailing edge 902 and cooperate with the shaft 902*a* to promote sure and easy wrapping operation of the sheet 900, as will be described.

Figure 40A:
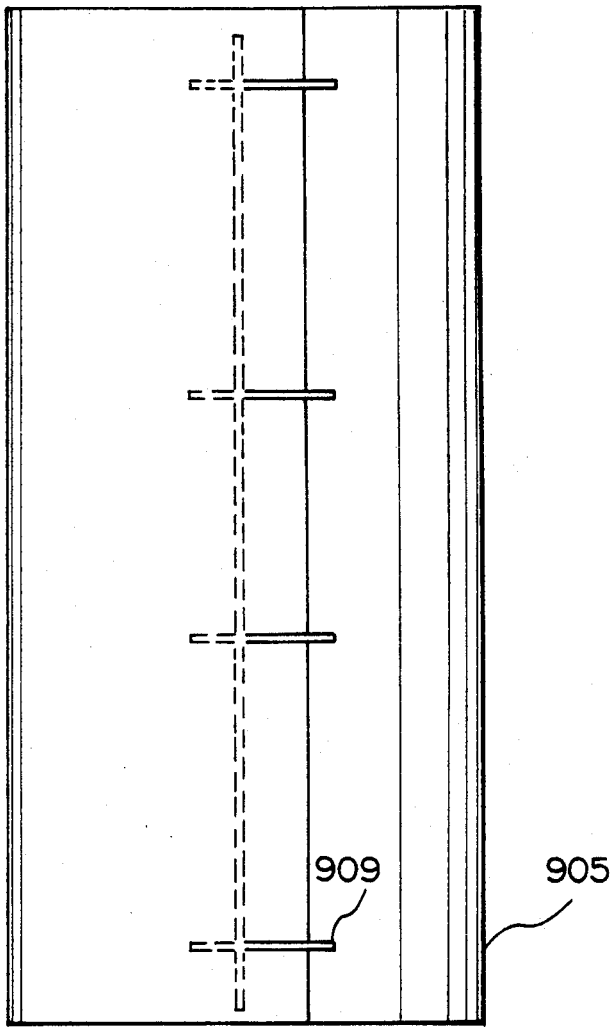
FIGS. 40A and 40B show the support in a plan view and a front view, respectively.
Figure 40B:
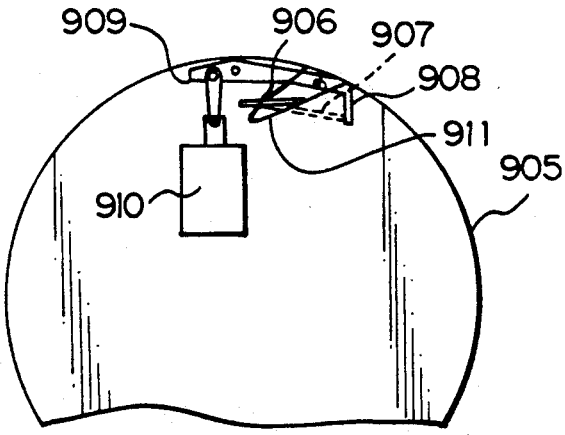
Figure 41:
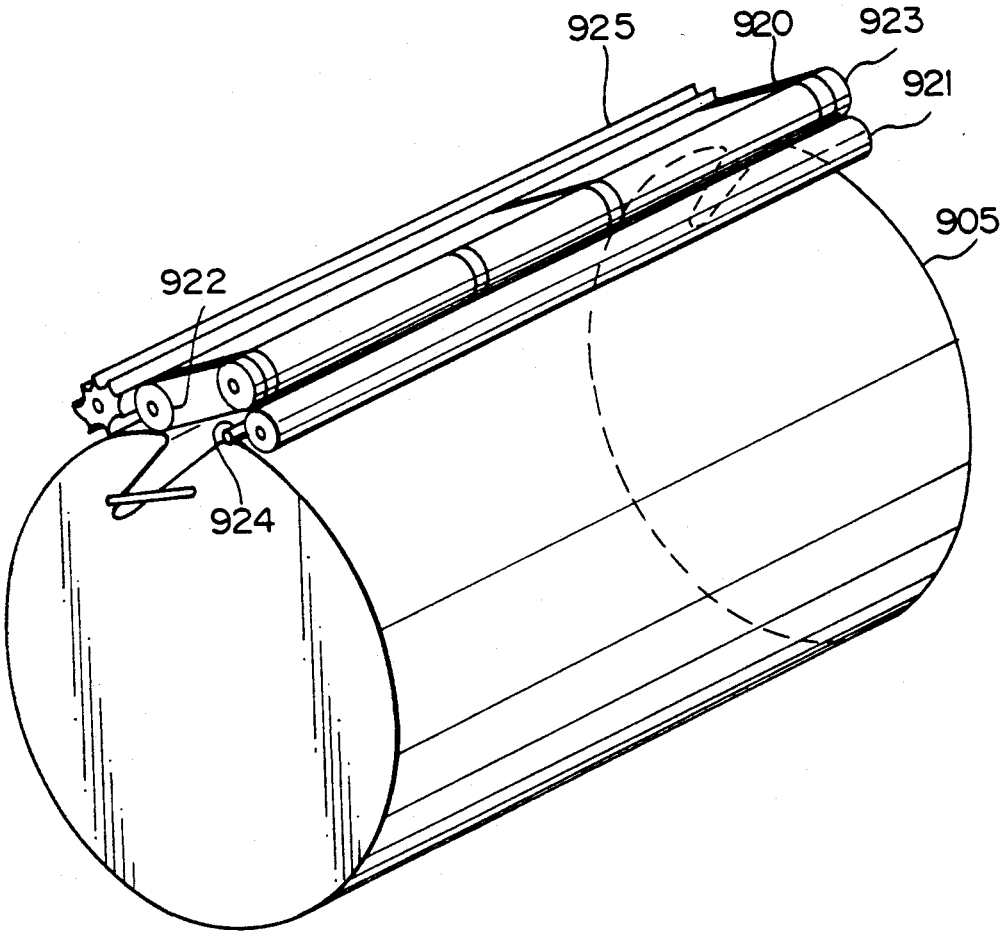
FIG. 41 is a perspective view showing a mechanism around the support.
Figure 42A:
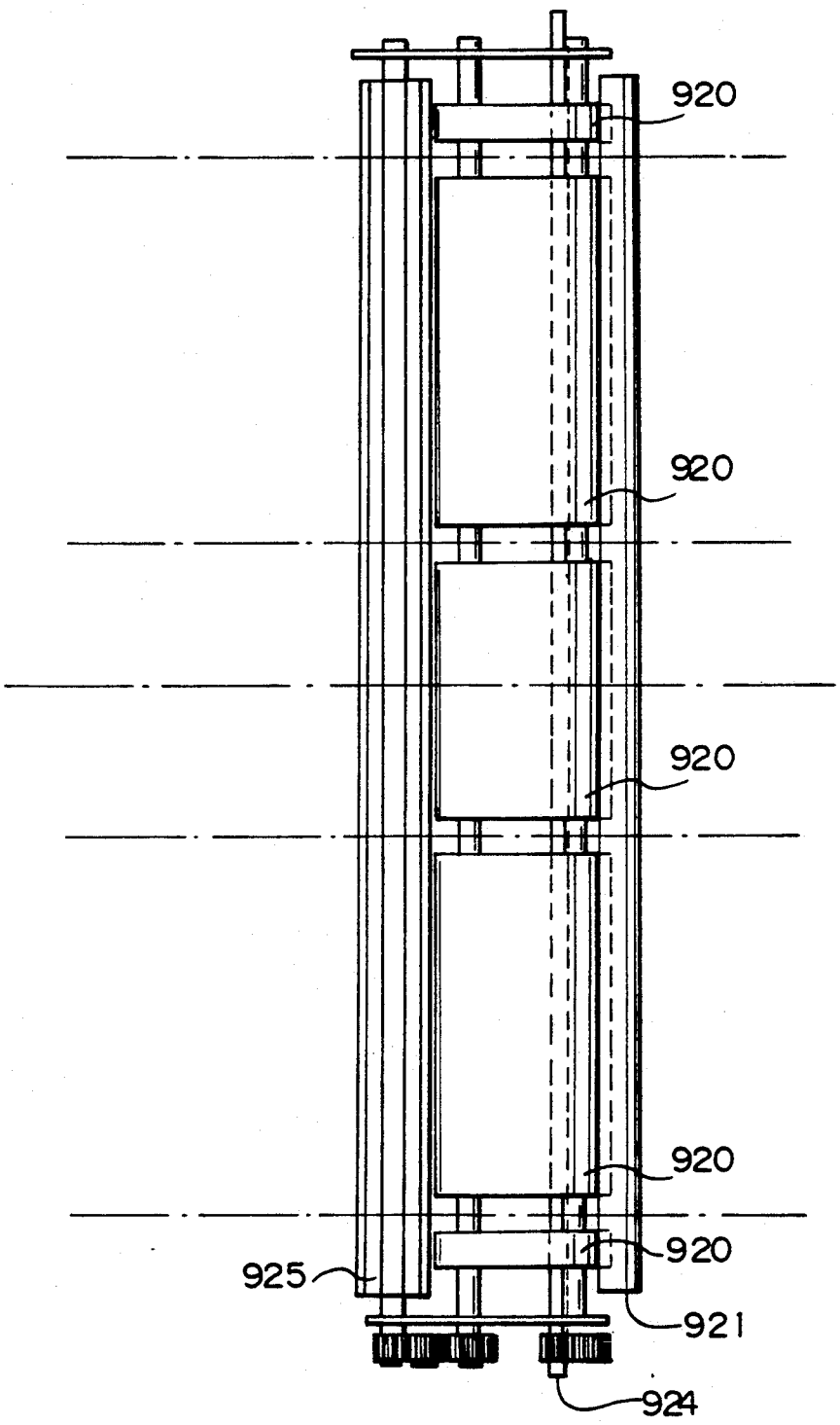
FIGS. 42A and 42B show the mechanism of FIG. 41 in a plan view and a front view, respectively.
Figure 42B:
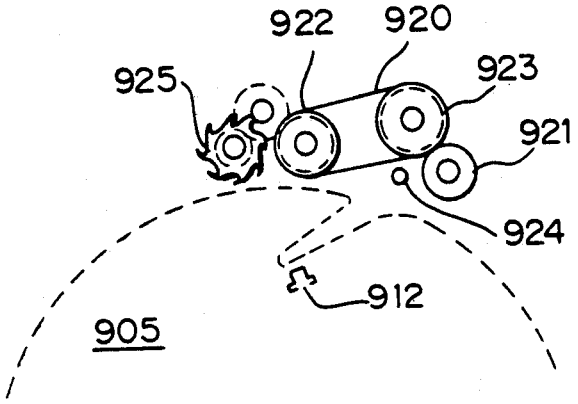
Figure 43:
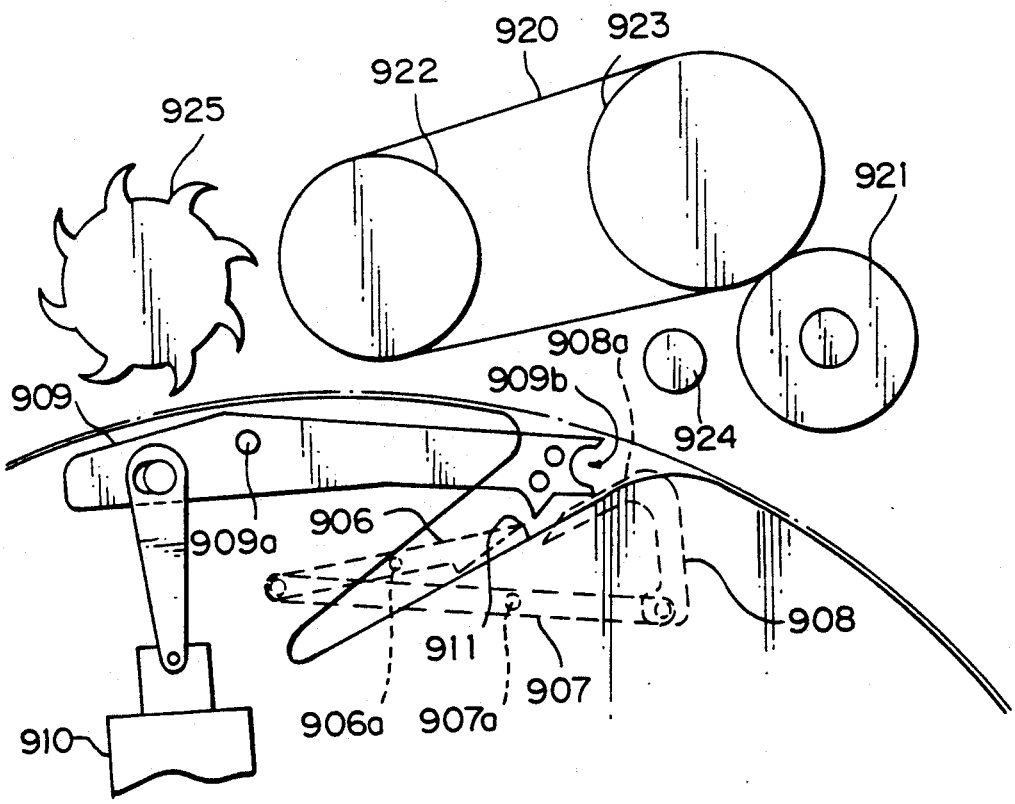
FIG. 43 is an enlarged front view of the mechanism of FIG. 41.
Figure 44:
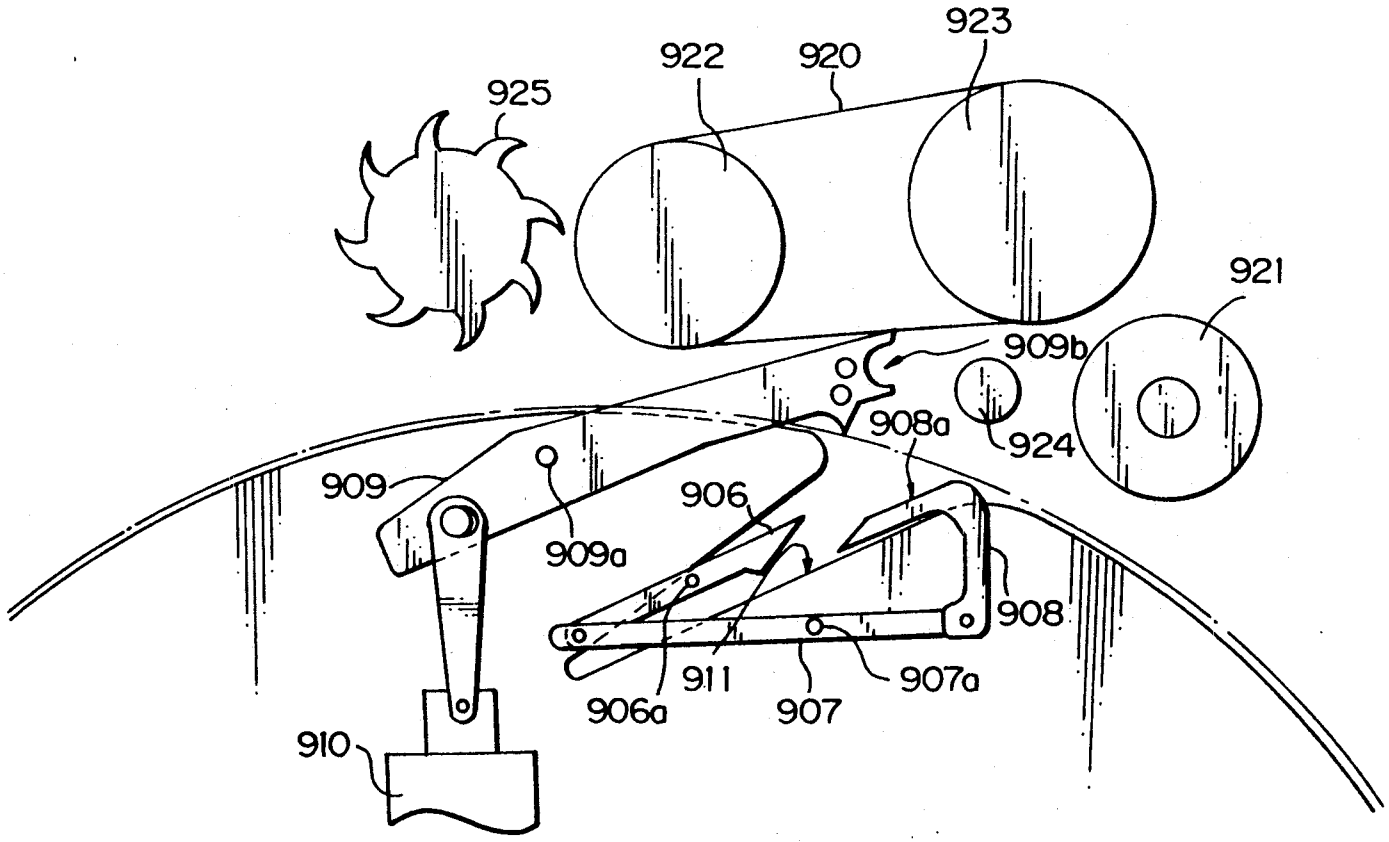
FIG. 44 is an enlarged front showing the mechanism of FIG. 41 in a condition different from the condition shown in FIG. 43.
Figure 45:
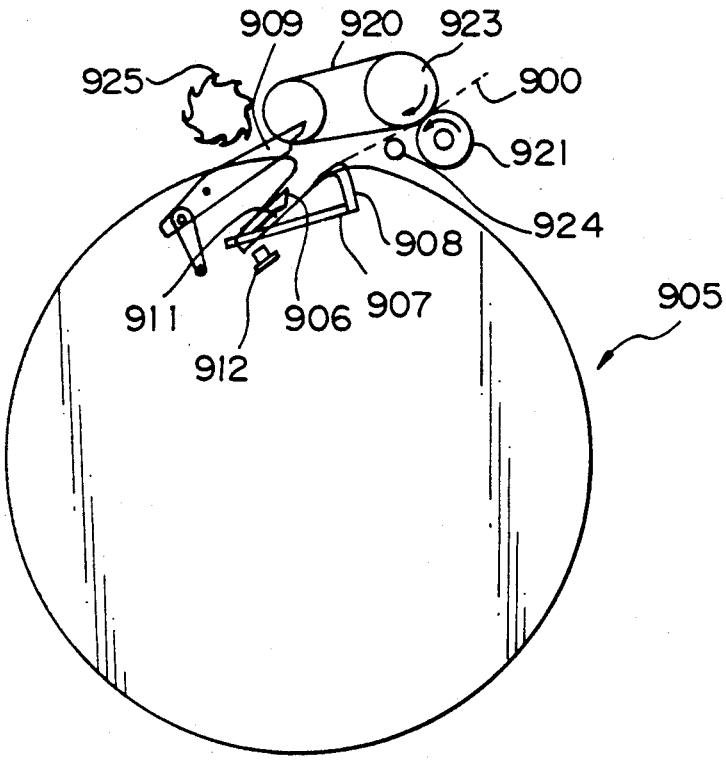
FIGS. 45–51 are front views showing the support and parts cooperative therewith at different stages of operation for wrapping the sheet around the support.
Figure 46:
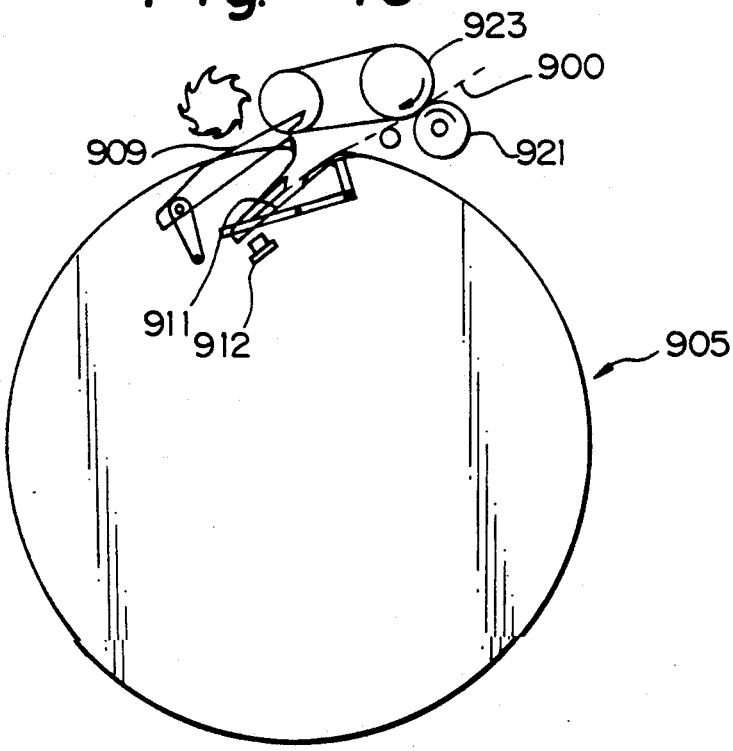
Figure 47:
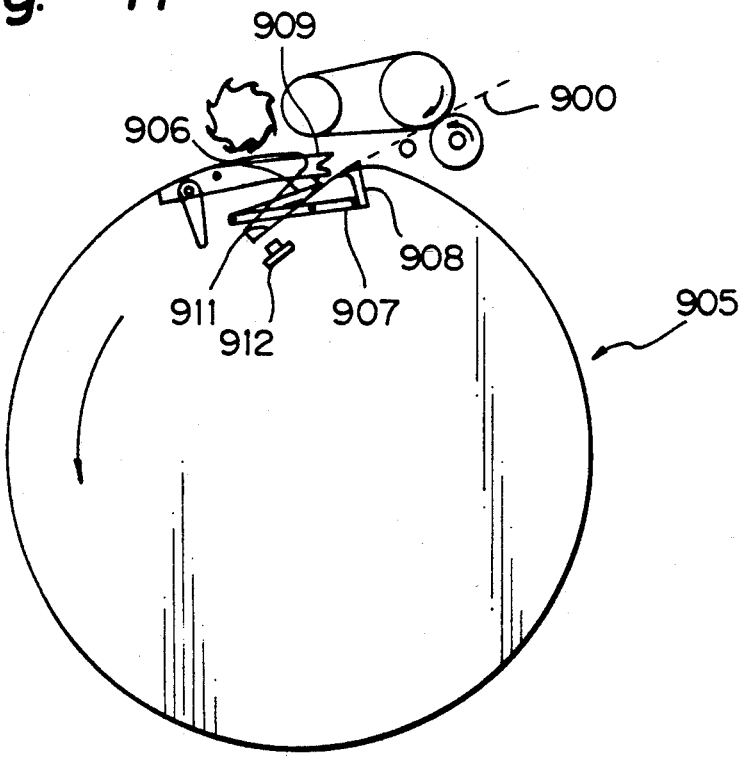

Referring to FIGS. 39, 40A, 40B, 43 and 44, the hollow cylindrical support 905 has a recess 905*a* for receiving the leading edge 901 and trailing edge 902 of the sheet 900. A wrap/take-up mechanism is disposed in the drum 905 in close proximity to the recess 905*a* and includes a pawl or stop 906 and a clamp lever 909. The stop 906 clamps the sheet 900 by pressing the leading edge 901 of the sheet 900 against a fixing portion 911 which is part of the walls of the recess 905*a*. The stop 906 is rotatably mounted on a stationary shaft 906*a* and operatively connected to a stop guide 908 by an arm 907. The arm 907 is also rotatably mounted on a stationary shaft 907*a*. Hence, when the exposed surface 908*a* of the stop guide 907 is pressed by the end of the clamp lever 909, the arm and stop 906 rotate clockwise about the respective shafts 907*a* and 906*a*. As a result, the end of the stop 906 sequentially reduces the gap between it and the fixing portion 911 to thereby clamp the sheet 900. The clamp lever 909 is rotatably mounted on a stationary shaft 909*a* and formed with a notch 909*b* at the end thereof which is capable of receiving the shaft 902*a* of the sheet 900. A clamp solenoid 910 is drivably connected to the clamp lever 909. In the illustrative embodiment, four clamp levers 909 are mounted on the support 905, as shown in FIG. 40A. A spring, not shown, constantly biases the clamp lever 909 such that they protrude from the surface of the support 905 when the clamp solenoid 910 is energized or retract into the support 905 when the solenoid 910 is deenergized.

Figure 52:
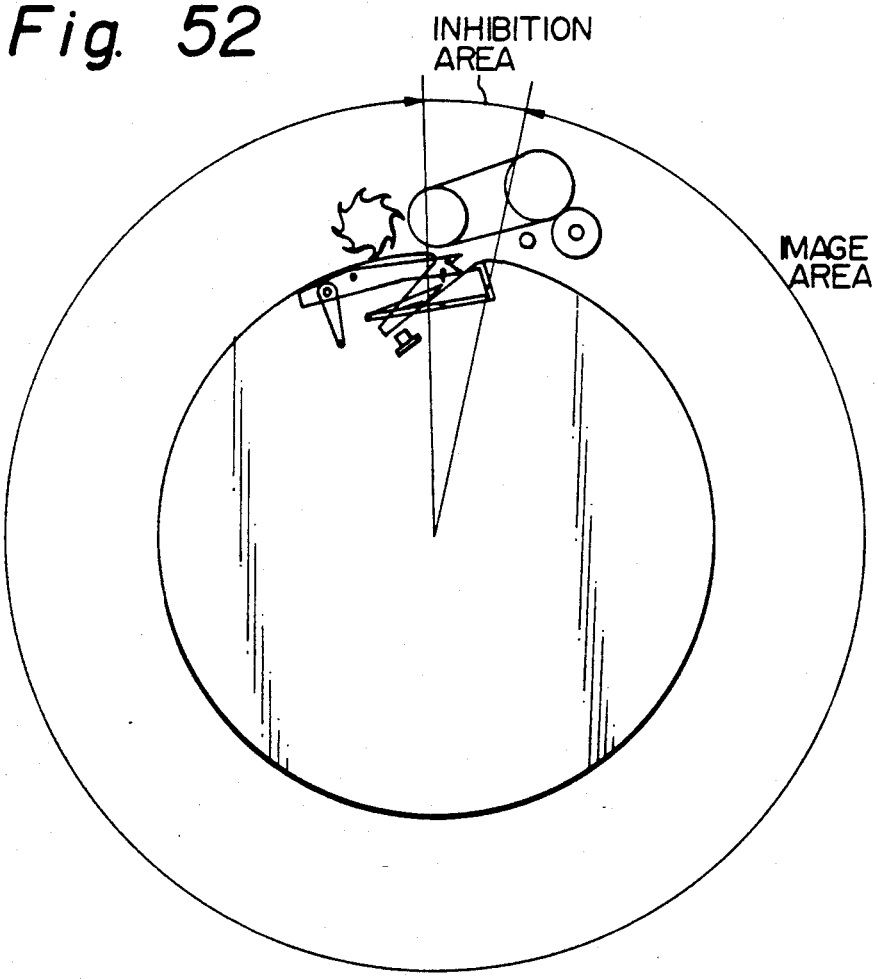
FIG. 52 shows an image area on the support.

As shown in FIG. 52, the recess 905*a* of the drum 905 forms a seam on the drum 140 where an image cannot be formed. It is, therefore, necessary to determined the position of the recess 905*a* while the cyldindrical support 140 is in rotation in order to control the image forming sequence. To meet this demand, a seam sensor, not shown, is provided which is responsive to the recess 905*a*. The output of the seam sensor is also used in the event of control over the wrapping and peeling operations of the sheet 900, as will be described.

As shown in FIGS. 41, 42A, 42B, 43 and 44, a pay-out section has three kinds of rollers 921, 922 and 923 and a single guide load 924. The first guide roller 921 is a driven roller extending over the entire length of the drum 905. Bearings supporting the guide roller 921 are biased by springs and movable to bring the roller 921 into and out of contact with the third guide roller 923. Specifically, the guide roller 921 is movable over a distance of 3 mm toward and away from the guide roller 923 which is substantially the same as the diameter of the shaft 902*a* which is affixed to the sheet 900 (see FIGS. 41, 42A and 42B). A driving force is transmitted from the apparatus body to the third guide roller 923 and then to the second guide roller 922 by a guide belt 920. The second guide roller 922 imparts the rotation thereof to a take-up roller 925 by increasing the rotation speed. The guide rollers 922 an 923 and take-up roller 925 have their shafts affixed to a common bracket which is rotatable about the shaft of the guide roller 923. The guide belt 920 and guide rollers 922 and 923 are each segmented in the axial direction of the support 905, so that the ends of the clamp levers 909 may each intervene between nearby segments when protruded from the support 905. The take-up roller 925 is made of rubber and provided with axially extending teeth on the surface thereof. To take up or peel off the sheet 900, the take-up roller 925 removes the shaft 902 of the sheet 900 from the notches 909*b* of the clamp levers 909 with the teeth thereof. The linear speed of the guide rollers 921–923 is selected to be the same as the linear speed of the support 905 in the event of wrapping while the linear speed of the take-up roller 925 is selected to be lower than the latter.

Figure 74:
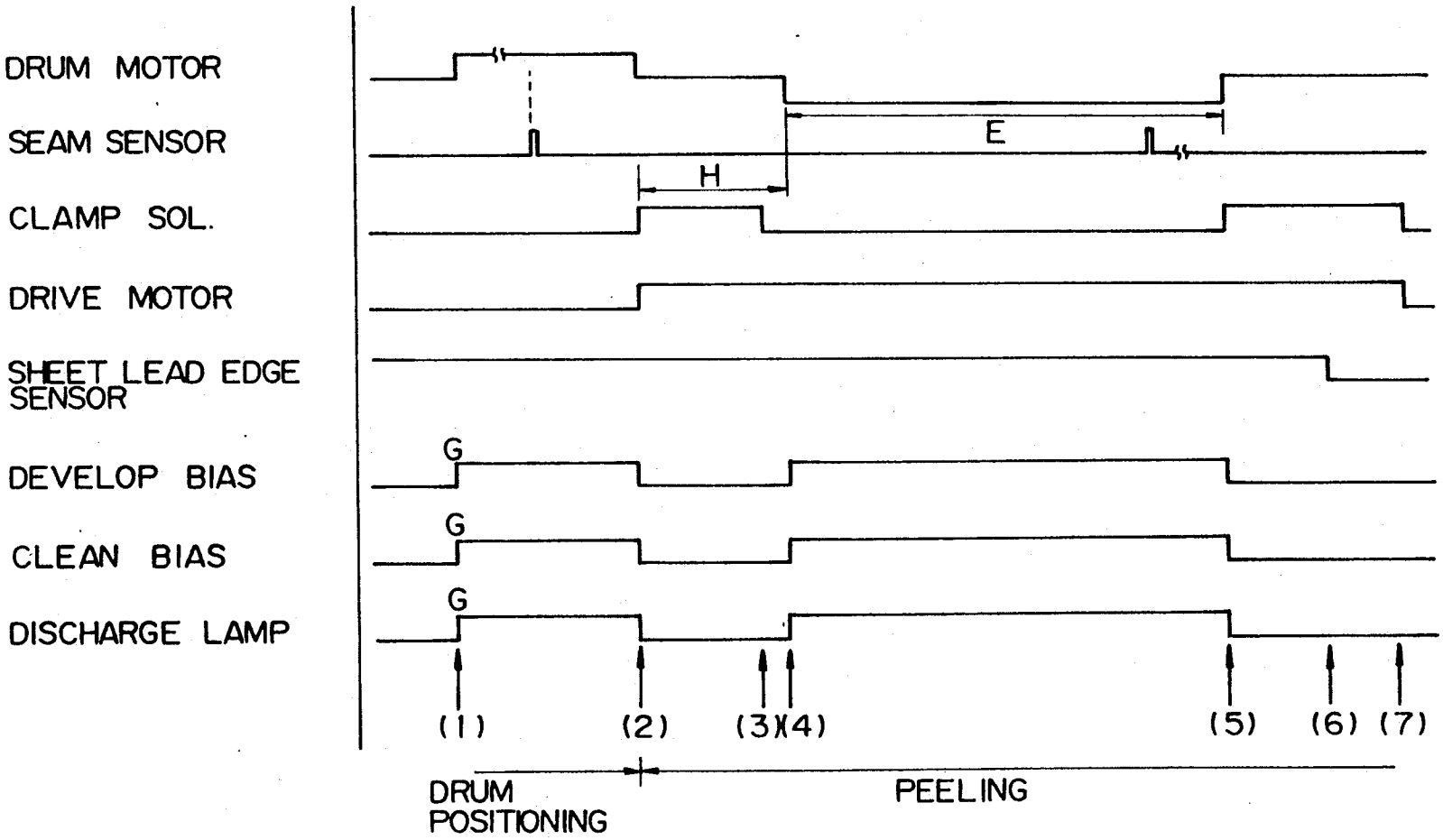
FIG. 74 is a timing chart representative of control to be executed by the copier of FIG. 1 in the event of peeling the photoconductive sheet.
Figure 75:
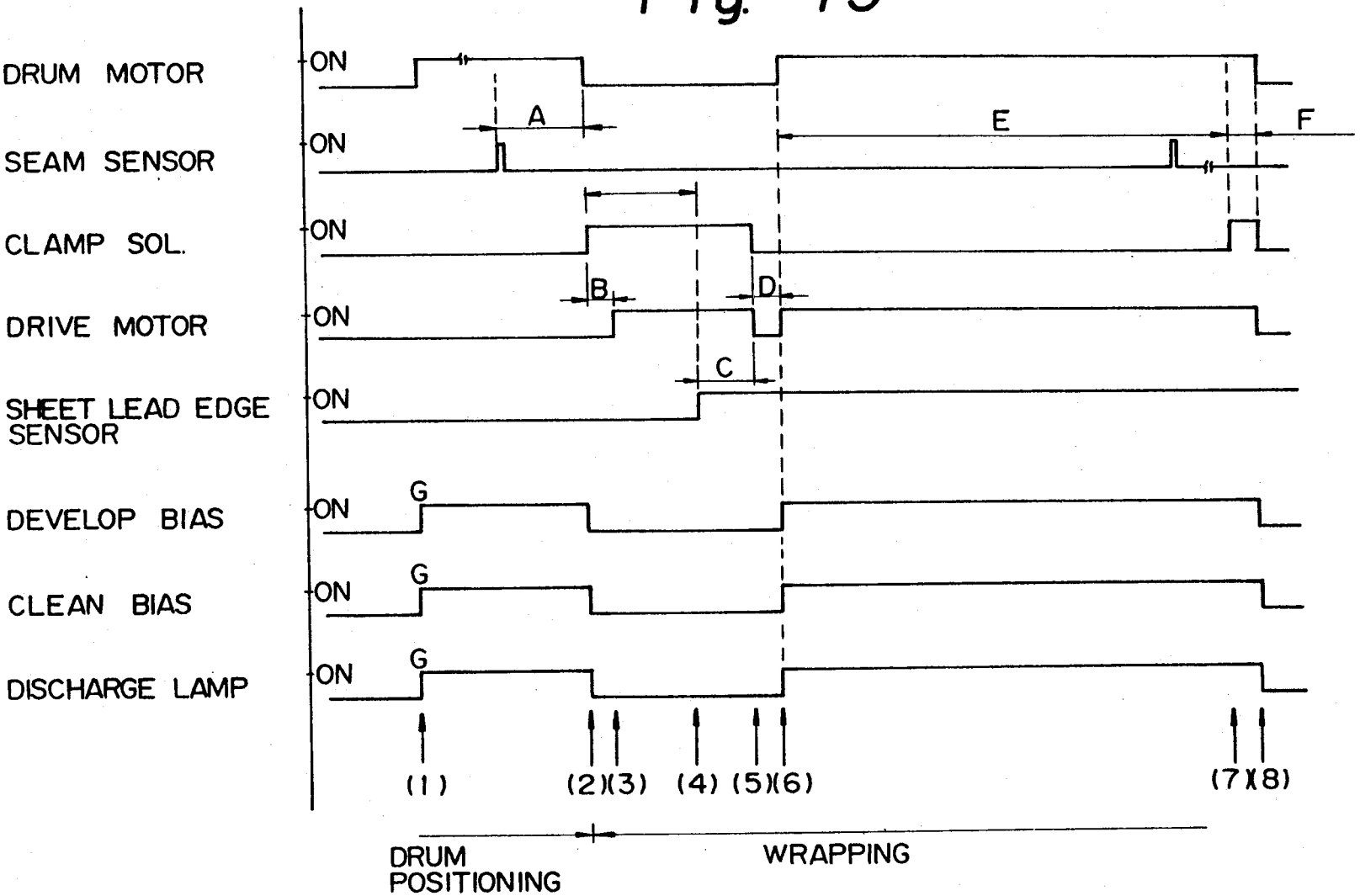
FIG. 75 is a timing chart representative of control to be executed by the copier of FIG. 1 in the event of wrapping the photoconductive sheet around the support.

A reference will be made to FIGS. 45–51 and 75 for describing a procedure for wrapping the sheet 900 round the cylindrical support 905. First, a drum motor is energized to start rotating the support 905 ((1), FIG. 75). The drum motor is deenergized when the fixing portion 911 of the support 905 is brought to a position where it faces the guide belt 920 ((2), FIG. 75), thereby positioning the support 905 at a wrap start position. At this instant, the seam of the drum sensed by the seam sensor is used as a reference. It is to be noted that the drum motor is deenergized a predetermined period of time A later than the rise of the output of the seam sensor, as shown in FIG. 75. Further, as shown in FIG. 74, the developing bias, cleaning bias and discharge lamp are turned on at the same time as the drum motor for the purpose of preventing the toner and agent from depositing on the support 905 during the wrapping operation, as will be described later specifically. While the support 905 is in a halt, the clamp solenoid 910 is energized to cause the clamp levers 909 to protrude from the surface of the support 905. In this condition, a drive motor for driving the first guide roller 921 and other rollers is turned on ((3), FIG. 75) to cause the guide rollers 921 and 923 to pay out the sheet 900. As a result, the leading edge 901 of the sheet 900 is inserted to between the fixing portion 911 of the support 905 and the end of the stop 906. It should be noted that a delay time B (see FIG. 75) is provided between the turn-on of the clamp solenoid 910 and the start of sheet pay-out in consideration of the delay time of the solenoid 910 (about 500 ms). The sheet 900 is continuously paid out until a sheet sensor 912 disposed in the support 905 senses the leading edge of the sheet 900. The sheet sensor 912 may be implemented by a reflection type or a transmission type photosensor.

Figure 48:
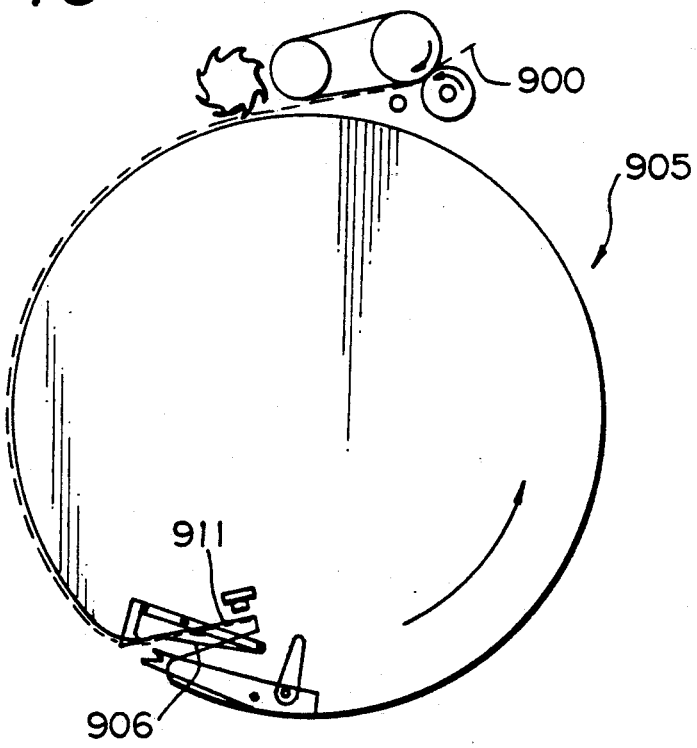
Figure 49:
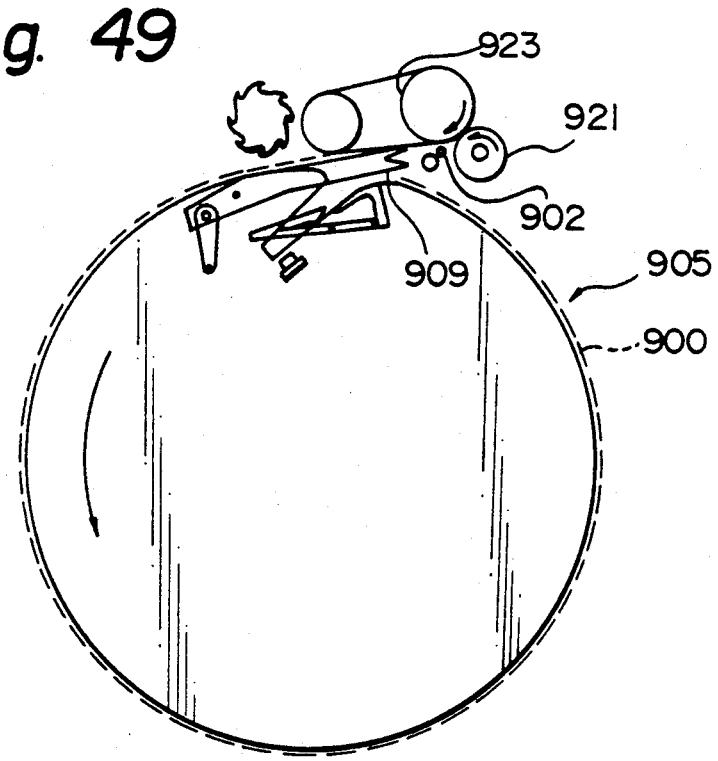
Figure 50:
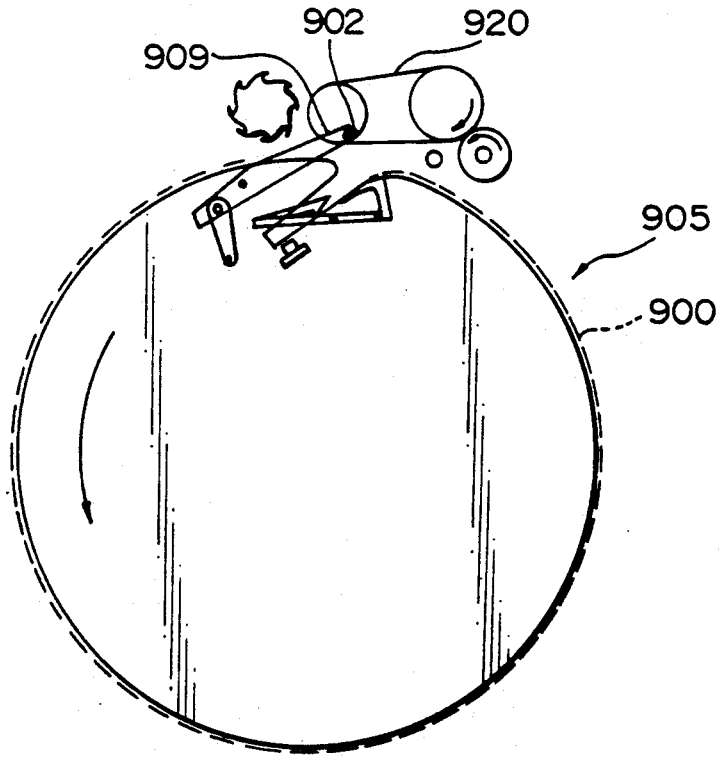
Figure 51:
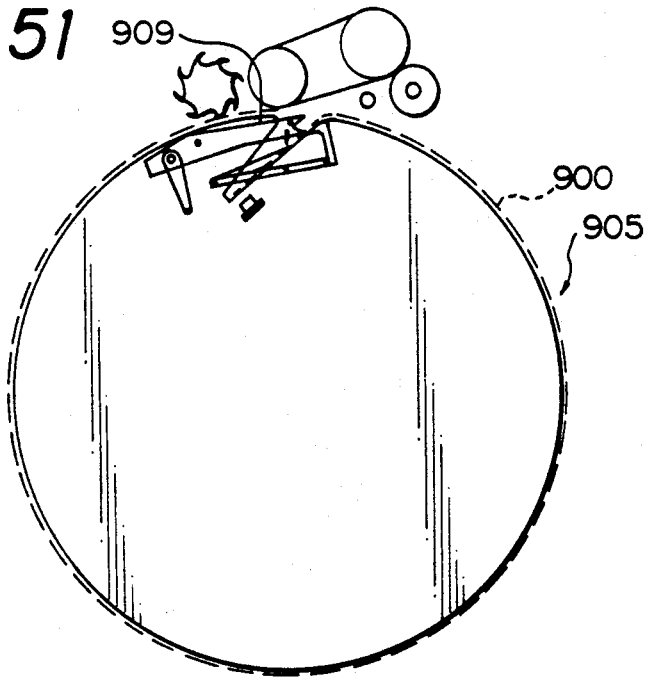

As soon as the sheet sensor 912 senses the leading edge of the sheet ((4), FIG. 75), the drive motor is turned off on the elapse of a predetermined period of time C. At the same time, the clamp solenoid 910 is turned off to pull the clamp levers 909 into the drum 905. The period of time C is long enough for the leading edge 901 of the sheet 900 to surely move deep into the fixing portion 911. The clamp levers 909 press the exposed surface 908*a* of the stop guide 908 via the sheet 900 due to the force of springs, not shown. As a result, the arm 907 connected to the stop guide 908 is rotated clockwise about the shaft 907*a*. Then, the stop 906 connected to the arm 907 is rotated clockwise about the shaft 906*a* with the end thereof approaching the fixing portion 911 (see FIG. 47). After the turn-off of the clamp solenoid 910, the drum motor and drive motor are again turned on on the elapse of a predetermined period of time (6), FIG. 75) to thereby rotate the support 905, as indicated by an arrow in the figure. Then, as shown in FIG. 48, the sheet 900 starts wrapping round the support 905 while further urging the stop guide 908 into the support 905. Consequently, the stop 906 further approaches the fixing section 911 to more surely clamp the sheet 900.

As the support 905 is further rotated, the shaft 902*a* fixed to the trailing edge 902 of the sheet is brought into contact with the position where the guide rollers 921 and 923 face each other. Then, the clamp solenoid 910 is energized to cause the clamp lever 909 to protrude from the support 905. The interval E (see FIG. 75) between the start of rotation of the drum 905 and the turn-on of the clamp solenoid 910 is the period of time necessary for the support 905 to complete one rotation and is counted by using the output of the seam sensor as a reference. As the drum is further rotated, the shaft 902*a* of the sheet 900 urges the guide roller 921 downward since the guide roller 921 is movable into and out of contact with the guide roller and since the sheet 900 is pulled due to the rotation of the support 905. As a result, the leading edge 902 of the sheet 900 moves away from the facing portions of the guide rollers 921 and 923 and brought to a position between the guide belt 920 and the guide load 924 (see FIG. 49). As the support 905 is further rotated, the shaft 902*a* of the sheet 900 advances while urging the guide belt 920 and guide roller 922 upward. Then, the ends of the clamp levers 909 having protruded to substantially the same level as the guide belt 920 enter the notches 903 of the sheet 900, and the shaft 902*a* enters the recesses 909*b* of the clamp levers (see FIG. 50). At this time, the clamp solenoid 910 is turned off ((8), FIG. 75) to retract the clamp levers 909 into the support 905. Consequently, the clamp levers 909 wrap the sheet 900 round the support 905 by pulling the sheet 900 (see FIG. 51). Here, the period of time F (see FIG. 75) during which the clamp solenoid 910 remains energized allows the support 905 to rotate until the ends of the clamp levers 909 enter the notches 903 of the sheet. In this manner, the sheet 900 can be wrapped round the support 905 without slackening.

Figure 53:
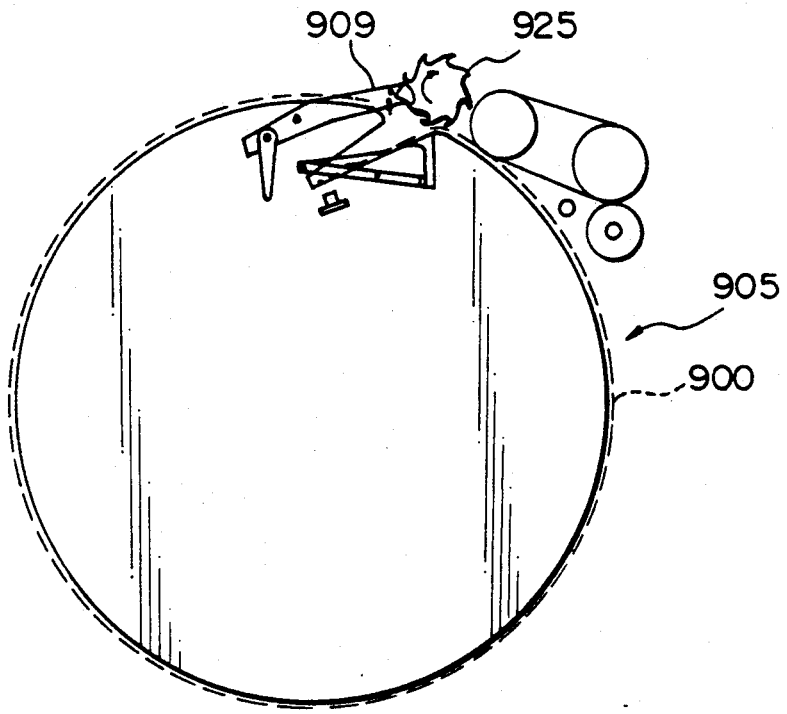
FIGS. 53–55 are front views showing the drum and associated parts at successive stages of operation for peeling the sheet from the support.

A procedure for removing the sheet 900 from the support 905 will be described with reference to FIGS. 53–55 and 74. First, the drum motor is energized to start rotating the support 905 ((1), FIG. 74). The drum motor is deenergized when the support 905 is rotated to a position where the ends of the clamp levers 909 face the tape-up roller 925 on the basis of the output of the seam sensor, as shown in FIG. 53 ((2), FIG. 2). As a result, the support 905 is located at a peel start position. Again, the developing bias, cleaning bias and discharge lamp are turned on while the drum motor is in an ON state for the same reason as during the wrapping operation. In this condition, the drive motor is energized to rotate the take-up roller 925 clockwise, and the clamp solenoid 910 is energized (see FIG. 53). As a result, the upper ends of the clamp levers 909 raise the notches 903 of the sheet 900 until the sheet 900 contacts the take-up roller 925. As the take-up roller 925 conveys the shaft 902*a* of the sheet 900 due to the clockwise rotation thereof, the shaft 902*a* is released from the notches 909*b* of the clamp levers 909 while the notches of the sheet 900 are released from the ends of the lamp levers 909. Consequently the trailing edge 902 of the sheet 900 becomes free from the clamp levers 909 (see FIG. 54).

Figure 54:
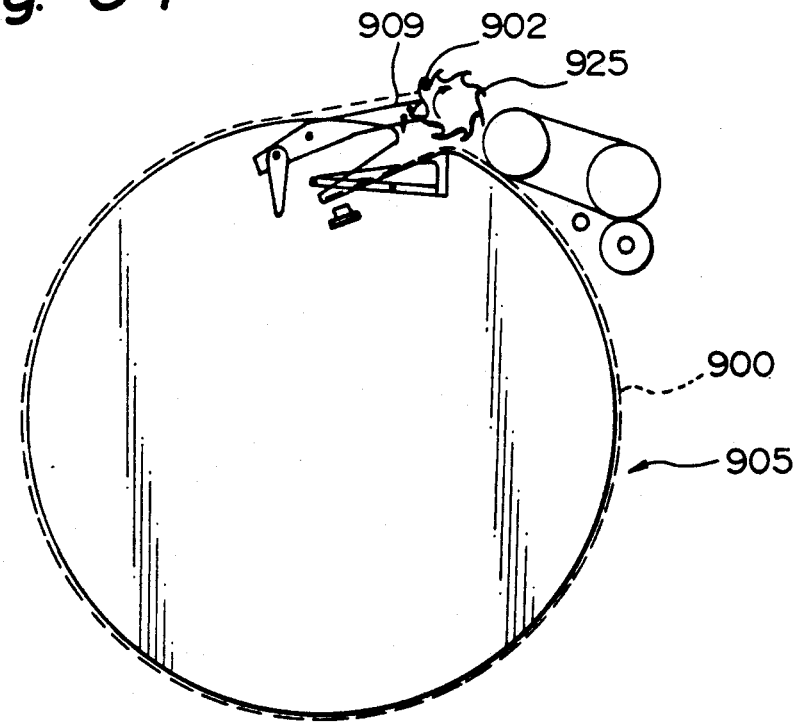
Figure 55:
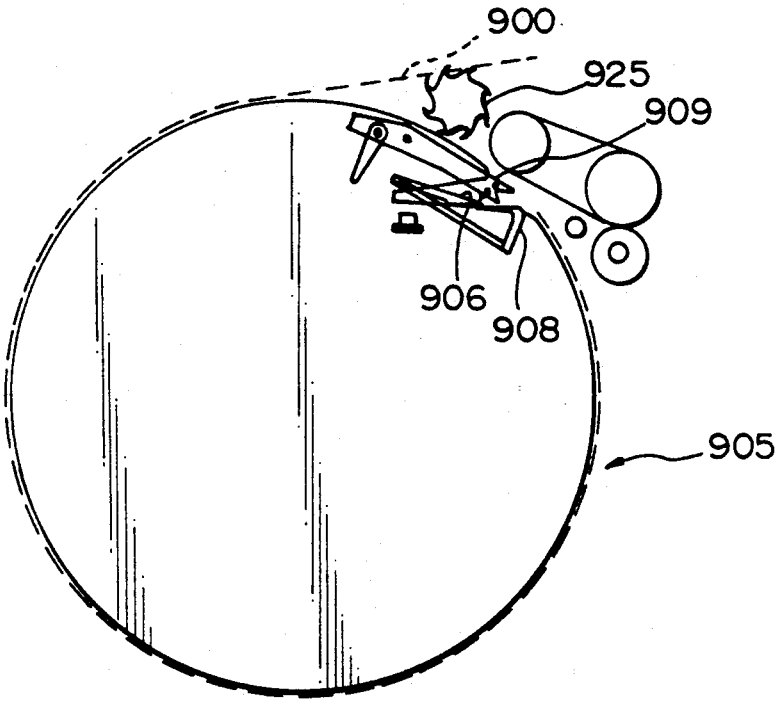

Subsequently, the clamp solenoid 910 is deenergized ((3), FIG. 74) to retract the clamp levers 909 into the support 905. At this instant, the trailing edge 902 of the sheet 900 is still held by the take-up roller 925. Whether or not the take-up roller 925 is holding the sheet 900 may be determined by use of, for example, a reflection type photosensor. On the elapse of a predetermined period of time H after the turn-on of the clamp solenoid 910, the drum motor is reversed to rotate the support 905 in the opposite direction to the rotation occurred during wrapping operation. The period of time H allows the take-up roller 925 to bite the trailing edge 902 of the sheet 900. If desired, the reversal of the support 905 may be started in response to the output of the above-mentioned photosensor and not by such time setting. On the reversal of the support 905, the sheet 900 is sequentially peeled off from the support 905 (FIGS. 54 and 55). The removed sheet 900 is collected in the sheet collecting section 599 of the box 550 at random. For this purpose, the box 550 is formed with a sheet inlet in close proximity to the take-up roller 925. When the support 905 is about to complete one full rotation ((5), FIG. 74), the drum motor is deenergized to stop the rotation of the drum 905. The clamp solenoid 910 is turned on for a predetermined period of time to cause the clamp levers 909 to protrude from the surface of the support 905. As a result, the sheet 900 has the leading edge 901 thereof released from the stop 90 and stop guide 908 and is sequentially taken up by the take-up roller.

Figure 76:
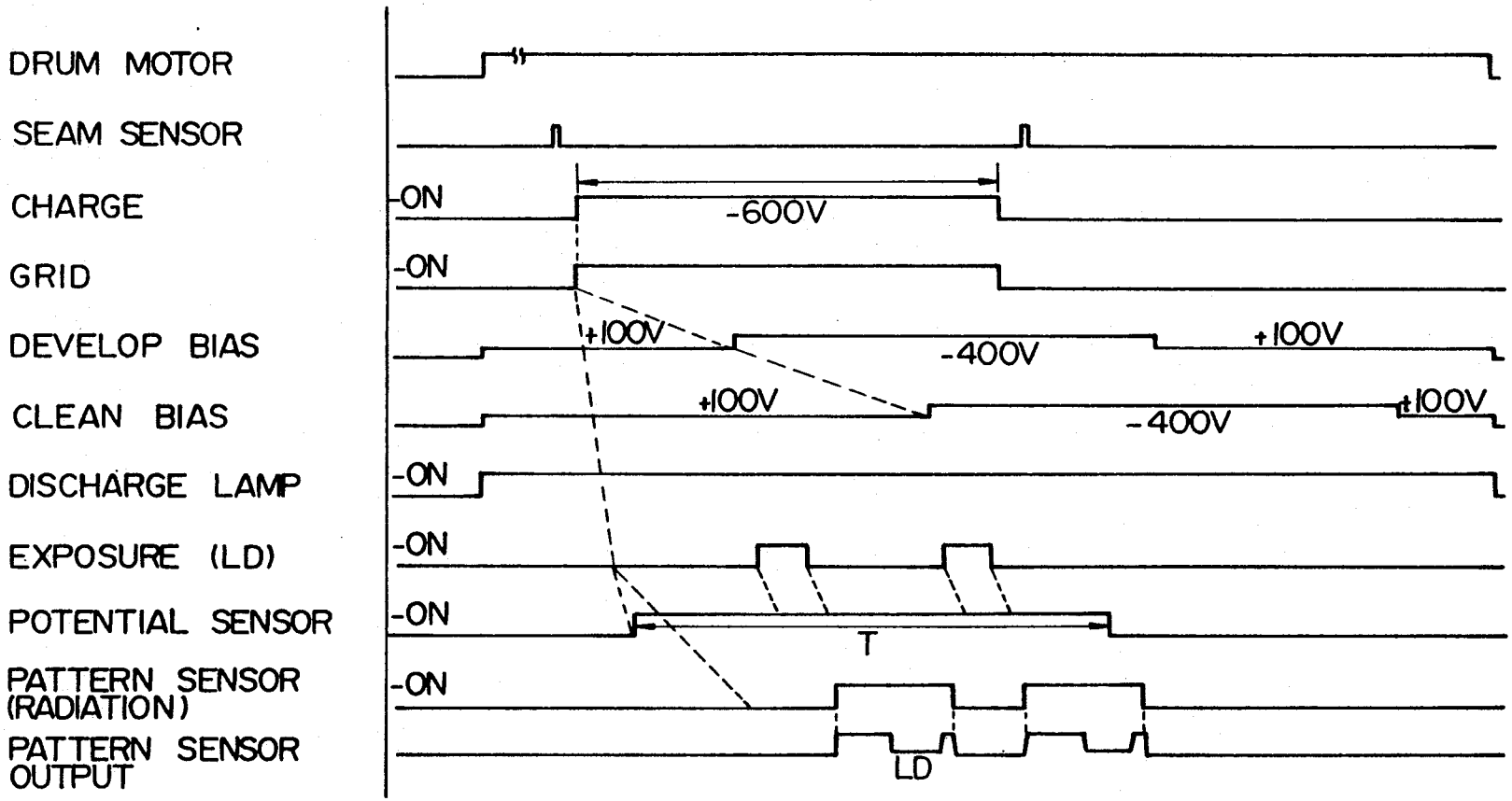
FIG. 76 is a timing chart indicative of control to be executed by the copier of FIG. 1 in the event of process checking.

When the sheet 900 is replaced with new one by the above procedure, it is preferable to correct the image forming process conditions in conformity to the characteristics of the new sheet, as follows. As shown in FIG. 76, after a new sheet 900 has been wrapped round the support 905, the drum 905 is charged (−600 V) to expose part of the sheet 900 in a predetermined manner (exposure LD ON). A potential sensor senses the resulting potentials of the exposed and non-exposed portions of the sheet 900 (sampling at a predetermined period over a period of time T). At the same time, the photosensor 352 reads the density of a toner image corresponding to the exposed portion and that of the background corresponding to the non-exposed portion. The resulting four kinds of data are used to execute the following checks and corrections:

1. checking the charge potential and the potential of the exposed portion, and setting the charger output (and/or grid voltage) such that the charge potential reaches −600 V;

2. checking the charge potential and the potential of the exposed portion, and correcting the exposing light (LD power) and developing bias;

3. checking the outputs of the photosensor representative of the toner image and background, and correcting the output of the sensor (ascribable to the reflectance) (surface property) particular to the new sheet 900); and 4. checking the outputs of the photosensor representative of the toner image and background to determine a toner concentration, and correcting the toner concentration in the developing unit by, if necessary, supplying a fresh toner.

Hereinafter will be described an implementation for preventing the toner and agent from depositing on the support 905 in the event when the sheet 900 is wrapped round or peeled off the support 905. In the illustrative embodiment, even during such a procedure, the developing device 386 and cleaning device 130 which act on the drum 140 are held in the same position as during ordinary image formation. Hence, when the support 905 of the drum 140 is rotated, the magnet brushes of the developing device 386 and cleaning device 130 slide thereon. During replacement of the sheet 900, the support 905 and sheet 900 are not charged at all, so that the toner or similar substance is prevented from electrically transferred from the magnet brushes thereto. Physically, however, some toner or similar substance is deposited on the support 905 or the sheet 900. If the toner, for example, is deposited on the support 905 without the sheet 900, the sheet 900 will fail to sufficiently contact the support 905 when wrapped thereround and, in the worst case, move relative to the support 905 during image forming operation. Further, if the toner is deposited on the sheet 900 having been wrapped round the support 905, it will be transferred to a paper sheet in the event of image formation. The toner is also apt to deposit on the support 905 during the removal of the sheet 900 from the support 905. In light of this, the embodiment controls, for example, the developing bias to prevent the toner and agent from depositing on the support 905 or the sheet 900 during the replacement of the sheet 900, as follows.

Figure 81:
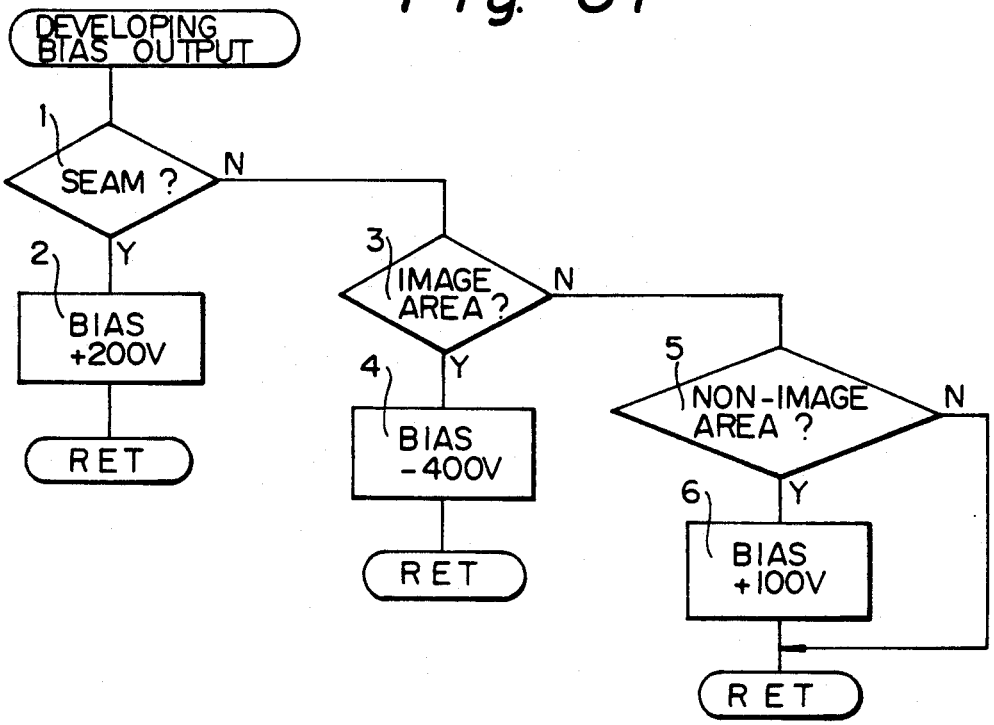
FIG. 81 is a flowchart showing control to be executed by the copier of FIG. 1 for controlling a developing bias in the event of replacement of the photoconductive sheet.

As shown in FIG. 81, whether or not the seam of the drum 140 is located to face the developing unit 100 is determined (step 1). Here, it is assumed that the seam faces the developing unit 100 over a predetermined period of time after the seam sensor has sensed the seam. The embodiment uses a negatively charged toner and effects development in the portions where the potential has been lowered to about −100 V by imagewise exposure by applying a developing bias of −400 V when the image portion faces the developing unit 100 (steps 3 and 4). Therefore, the developing bias is controlled to +200 V (step 2) while the seam of the drum 140 faces the developing unit 100, so that the negatively charged toner may not deposit on the drum 140 even when a potential of about −100 V remains on the drum 140. It is to be noted that the developing bias is set at +100 V while the non-image portion of the drum 140 faces the developing unit 100 during image formation (steps 5 and 6).

Figure 82:
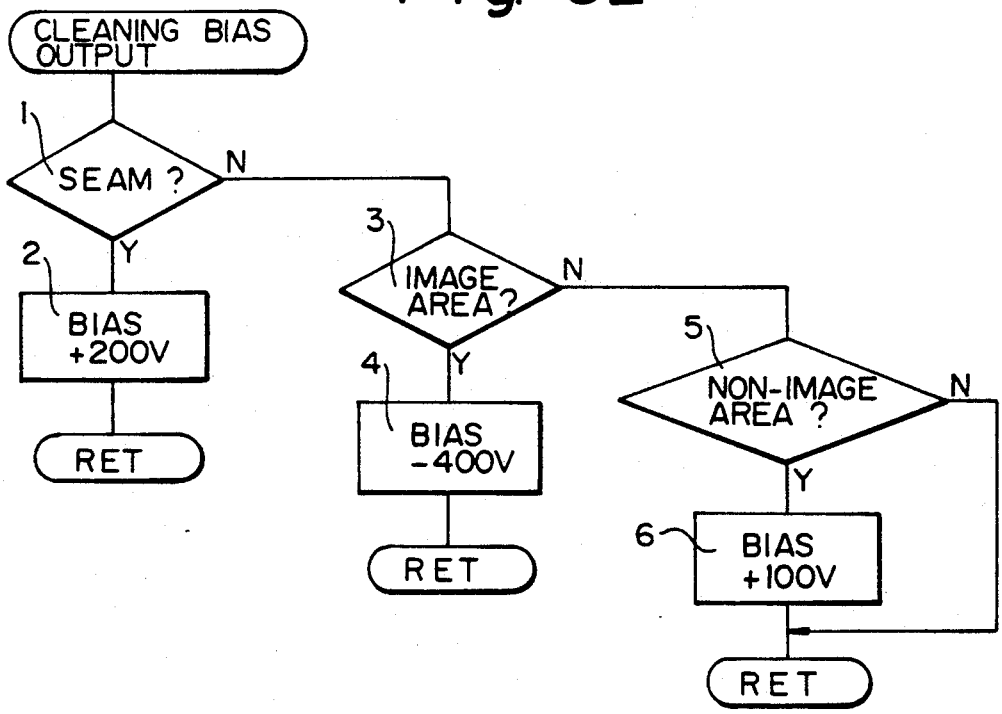
FIG. 82 is a flowchart showing control to be executed by the copier of FIG. 1 for controlling a cleaning bias in the event of replacement of the photoconductive sheet.

FIG. 82 shows a procedure in which the cleaning bias is so controlled as to prevent the toner and agent from depositing on the drum 140. As shown, the cleaning bias is controlled to +200 V when the seam of the drum 140 faces the cleaning device 130, to −400 V when the image portion of the drum 140 faces the device 130, or to +100 V when the non-image portion of drum 140 faces the device 130.

Figure 79A:
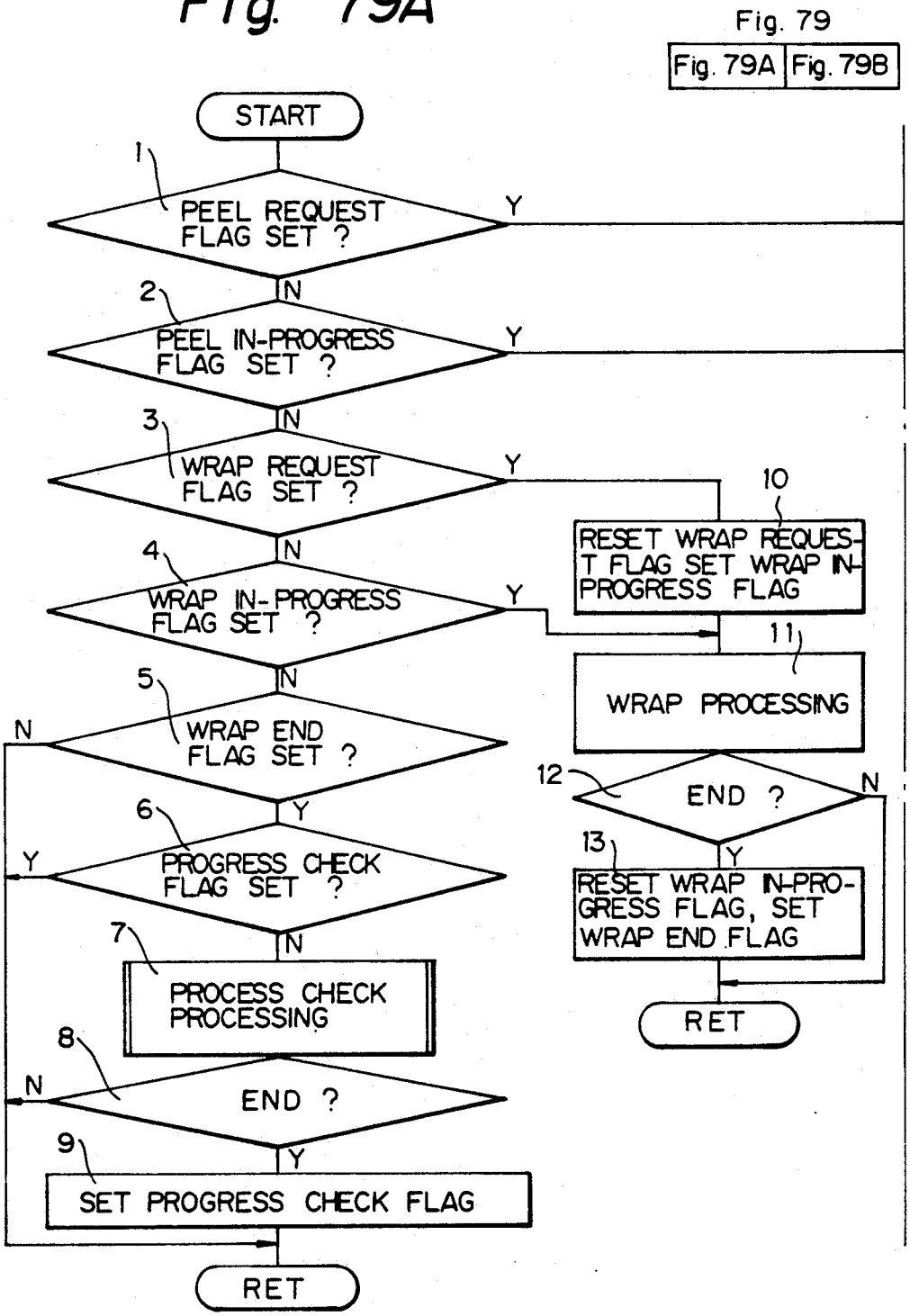
FIGS. 79A and 79B are flow charts to be executed by the copier of FIG. 1 in the event of replacement of the photoconductive sheet.
Figure 79B:
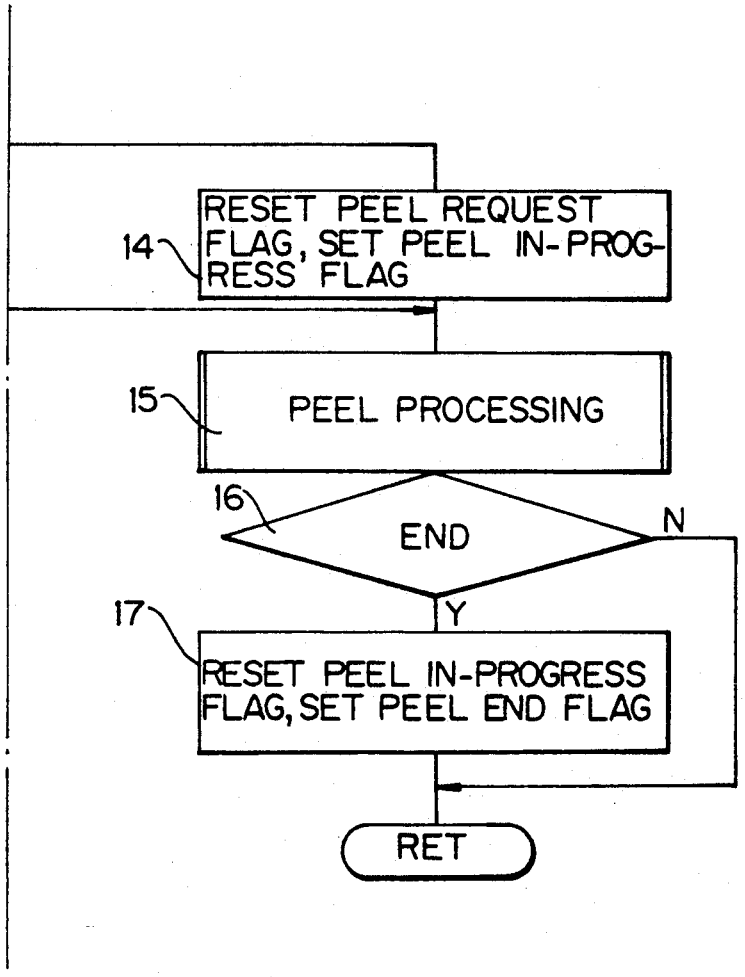

FIG. 79 demonstrates the general control effected when the sheet 900 of the drum 140 is replaced. Basically, the wrapping and peeling operations associated with the sheet 900 are executed by the following flags:

wrap request flag representative of a request for new sheet wrapping;

peel request flag representative of a request for old sheet peeling wrap in-progress flag indicating that a wrapping operation is under way;

peel in-progress flag indicating that a peeling operation is under way;

wrap end flag representative of the end of a wrapping operation;

peel and flag representative of the end of a peeling operation; and process check flag indicating that an image forming condition check procedure has ended in the event of the replacement of the sheet 900.

As shown in FIG. 79, whether or not the peel request flag is set is determined (step 1). If this flag is set, it is reset and the peel in-progress flag is set (step 14). The procedure for peeling off the sheet 900 is executed (step 15). On the completion of this procedure, the peel in-progress flag is reset and the peel end flag is set (step 17). While the peel in-progress flag is set, the operation is transferred from the step 2 to the step 15 for continuing the peeling operation. If the wrap request flag is set as determined in the step 3, this flag is reset and the wrap in-progress flag is set (step 10). Then, the drum wrapping procedure is executed (step 11). On the completion of this procedure, the wrap in-progress flag is reset and the wrap end flag is set (step 13). While the wrap in-progress flag is set, the operation is transferred from the step 4 to the step 11 for continuing the wrapping operation. If the wrap end flag is set as determined in the step 5, whether or not the process check flag is set is determined (step 6). If this flag is not set, the image forming condition check processing is continued (step 7). On the completion of this processing, the process check flag is set (step 9). It is to be noted that when any one of the wrapping, peeling and image forming condition check processing is under way, a counter implemented by a nonvolatile RAM is started and flags are set. This allows the processing to be continued after the turn-on or turn-off of the power source on the basis of the counter and flags.

The box 550 having the cartridge collecting section 551 and removably mounted on the apparatus body will be described specifically. The box 551 may be configured to accommodate not only the empty cartridges 500 but also other various expendables which are automatically retractable from predetermined operative positions in the apparatus. Then, all such expendables can be removed from the apparatus together with the box 551. The expendables other than the cartridge 500 include the sheet 900 wrapped round the cylindrical drum 905 as stated earlier, and the waste toner removed from the drum 140 by the cleaning device 130 and not reused. Hence, the box 550 may have any one of three different configurations, i.e., one having only a cartridge collection section (e.g. box shown in FIG. 58), one having at least one of a waste toner collecting section and a sheet collecting section in addition to a cartridge collecting section, and one having all of the cartridge, waste toner and sheet collecting sections. The configuration depends on the apparatus body. The box 550 itself may be provided with a disposable configuration.

Referring to FIGS. 59A–59C, 60 and 61, a box of the kind having a cartridge collecting section and a waste toner collecting section (referred to as a first type hreinafter) is shown. As shown, the box has a cartride collecting section 551 capable of accommodating ten empty cartridges 500. A single cartridge 500 accommodates about 360 grams of toner and can implement about 8,000 copies under standard conditions, as stated earlier. It follows that about 80,000 copies are obtainable until the cartridge collecting section 551 becomes full. In this specific configuration, the cartridge collecting section 551 is 110 mm high. Regarding an apparatus whose copying rate is relatively low, the cartridge collecting section 551 may be configured to accommodate only five empty cartridges 500 since the period of replacement is long. Such a cartridge collecting section 551 may have a height of 60 mm which is less than the overall height of the cartridge 500 filled with the developer. The reference numeral 559 designates a handle accessible for mounting the box on the apparatus body. A waste toner collecting section 561 is divided into a large chamber 567 and a small chamber 568 by a partition 565. The waste toner discharged from the cleaning device 130 is transported to the small chamber 568 via an inlet 569. Since the inlet 569 is positioned above a feed member 563, the waste toner drops onto and around the feed member 563 by gravity and accumulates there. As the feed member 563 is rotated, it transfers the waste toner from the small chamber 568 to the large chamber 567. Since the small chamber 568 is disposed above the large chamber 537, the toner is prevented from acting on the feed member 563 as a load despite the weight thereof. The waste toner storing means with such a configuration efficiently stores the waste toner in a compressed state and can be separated from the cleaning device 130.

The amount of waste toner increases substantially in proportion to the amount of toner consumption under standard conditions, as will be described later specifically. The number of empty cartridges 500, of course, increases in proportion to the amount of toner consumption. It follows that the cartridge collecting section 551 and waste toner collecting section 561 will become full substantially at the same time only if the collecting section 561 is provided with an adequate volume. A prerequisite is, however, that the volume of the collecting section 561 should be determined by assuming the worst image transfer ratio since the amount of waste toner depends on the image transfer efficiency. In this example, the cartridge 500 stores 360 grams of toner, so that ten cartridges 500 supply 3,600 grams of toner in total. Assuming that the worst image transfer ratio is 70%, 1,080 grams of waste toner will be produced. Although the volume of such an amount of waste toner is usually 3,600 cc, it is compressed by a compression ratio of 2.5 in the collecting section 561 and, therefore, to a volume of 1,400 cc. For this reason, the large chamber 567 and the small chamber 568 have volumes of 1,450 cc and 50 cc, respectively.

The apparatus body has the opening 694 below the cartridge insertion opening to allow the box 550 to be inserted thereinto (see FIG. 4). The operator is expected to insert or remove the box 550 into or from the apparatus body through the opening 694. The box 550 is provided with a lock mechanism and a shutter mechanism, as follows.

Figure 62B:
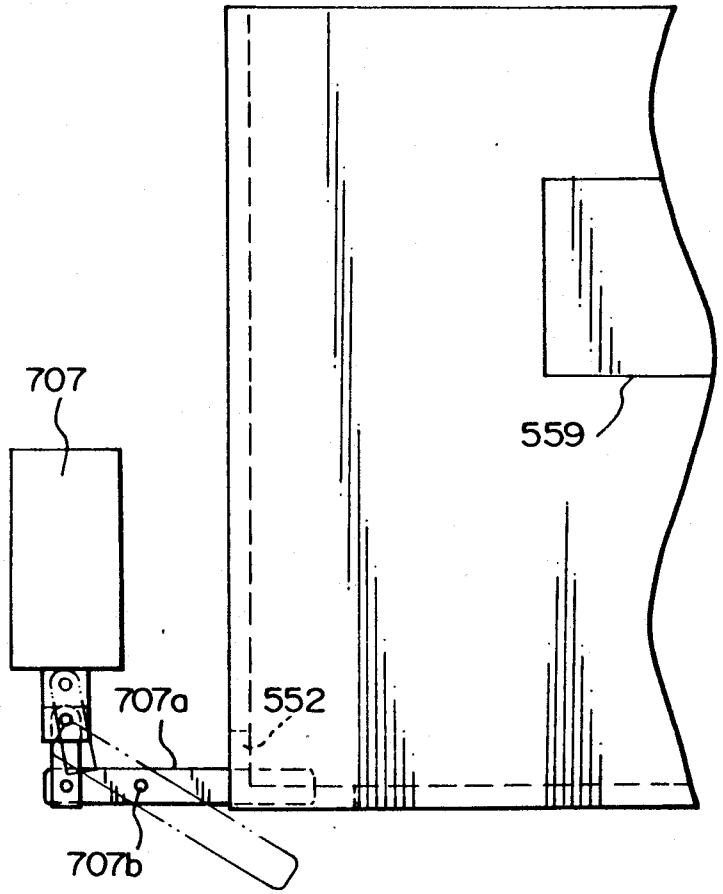
FIGS. 62A and 62B show a lock mechanism associated with the box of FIGS. 59A–59C in a side elevation as viewed from the left and a plan view, respectively.
Figure 62A:
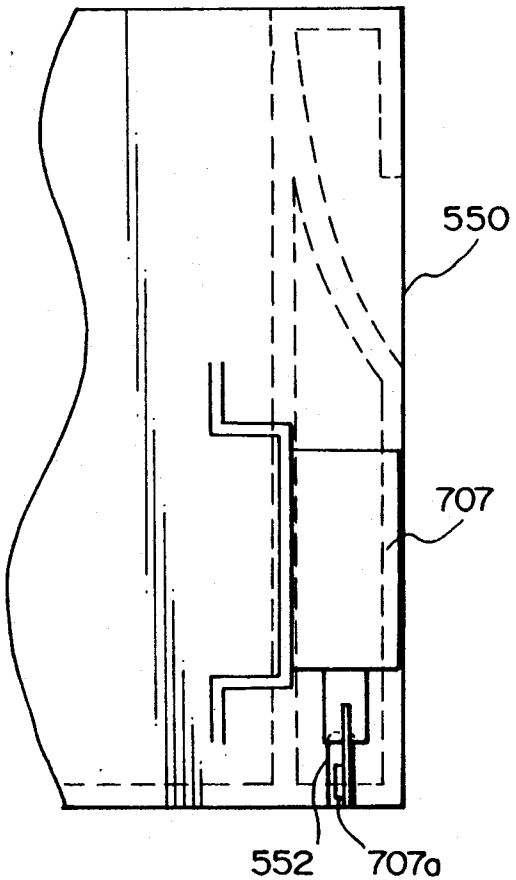

As shown in FIGS. 62A and 62B, the lock mechanism inhibits the box 550 from being inserted into or removed from the apparatus body except under predetermined conditions, so that the toner may not be scattered around to the outside of the apparatus body. In the event of insertion of the box 550, a lock solenoid 707 of the box 550 is energized before the insertion. Then, a lock member **707*a* is rotated clockwise about a fulcrum 707*b* to a position indicated by a phantom line in FIG. 62B. In this condition, as the box 550 is inserted into the apparatus body, a box sensor 706 located at a predetermined position in the apparatus body is turned on (FIG. 8). In response to the resulting output of the box sensor 706, a lock solenoid 707 is turned off to cause the lock member 707*a* to rotate counterclockwise about the fulcrum 707*b* to a position indicated by a solid line in FIG. 62B. As a result, the lock member 707*a* is received in a notch 558 formed in the box 550 to lock the box 550 in position. The box 550** can be pulled out of the apparatus body in essentially the same manner.

Figure 59A:
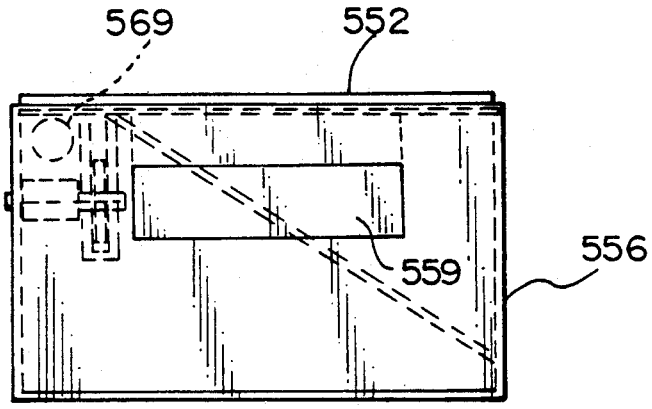
FIGS. 59A, 59B and 59C show a box having a cartridge collecting section, a sheet storing section, and a waste toner collecting section in a front view, side elevation as viewed from the left, and a plan view, respectively.
Figure 59B:
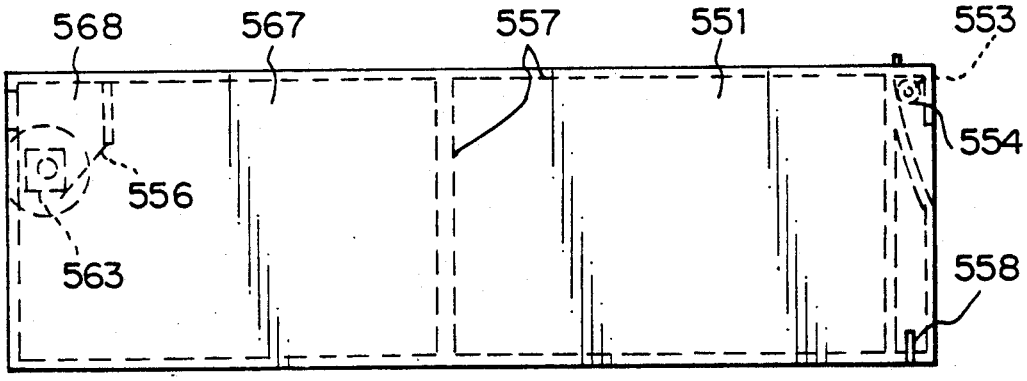
Figure 59C:
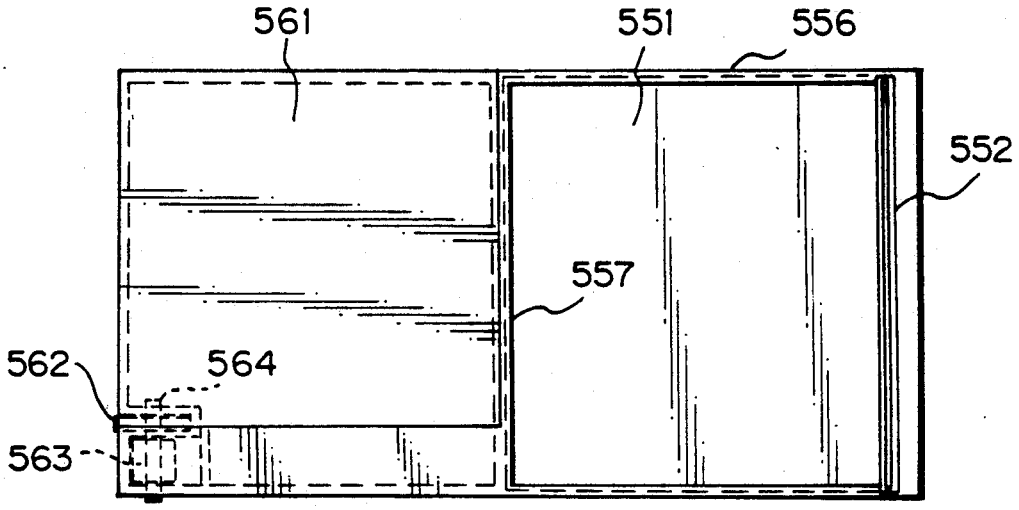
Figure 63:
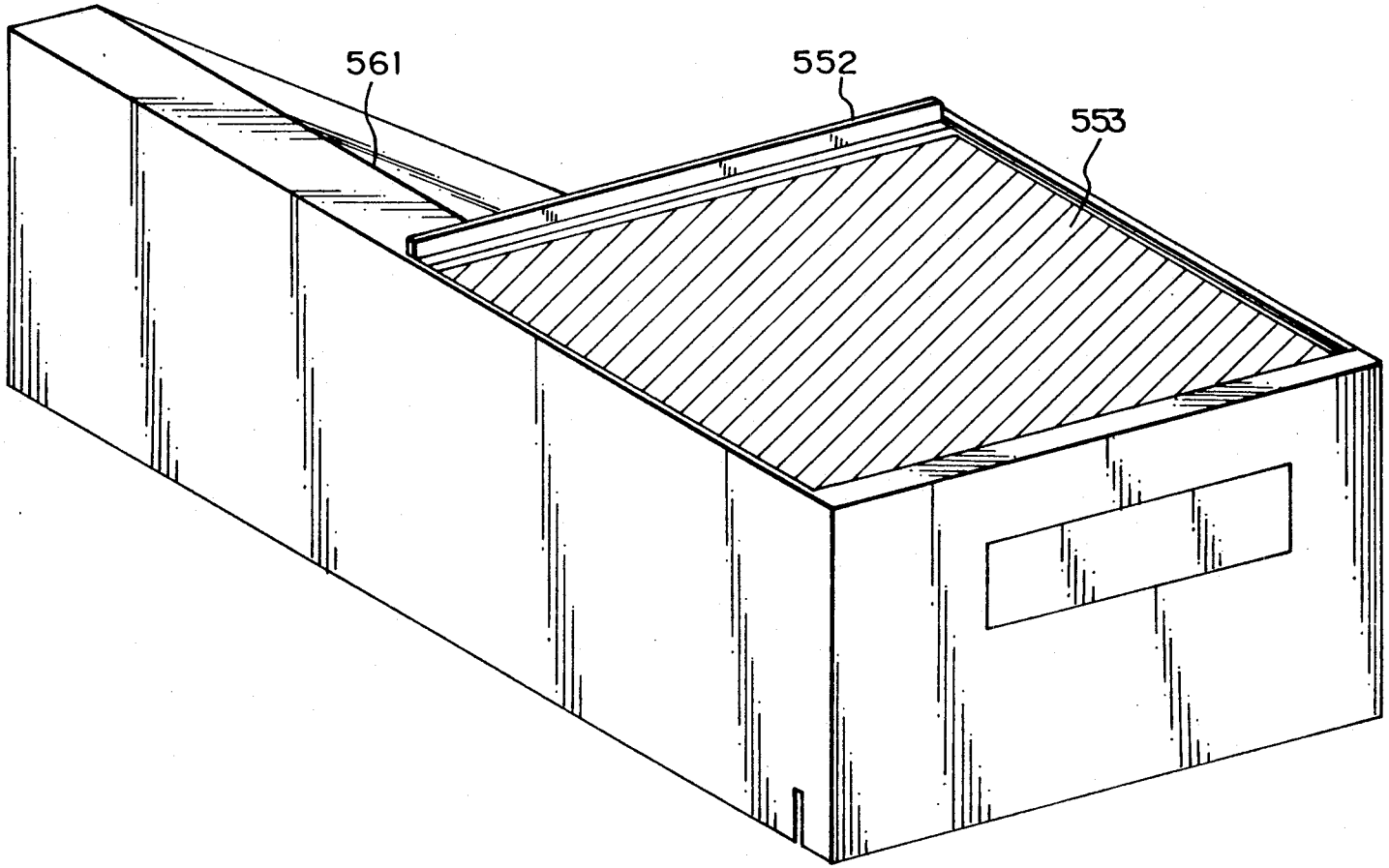
FIG. 63 is a perspective view of the box of FIGS. 59A–59C in a closed position.
Figure 64A:
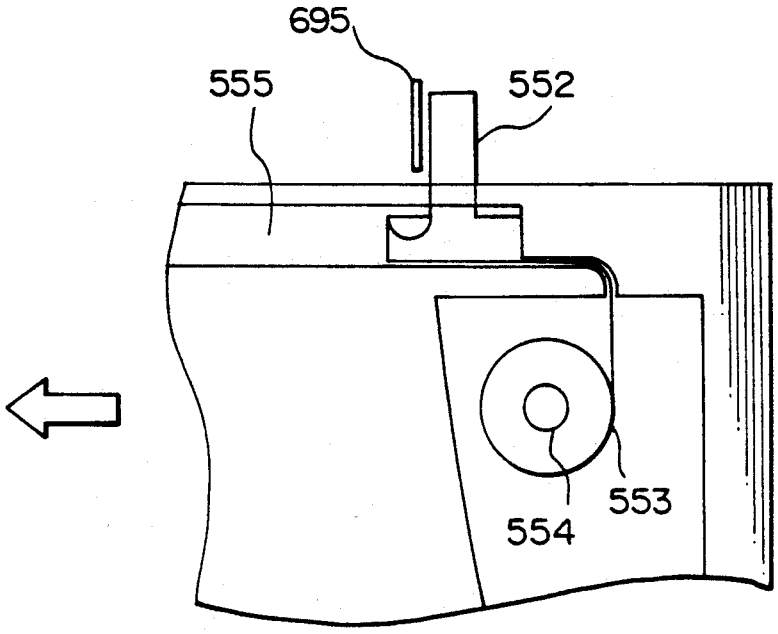
FIGS. 64A, 64B, 65A and 65B are side elevations as viewed from the left, showing the box of FIGS. 59A–59C at successive stages of removal.
Figure 64B:
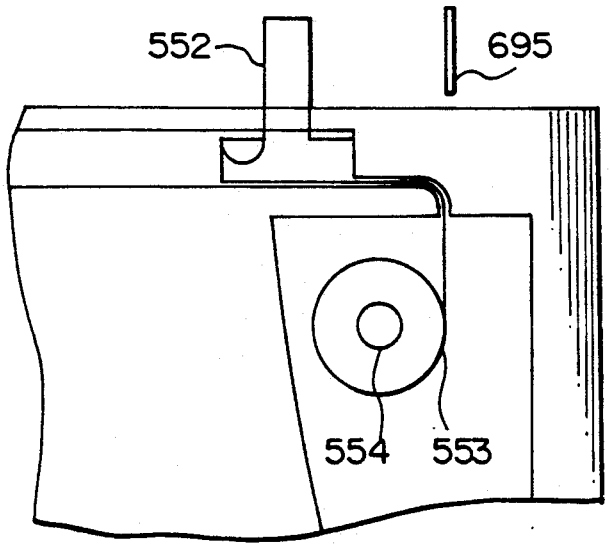

The shutter mechanism is shown in FIGS. 59A–59C, 63, 60, 64A, 64B, 65A, 65B, 66A and 66B. It is preferable to provide the box 550 with a shutter for cover the cartridge collecting section 551 in the event of removal of the box 550 for the same reason as stated in relation to the lock mechanism. As shown in FIGS. 59A–59C, a shutter shaft 552 is slidably received in a shutter groove 555 (see FIG. 64A) which is formed in a side wall 566 forming part of the box 550. A shutter sheet 553 is adhered to the shutter shaft 552 at one end thereof. Before the box 550 is inserted into the apparatus body, the shutter shaft 552 is located near the handle 559 while the shutter sheet 553 remains wrapped round a shutter sheet shaft 554. As shown in FIGS. 64A and 64B, a leaf spring 695 is affixed to the apparatus body such that it interferes with the shutter shaft 552 of the box 550 when the box 550 is moved into or out of the apparatus body.

Figure 65A:
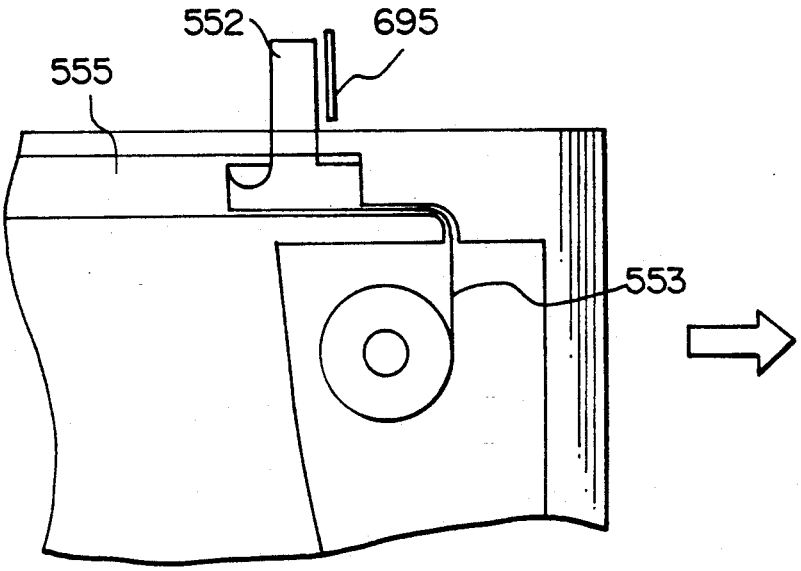
Figure 65B:
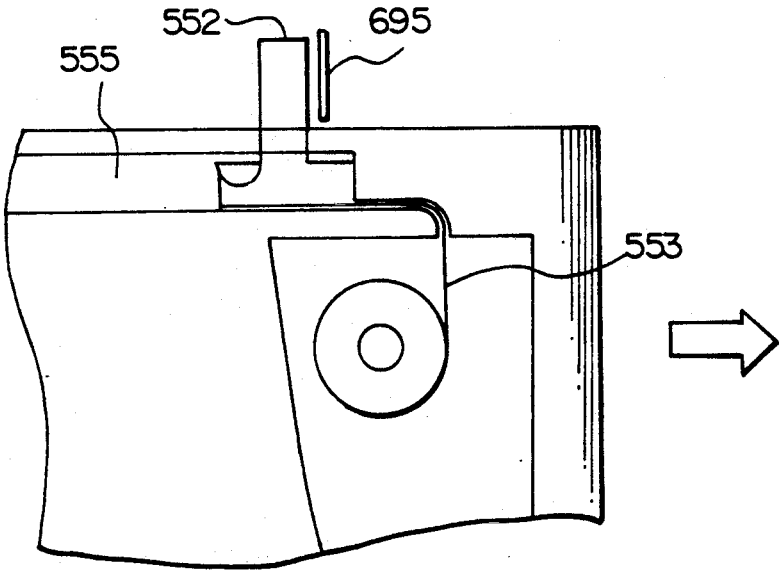
Figure 66A:
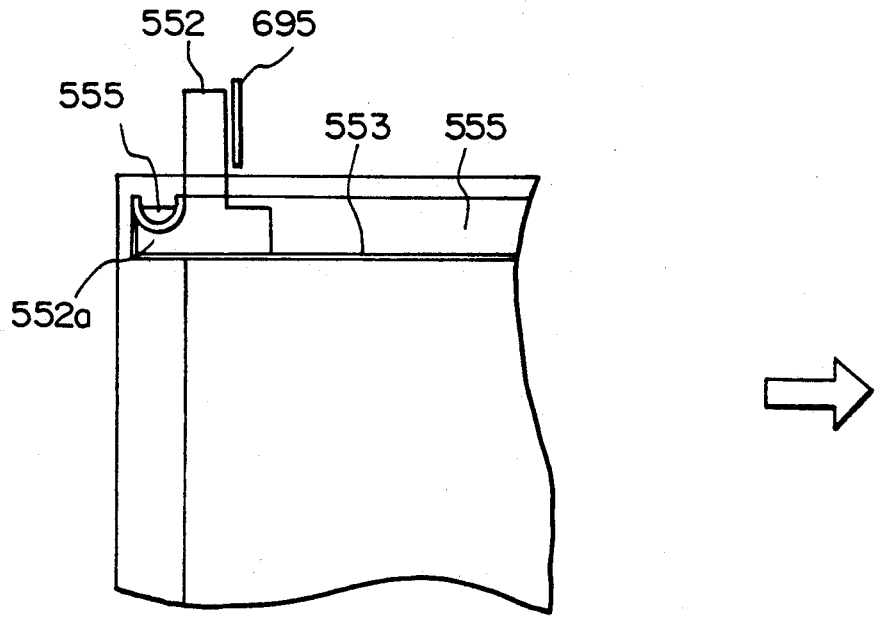
FIGS. 66A and 66B are side elevations as viewed from the left, showing the box of FIGS. 59A–59C at successive stages of insertion.
Figure 66B:
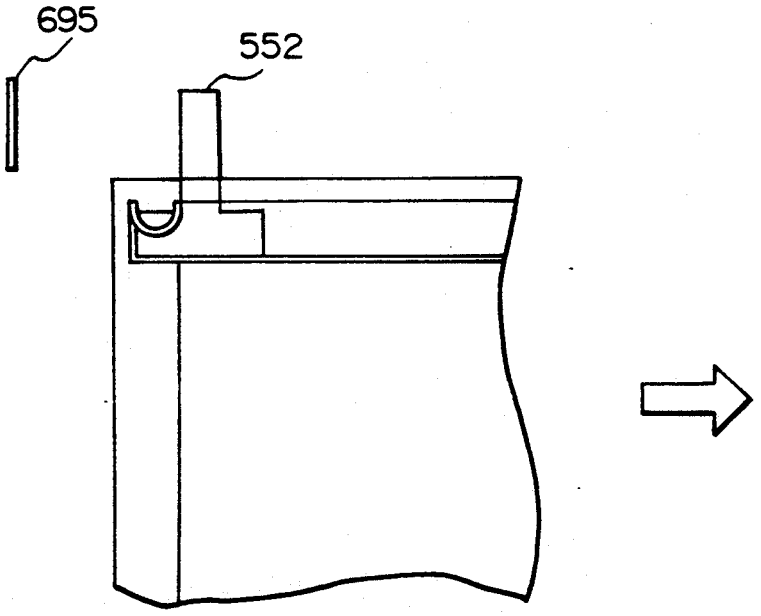

FIG. 64A shows a condition wherein the box 550 is inserted into the apparatus body over a substantial distance. As the box 550 is moved deeper into the apparatus body, the shutter shaft 552 interferes with the leaf spring 695. At this instant, the shutter shaft 552 does not move relative to the box 550 and moves into the apparatus body while bending the leaf spring 696. When the box 550 is fully inserted into the apparatus body, the leaf spring 695 is released from the shutter shaft 552 and restored due to resiliency (FIG. 64B). When the box 550 is pulled out of the apparatus body, the shutter shaft 552 again interferes with the leaf spring 695 (FIG. 65A). At this time, the shutter shaft 552 slides along the shutter groove 555 (FIG. 65B) before it bends the leaf spring 695. As a result, the shutter sheet 553 adhered to the shutter shaft 552 at one end thereof sequentially covers the cartridge collecting section 551. As soon as the shutter shaft 552 reaches the inner wall 557 of the box 550 (see FIG. 59C), the shaft 552 is fixed in place since a recess **552*a* thereof mates with a lug 555*a* extending from the shutter groove 555 (FIG. 66A). As the box 550 is further pulled out, the shutter shaft 552 comes out of the apparatus body while bending the leaf spring 696 (FIG. 66B). The box 550 removed from the apparatus body has the opening of the cartridge collecting section 551 fully closed by the shutter sheet 553 (FIG. 63**).

In the above configuration of the box 550, the cartridge collecting section 551 and the waste toner collecting section 561 become full at the same time. Therefore, when the box 551 is discarded when either of the collecting sections 551 and 561 is full, the two collecting means will be discarded at the same time by a single operation without wasting them. Assuming the previously stated volumes, all that is required regarding the toner is to insert a new cartridge every time 8,000 copies are produced and discard the box 550 when 80,000 copies are produced, i.e., maneuvability is extremely enhanced. Today, a photoconductive element having a ten times longer life than a traditional element is available although such an element is expensive. This kind of photoconductive element is mounted on a high grade, high speed apparatus. It follows that the long life photoconductive element will further simplify the maintenance when applied to an apparatus to which the box 550 with the above-described configuration (first type) is applicable.

Figure 58:
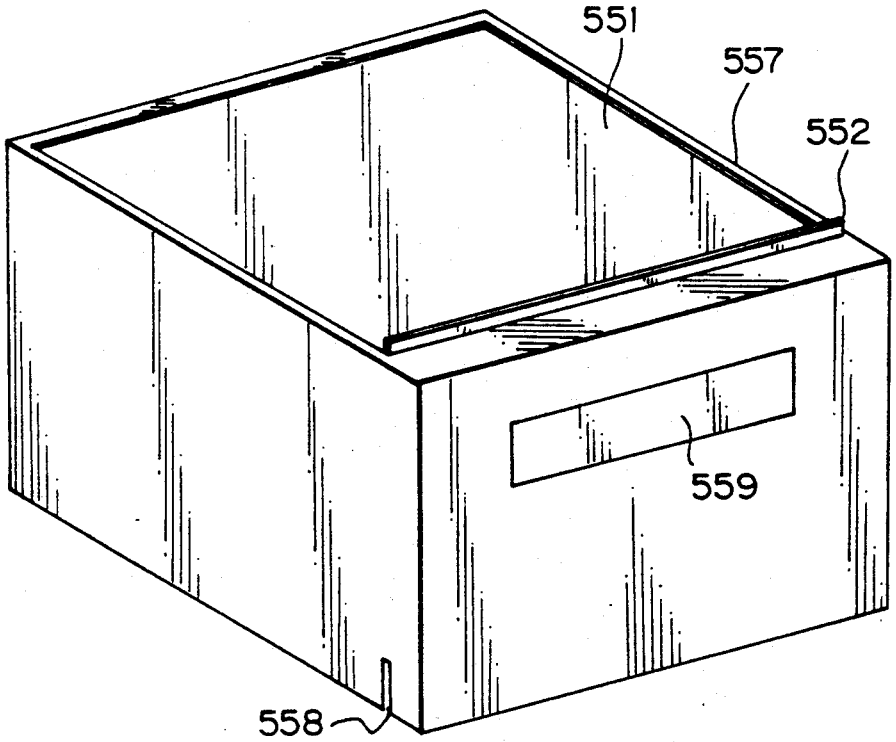
FIG. 58 is a perspective view of a box having only a cartridge collecting section.

A second type of box 550 may have only the above-stated cartridge collecting section, as shown in FIG. 58 specifically. The box shown in FIG. 58 has the same construction as the cartridge collection section of the first type of box. The box 550 which will be described is advantageously applicable to an apparatus of the kind using the toner recycle system. With this type of box 550, too, all that is required is to insert a new cartridge every time 8,000 copies are produced and discard the box 550 every time 80,000 copies are produced.

A third type of box 550 may have a cartridge collecting section, a waste toner collecting section, and a sheet collecting or storing section, as shown in FIG. 67 specifically. The third type of box 550 is advantageously applicable to an apparatus capable of replacing the photoconductive sheet automatically and collecting it in the box 550. As shown, the cartridge collecting section 551 and waste toner collecting section 561 are configured in essentially the same manner as those of the first type of box 550. The difference is that the lock mechanism is provided in a sheet collecting section 599 which will be described in detail later. The box 550 has to be bodily discarded when the cartridge collecting section and waste toner collecting section 561 are full, as stated earlier. In addition, even the photoconductive sheet deteriorates depending on the total number of copies produced. In this example, therefore, the cartridge collecting section 551 and waste tone collecting section are so configured as to become full in matching relation to the life of the photoconductive sheet. Hence, the three collecting sections can be discarded at the same time by a single operation. Again, the user has only to insert a new cartridge every time 8,000 copies are produced and discard the box when 80,000 copies are produced. While a long life photoconductive element is available as discussed in relation to the first type of box 550, such an element is rarely used with a low speed and inexpensive apparatus due to the cost. Therefore, the third type of box 550 also simplifies the maintenance when applied to an apparatus of the type using a conventional photoconductive element.

Figure 68:
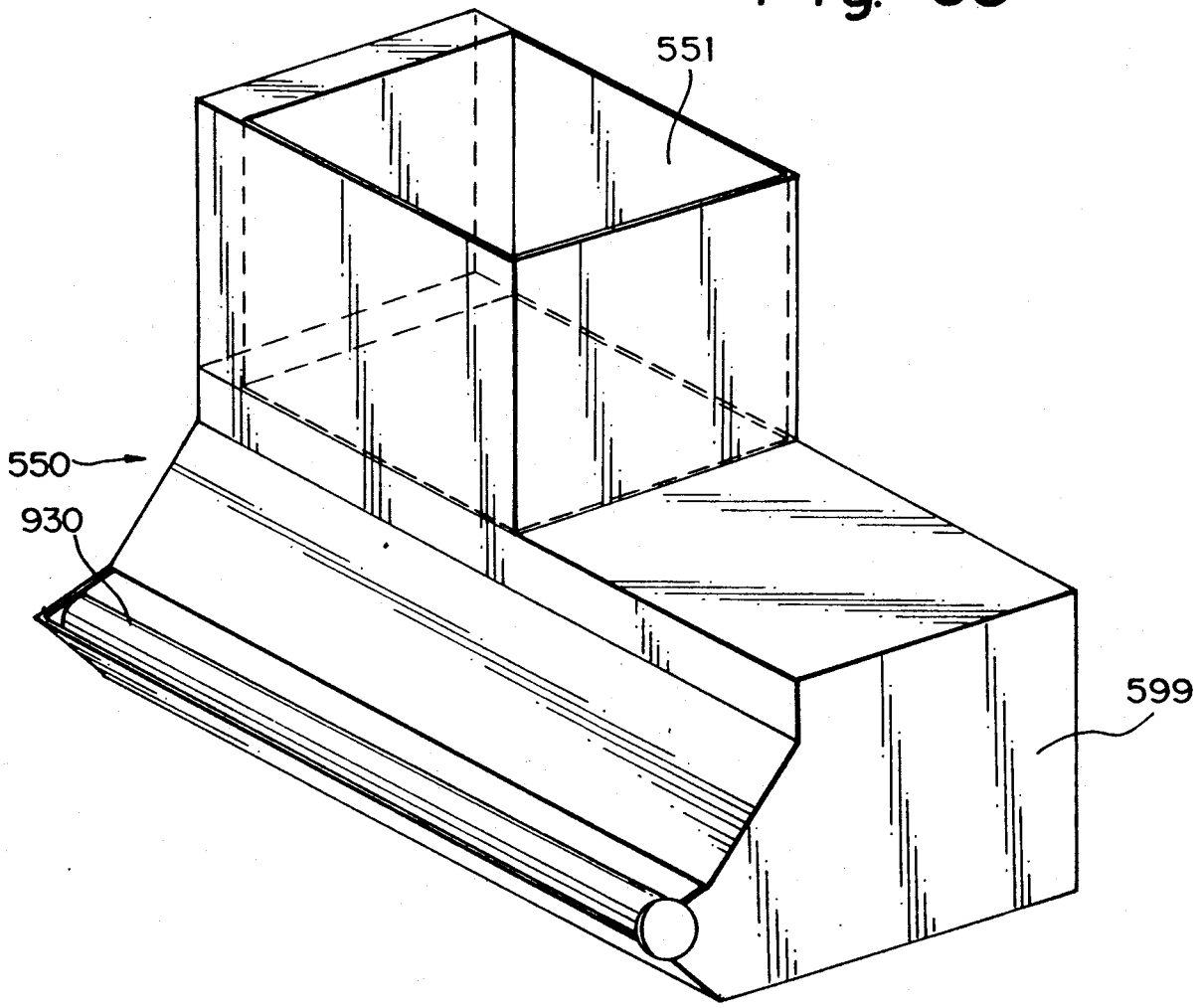
FIG. 68 is a perspective view of a box having a cartridge collecting section and a sheet storing section.

A fourth type of box 500 may have a cartridge collecting section and a sheet collecting section, as shown in FIG. 68 specifically. The fourth type of box 500 is advantageously applicable to an apparatus of the type capable of replacing a photoconductive sheet automatically and collecting it in the box 550 and, in addition, using the toner recycle system or having a large capacity waste toner collecting section thereinside, i.e., not requiring the box 550 to have a waste toner collecting section. In FIG. 68, the cartridge collecting section 551 has the same configuration as the cartridge collecting section 551 of the first type of box 550. The sheet collecting section 599 is identical in construction with the sheet collecting section 599 of the third type of box 550. Since the cartridge collecting section 551 is constructed to become full in matching relation to the life of the photoconductive sheet, the box 551 will be discarded when either of the collecting sections 551 and 599 becomes full. The fourth type of box 550, therefore, also achieves the various advantages described above in relation to the first to third types of boxes 500.

The first to fourth types of boxes 550 accommodate all the image forming apparatus of various costs and speeds, and each reduces the maintenance work to a remarkable extent. Besides, each of the boxes 550 is advantageous over the conventional process cartridge system regarding the environmental pollution and the waste of limited resources.

Figure 69A:
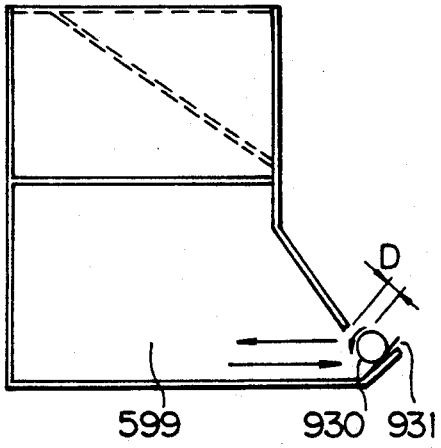
FIGS. 69A, 69B, and 69C show the box of FIG. 67 in a front view, top view, and plan view, respectively.
Figure 69B:
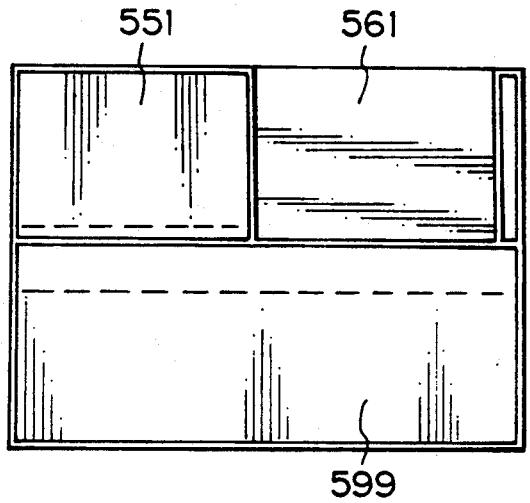
Figure 69C:
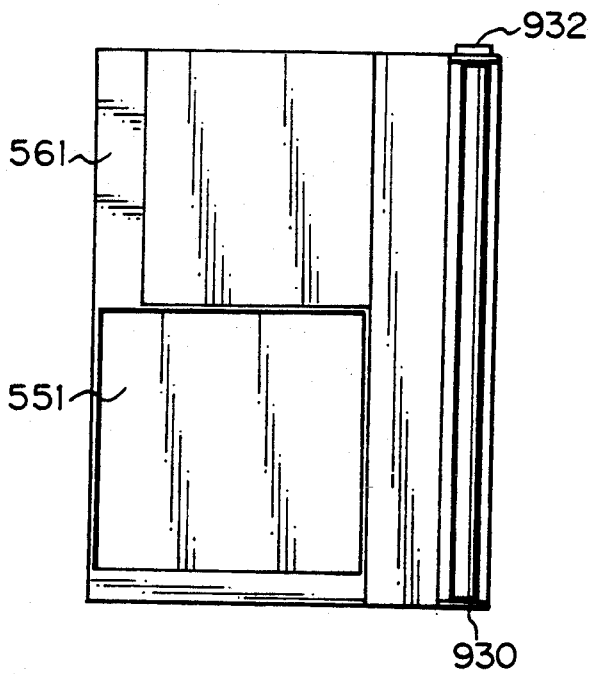

Hereinafter will be described the box 550 applicable to the embodiment. The box 550 has the configuration shown in FIG. 67 and made up of a cartridge collecting section, a waste toner collecting section, and a sheet collecting or storin section (third type). Such a box 550 is shown in a front view in FIG. 69A, in a side elevation as viewed from the left in FIG. 69B, and in a plan view in FIG. 69C. Since the cartridge collecting section 551 and waste toner collecting section 561 are identical with those of the first type of box shown in FIG. 59, the following description will concentration on the sheet storing section 599. The sheet storing section 599 stores fresh photoconductive sheets 900 and used photoconductive sheets 900. The sheet storing section 559 has an opening 800 located such that when the box 550 is mounted on the apparatus body, the opening 800 faces the sheet peeling mechanism. The opening 800 extends in parallel to the shaft of the hollow cylindrical support 905. A feed roller 930 is disposed in the opening 800 and driven by a drive motor mounted on the apparatus via a gear 932, as indicated by an arrow. The feed roller 930 is constantly biased by a leaf spring 931. In the event of wrapping the sheet 900, the feed roller 930 and the leaf spring 931 hold the sheet 900 therbetween, and the feed roller 930 is fed at substantially the same linear speed as the support 905. In the event of peeling off the sheet 900 from the support 905, the sheet 90 is forced into the sheet storing section 599 through a gap D by the force exerted by the guide roller section in the feed direction and the weight of the sheet 900.

Figure 70:
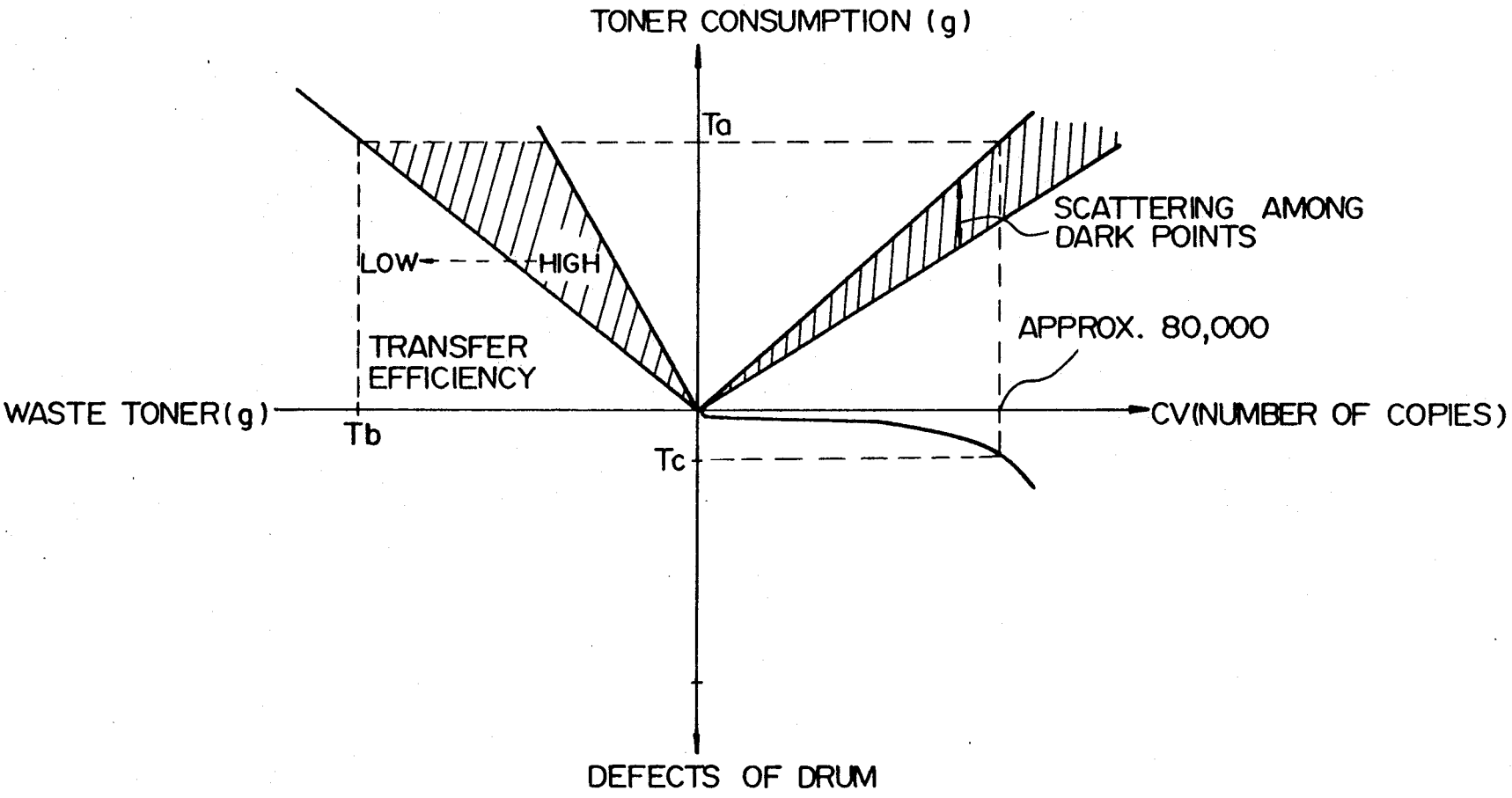
FIG. 70 is a graph indicative of a time for replacing the box of FIG. 67.

Control relating to the replacement of the box 550 is as follows. To begin with, a relation of the toner consumption, the amount of waste toner, and the deterioration of the photoconductive drum 140 to one another which determines a time for replacing the box 550 will be described. As shown in FIG. 70, the number copies (CV) and the amount of toner consumption are substantially proportional to each other although some irregularity exists. The irregularity is derived from the fact that the dark portion of a document is not constant. In a strict sense, the amount of non-transferred toner left on the drum 140 follows the amount of toner consumption, rather than the number of copies; the amount of non-transferred toner noticeably depends on the image transfer efficiency. For example, when the transfer charger is contaminated due to aging, the image transfer efficiency is degraded to increase the rate of waste toner production (generally, the efficiency is 70% to 80%). Since the drum 140 is repetitively subjected to friction with the developer and cleaning agent and repetitively brought into and out of contact with paper sheets, the rate at which the drum 140 is scratched or otherwise damaged increases with CV. By combining the three parameters, i.e., the increase in the defects of the drum, the increase in the amount of waste toner and the amount of toner consumption may be combined in various ways to select adequate one of the first to fourth types of boxes 500. The embodiment selects a relation between the maximum amount of waste toner (Tb) and the maximum amount of toner consumption (Ta) with respect to CV corresponding to the life (Tc) of the support shown in FIG. 70. When an integral molding is used, the following relation is required:

$$\text{volume of toner collecting section} \geqq Tb \times 1/\text{compression ratio} \quad (1)$$

Assuming that the cartridge collecting section accommodates n cartridges, the following relation has to hold:

$$n \times 350 \text{ grams} \geqq Ta \quad (2)$$

Therefore, the upper limit of CV is determined by Tc, Ta is determined by CV, and Tb is determined with consideration given to the worst image transfer ratio. Then, the volumes of the adjoining collecting and storing sections and means which can be bodily mounted and dismounted are determined. In the embodiment, therefore, when ten empty cartridges are collected, when 8,000 copies are produced with a single photoconductive sheet 900, or when the waste toner bottle is full, the sheet 900 is removed from the support 905, and then a message for urging the operator to replace the box 550 is displayed.

Figure 80A:
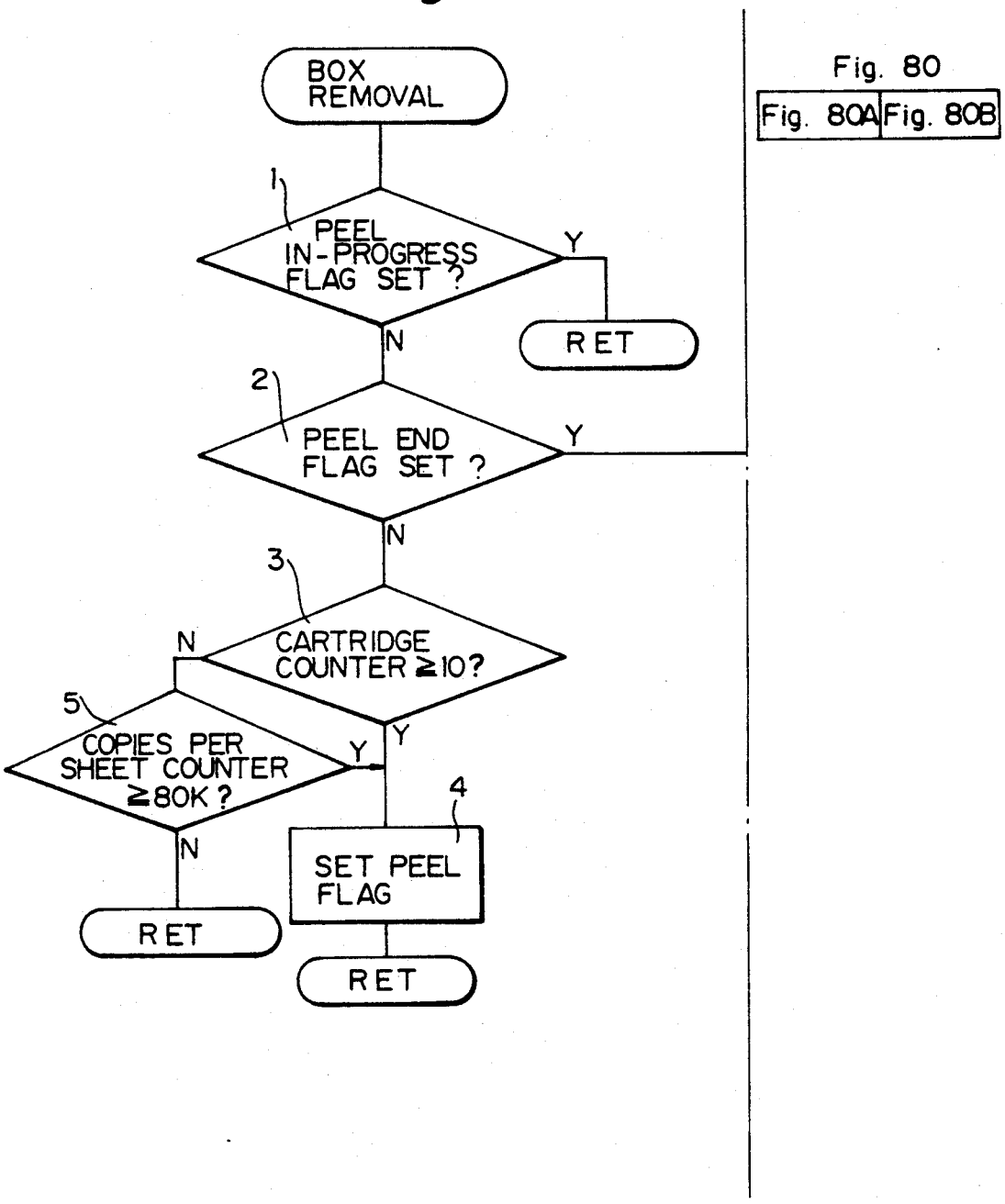
FIGS. 80A and 80B are flowcharts showing control which an image forming apparatus using the box shown in FIG. 68 executes in the event when the box is pulled out.
Figure 80B:
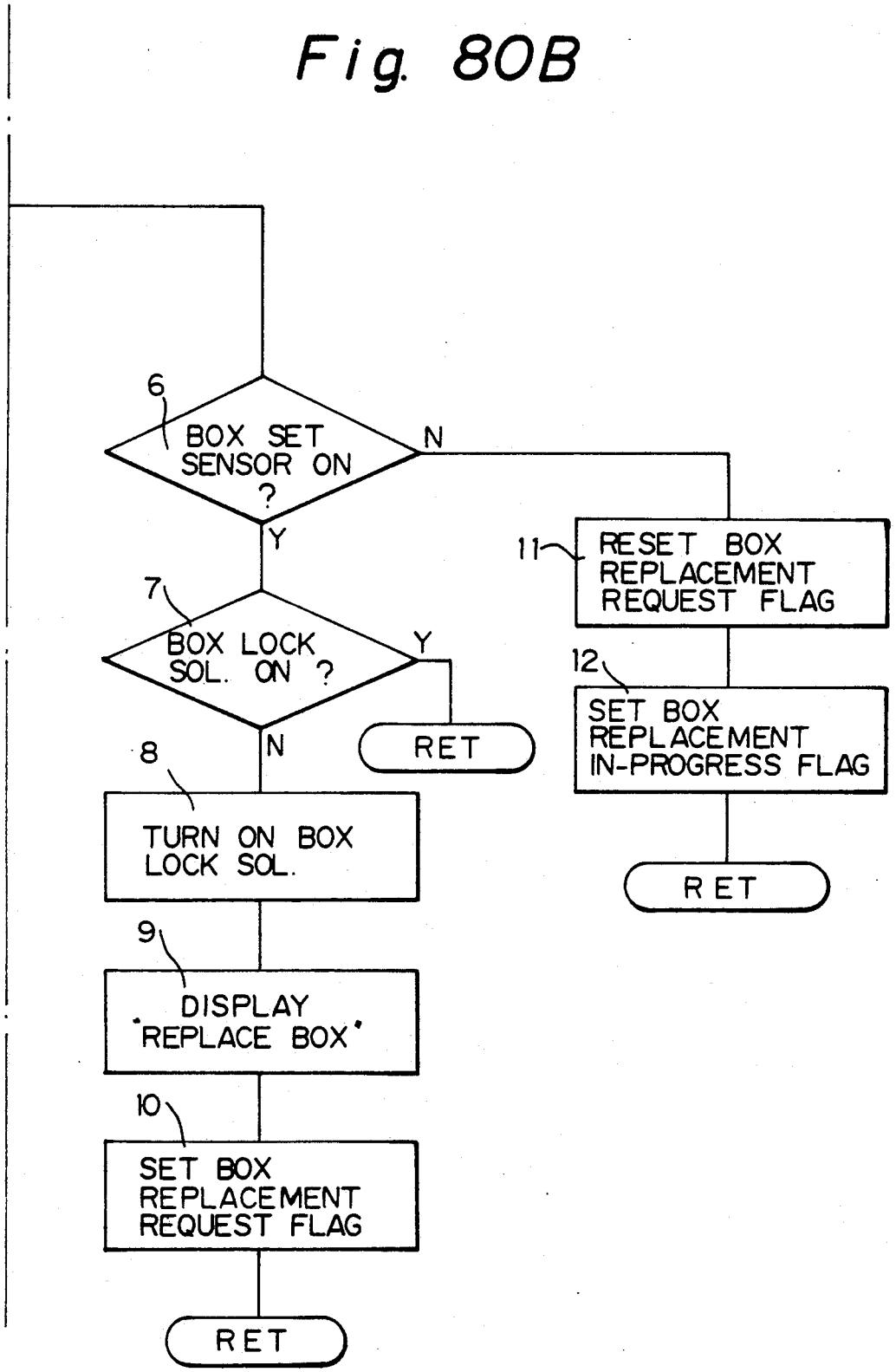
Figure 83A:
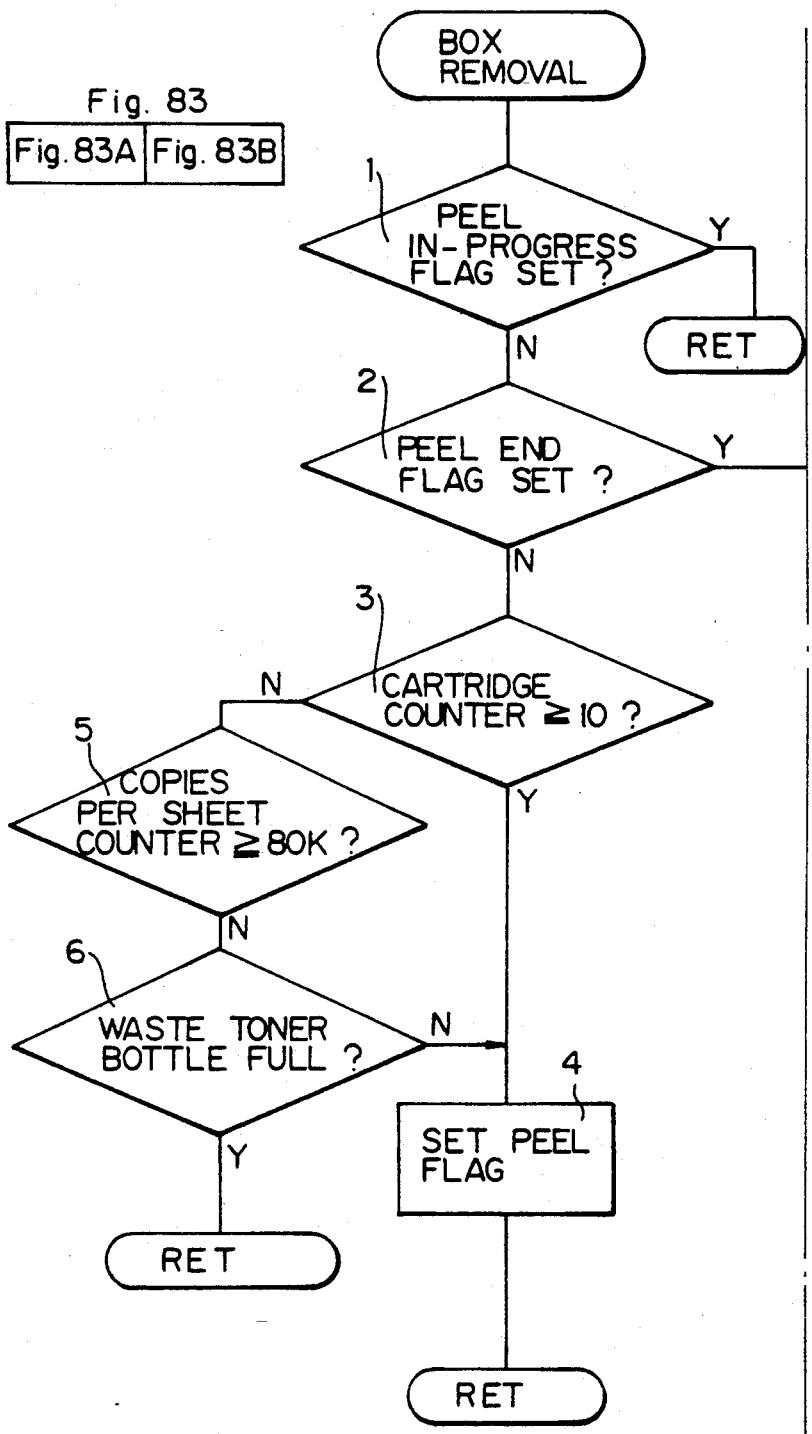
FIGS. 83A and 83B are flowcharts showing control to be executed by the copier of FIG. 1 in the event when the box is pulled out.
Figure 83B:
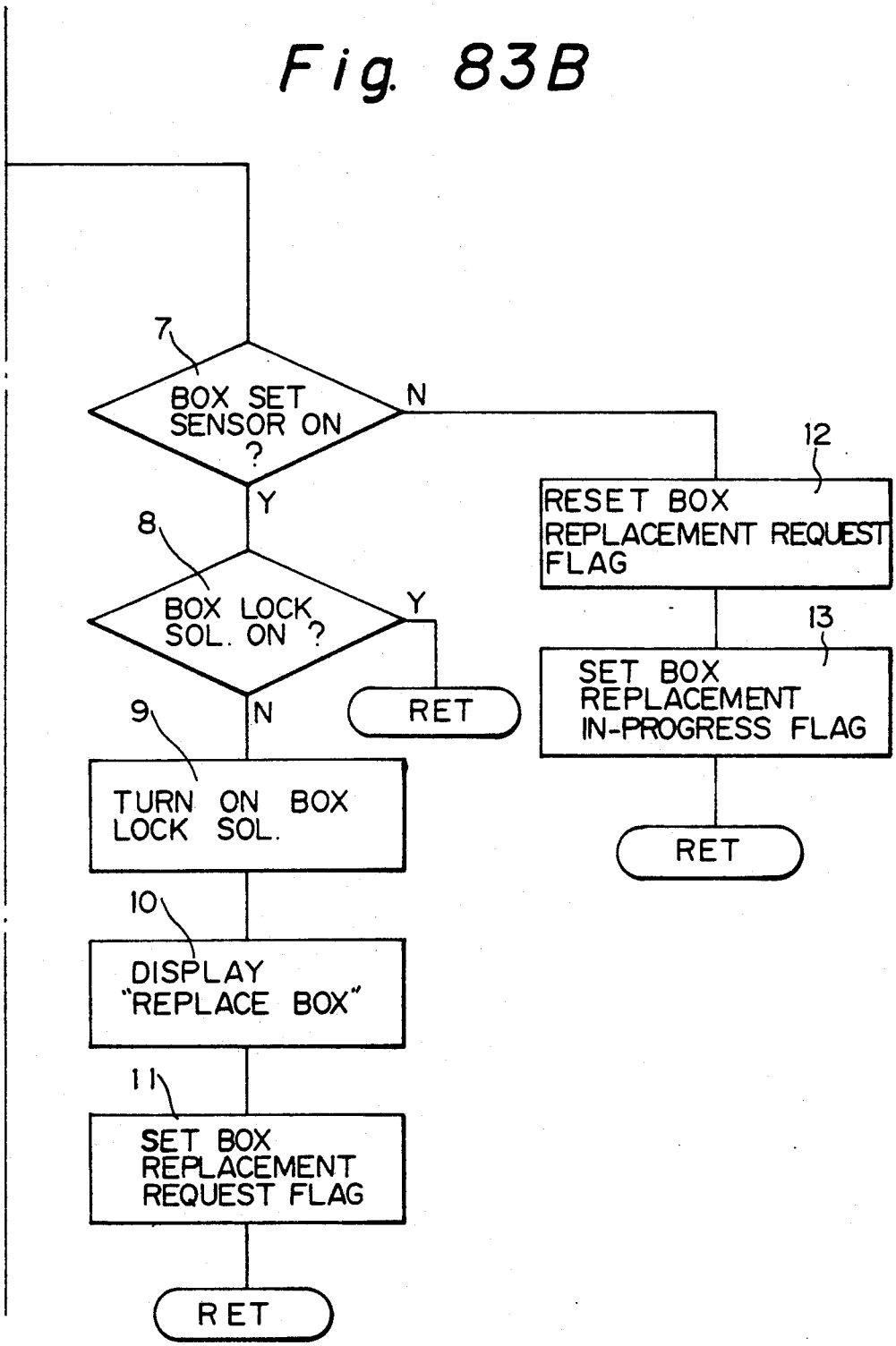
Figures 84A, 84B:
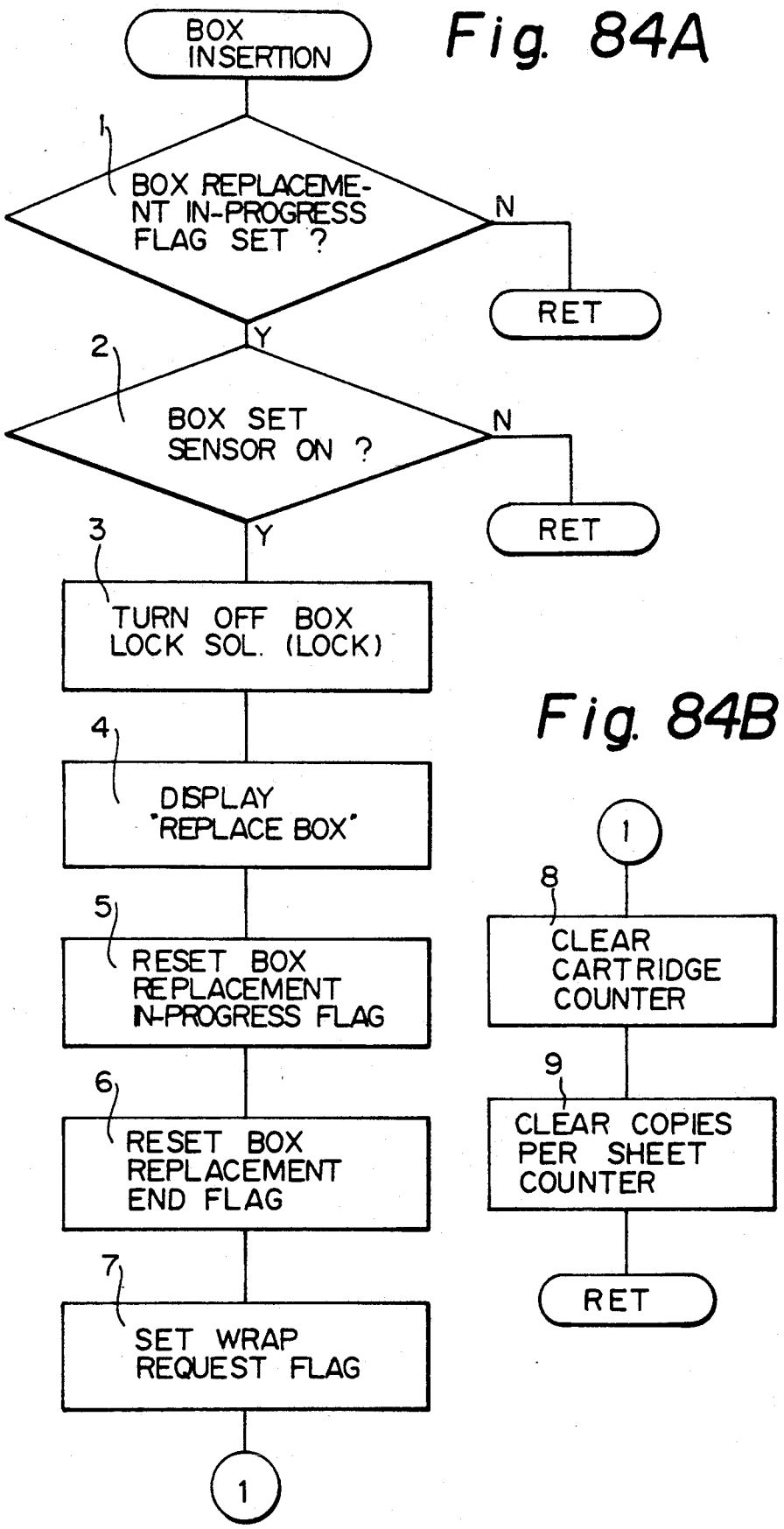
FIGS. 84A and 84B are flowcharts to be executed by the copier of FIG. 1 in the event when the box is inserted into the copier.
Figure 85:
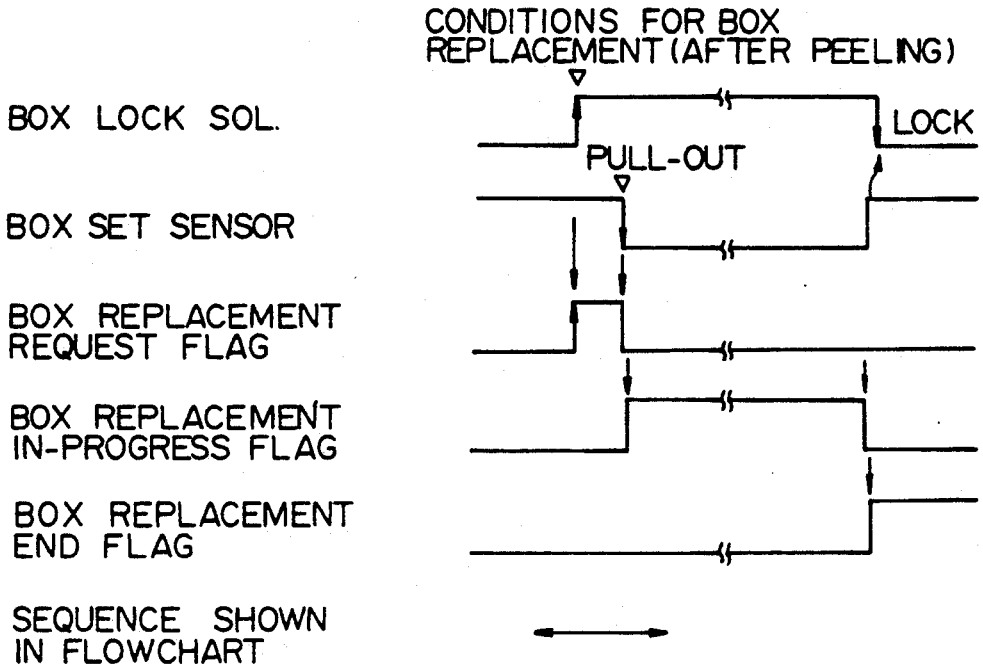
FIG. 85 is a timing chart associated with FIG. 83.
Figure 86:
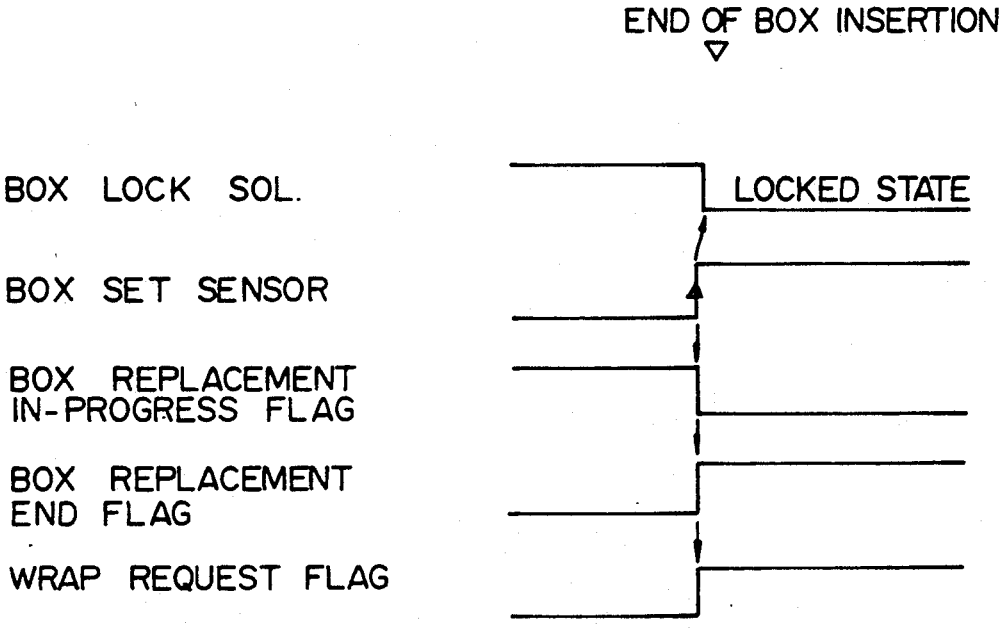
FIG. 86 is a timing chart associated with FIG. 84.

Specifically, as shown in FIG. 83, whether or not any one of the above-stated three conditions is reached is determined (steps 3–5). Among them, whether or not the waste toner bottle is full is determined by a piezoelectric sensor or similar sensing means. If any one of such conditions is reached and the box (MFP) is not pulled out (Y, step 7), an unlocking operation is performed (lock solenoid (MFP LOCK SOL) 707 ON) (steps 8–11) while a predetermined message is displayed. When a new box is inserted into the apparatus body, a procedure shown in FIG. 84 is executed to perform a locking operation. The locking operation is demonstrated in FIG. 86. FIG. 80 shows a procedure similar to the procedure of FIG. 83 with respect to the box having only the cartridge collecting section and sheet storing section. FIG. 85 is a timing chart associated with FIG. 80.

Figure 56:
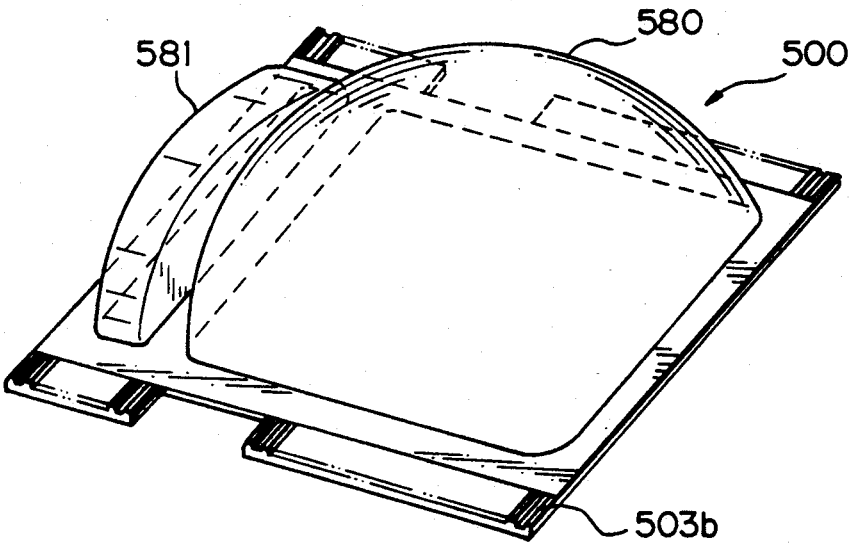
FIGS. 56 and 57 are perspective views each showing another modified form of the cartridge.
Figure 57:
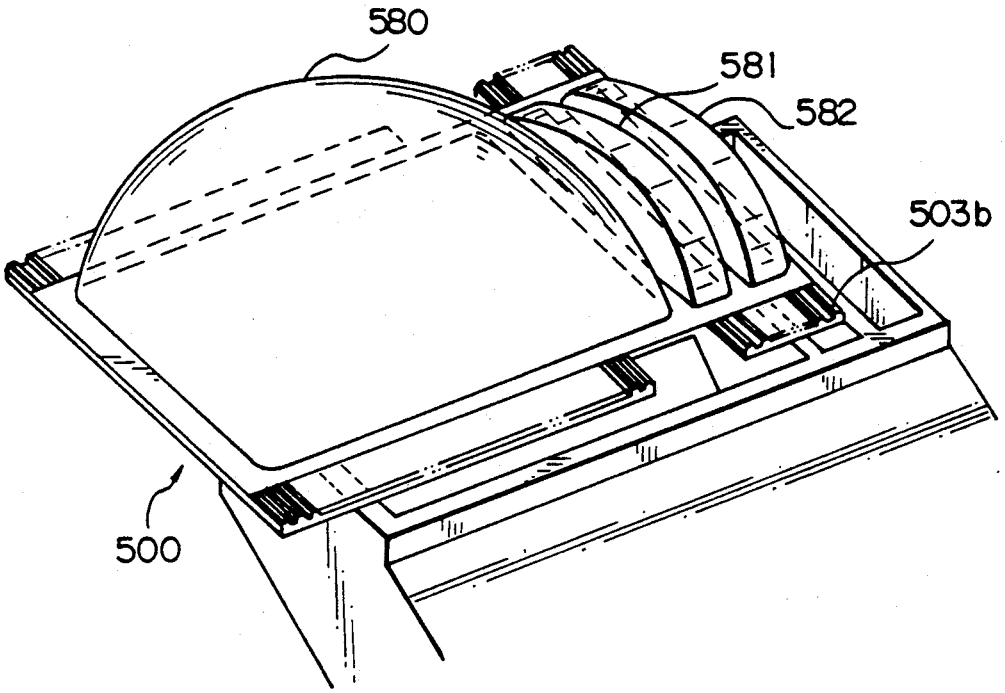

While the cartridge 500 has been shown and described as having a top plate, a bottom plate and elastic sides, it may have any one of other specific configurations which will be described. FIG. 56 shows a cartridge 500 having a plate made of hard material, a member made of rubber or similar elastic material or a film-like member adhered to the hard plate, and a film or similar sealing member sealing a toner and an agent or only a toner. When a toner and an agent are to be sealed, some air or nitrogen may be introduced to prevent them from solidifying. Specifically, the hard plate has a larger opening and a smaller opening which accommodate a toner and an agent, respectively. The larger opening and the smaller opening, therefore, serve as a toner storing section 580 and an agent storing section 581. Such a cartridge 500 is set on the developing unit to supply the agent an toner. If desired, only the toner may be sealed in the cartridge 500. FIG. 57 shows another cartridge 500 having a cleaning agent storing section 582 in addition to the toner storing section 580 and agent storing section 581. Such three compartments will be necessary when the agent and the cleaning device have different characteristics. The cartridge 500 of FIG. 57 is also made of rubber or similar elastic material. In FIG. 57, a hopper is also divided into three sections in conformity to the configuration of the cartridge 500. In any case, the toner storing section 580 is made of elastic material and, therefore, collected in a collapsed position to occupy a minimum of space. While the modified cartridges 500 each has the timing groove **503*b* at both sides thereof, the timing groove 503*b* may, of course, be provided only at one side, as has been the case with the cartridge shown in FIG. 9**.

In summary, it will be seen that the present invention provides an image forming apparatus which enhances easy and efficient supply of a developer without causing it to be scattered around, saves space by providing a cartridge collecting section with a minimum necessary volume, and allows the user to discard empty cartridges by a single operation. This not only realizes simple maintenance but also promotes the effective use of limited resources since only needless matters are discarded.

Various modifications will become possible for those skilled in the art after receiving the teachings of the present disclosure without departing from the scope thereof.

What is claimed is:

1. An image forming apparatus comprising:

a body;

an image carrier;

developing means for developing a latent image electrostatically formed on said image carrier by a developer;

cleaning means for collecting the developer remaining on said image carrier after image transfer;

waste developer storing means for storing the developer collected by said cleaning means;

developer storing means for storing a fresh supplementary toner;

a loading section to be loaded with said developer storing means;

a developer supply section to be supplied with the supplementary developer from said developer storing means;

first transporting means for transporting said developer storing means from said loading section to said developer supply section;

collecting means for collecting empty developer storing means which has supplied the developer to said developer supply section; and second transporting means for transporting said empty developer storing means from said developer supply section to said collecting means;

at least one of said collecting means and said waste developer storing means being removably mounted on said body.

2. An image forming apparatus comprising:

a body;

an image carrier;

developing means for developing a latent image electrostatically formed on said image carrier by a developer;

cleaning means for collecting the developer remaining on said image carrier after image transfer;

first transporting means for transporting the developer collected by said cleaning means to said developing means;

second transporting means for transporting a cleaning agent from said developing means to said cleaning means;

developer storing means for storing a fresh supplementary developer;

a loading section to be loaded with said developer storing means;

a developer supply section to be supplied with the supplementary developer from said developer storing means;

third transporting means for transporting said developer storing means from said loading section to said developer supply section;

collecting means removably supported by said body for collecting empty developer storing means which has supplied the developer at said developer supply section;

fourth transporting means for transporting said empty developer storing means from said developer supply section to said collecting means; and cleaning agent collecting section for collecting the cleaning agent used by said cleaning means.

3. An apparatus as claimed in claim 2, wherein said second transporting means transports the cleaning agent from said developing means to said cleaning means by way of the surface of said image carrier.

4. An apparatus as claimed in claim 2, wherein said cleaning agent collecting section has a greater volume than the developer and cleaning agent which will be discharged from said developing means and said cleaning means before the life of said body ends.

5. An image forming apparatus comprising:

a body;

an image carrier;

developing means for developing a latent image electrostatically formed on said image carrier by a toner;

cleaning means for collecting the developer remaining on said image carrier after image transfer;

waste developer storing means for storing the developer collected by said cleaning means;

developer storing means for storing a fresh supplementary toner;

loading section to be loaded with said developer storing means;

developer supply section to be supplied with the supplementary developer from said developer storing means;

first transporting means for transporting said developer storing means from said loading section to said developer supply section;

collecting means for collecting empty developer storing means which has supplied the developer to said developer supply section; and second transporting means for transporting said empty developer storing means from said developer supply section to said collecting section means;

said collecting means and said waste developer storing means being constructed integrally with each other and removably supported by said body.

6. An apparatus as claimed in claim 5, further comprising cleaning agent collecting means for storing a cleaning agent deteriorated by being used by said cleaning means, and third transporting means for transporting said deteriorated cleaning agent from said cleaning means to said cleaning agent collecting means.

7. An apparatus as claimed in claim 6, wherein said cleaning agent collecting means has a volume great enough to store the total amount of deteriorated cleaning agent which will be produced by said cleaning means before the life of said body ends.

8. An apparatus as claimed in claim 5, further comprising control means for determining a time for replacing said collecting means and said waste toner storing means constructed integrally with each other on detecting either of a condition in which the total number of said empty developer storing means collected in said collecting means has reached an upper limit of accommodation and a condition in which the developer stored in said waste developer storing means has reached an upper limit of accommodation.

9. An apparatus as claimed in claim 5, wherein said developer storing means has side walls implemented by one of an elastic member and a film-like member.

10. An apparatus as claimed in claim 5, wherein said developer storing means is so configured as to become smaller in volume thereof when empty, said collecting means for collecting said empty developer storing means being lower in height than a full developer storing means.

11. An apparatus as claimed in claim 5, wherein said developer storing means comprises a developer container to be loaded on said loading section and then transported from said loading section to said developer supply section by said first transporting means along a transport path provided in said body;

said developer container comprising:

a top wall and a bottom wall each being constituted by a flat plate member; and sides defining a confinement for storing the developer in cooperation with said top wall and said bottom wall and constituted by one of an elastic member and a film-like member;

said top wall and said bottom wall each being formed with an engaging portion engageable with a member defining said transport path.

12. An image forming apparatus comprising:

a body;

developing means for developing a latent image electrostatically formed on said image carrier by a developer;

image carrier replacing means for replacing said image carrier;

image carrier storing means for storing said image carrier;

a loading section to be loaded with said developer storing means;

a developer supply section to be supplied with the developer from said developer storing means;

first transporting means for transporting said developer storing means from said loading section to said developer supply section;

collecting means for collecting empty developer storing means which has supplied the developer at said developer supply section; and second transporting means for transporting said empty developer supply means from said developer supply section to said collecting means;

said collecting means and said image carrier storing means being constructed integrally with each other and removably supported by said body.

13. An apparatus as claimed in claim 12, further comprising:

cleaning means for collecting the developer remaining on said image carrier after image transfer; and cleaning agent storing means for storing a cleaning agent deteriorated by being used by said cleaning means.

14. An apparatus as claimed in claim 12, further comprising control means for determining a time for replacing said collecting means and said image carrier storing means constructed integrally with each other on detecting at least one of a condition in which the total number of said developer storing means collected in said collecting means reaches an upper limit of accommodation and a condition in which the number of times that an image forming operation using said image carrier is repeated reaches a limit of durability of said image carrier.

15. An apparatus as claimed in claim 14, wherein said collecting means has a volume which becomes full when collected a particular number of said developer storing means capable of accommodating the total amount of developer great enough to supplement developer consumption occurring until the number of times that an image forming operation using said image carrier reaches a limit of durability of said image carrier.

16. An image forming apparatus comprising:

a body;

an image carrier;

developing means for developing a latent image electrostatically formed on said image carrier by a developer;

image carrier replacing means for replacing said image carrier;

image carrier storing means for storing said image carrier;

cleaning means for collecting the developer remaining on said image carrier after image transfer;

waste developer storing means for storing the developer collected by said cleaning means;

developer storing means for storing a fresh supplementary developer;

a loading section to be loaded with said developer storing means;

a developer supply section to be supplied with the developer from said developer storing means;

first transporting means for transporting said developer storing means from said loading section to said developer supply section;

collecting means for collecting empty developer storing means which has supplied the developer at said developer supply section; and second transporting means for transporting said empty developer storing means from said developer supply section to said collecting means;

said collecting means, said waste developer storing means and said image carrier storing means being constructed integrally with each other and removably supported by said body.

17. An apparatus as claimed in claim 16, further comprising:

cleaning agent storing means for storing a cleaning agent deteriorated by being used by said cleaning device; and third transporting means for transporting the deteriorated cleaning agent from said cleaning means to said cleaning agent storing means.

18. An apparatus as claimed in claim 16, further comprising control means for determining a time for replacing said collecting means, said waste developer storing means and said image carrier storing means constructed integrally with each other on detecting at least one of a condition in which the total number of said developer storing means collected in said collecting means reaches an upper limit of accommodation, a condition in which the number of times that an image forming operation using said image carrier is repeated reaches a limit of durability of said image carrier, and a condition in which the amount of the developer stored in said waste developer storing means reaches an upper limit of accommodation.

19. An apparatus as claimed in claim 16, further comprising a developer and cleaning agent collecting means for collecting the developer used by said developing means and the cleaning agent used by said cleaning means from said developing means and said cleaning means, respectively, said developer and cleaning agent collecting means having a greater volume than said developer and said cleaning agent which will be discharged from said developing means and said cleaning means before the life of said body ends.

20. An apparatus as claimed in claim 16, further comprising:

a waste developer receiving section in which the waste developer collected by said cleaning means is introduced;

a waste developer compressing and storing section for storing said waste developer introduced in said waste developer receiving section while compressing said waste developer; and feeding means for feeding said waste developer introduced in said waste developer receiving section to said waste toner compressing and storing section.

* * * * *